US011564434B2

(12) United States Patent
Gati

(10) Patent No.: US 11,564,434 B2
(45) Date of Patent: Jan. 31, 2023

(54) METHODS AND APPARATUS FOR ADJUSTING THE FIT PROFILE OF CLOTHING ITEMS

(71) Applicant: George Gati, Riviera Beach, FL (US)

(72) Inventor: George Gati, Riviera Beach, FL (US)

( * ) Notice: Subject to any disclaimer, the term of this patent is extended or adjusted under 35 U.S.C. 154(b) by 0 days.

(21) Appl. No.: 17/484,392

(22) Filed: Sep. 24, 2021

(65) Prior Publication Data

US 2022/0030997 A1 Feb. 3, 2022

Related U.S. Application Data

(63) Continuation-in-part of application No. 16/900,892, filed on Jun. 13, 2020, now abandoned.

(51) Int. Cl.

| | |
|---|---|
| ***A41F 17/00*** | (2006.01) |
| ***A41F 9/00*** | (2006.01) |
| *A41F 18/00* | (2006.01) |

(52) U.S. Cl.

CPC ..... *A41F 17/00* (2013.01); *A41F 9/00* (2013.01); *A41B 2400/80* (2013.01); *A41F 18/00* (2013.01)

(58) Field of Classification Search

CPC ..... A41F 17/00; A41F 9/00; A41F 18/00; A41B 2400/80; A47C 20/025; A61F 5/028; A61F 5/03; A61F 5/24; A61F 13/148

USPC ..... 2/464; 128/96.1

See application file for complete search history.

(56) References Cited

U.S. PATENT DOCUMENTS

| | | | | |
|---|---|---|---|---|
| 3,501,775 A * | 3/1970 | Demers et al. | ..... | A41F 9/002 2/321 |
| 5,758,366 A * | 6/1998 | Wilson | ..... | A41F 9/02 2/311 |
| 5,953,749 A * | 9/1999 | Backs | ..... | A61G 7/065 128/845 |
| 2016/0249693 A1* | 9/2016 | Guerrero | ..... | A63B 71/143 2/21 |

* cited by examiner

*Primary Examiner* — Nathan E Durham
*Assistant Examiner* — Abby M Spatz
(74) *Attorney, Agent, or Firm* — Raymond J. Werner

(57) ABSTRACT

A foam rubber structure, with a base portion with a first rectangular cross-section, a first bevel portion with a first triangular cross-section superjacent the base portion, a first closure region at a first end of the foam rubber structure, and a second closure region at a second end of the foam rubber structure, a first portion of a hook and loop fastener attached to the first closure region, and a second portion of the hook and loop fastener attached to the second closure region, wherein the first closure region has a second rectangular cross-section that is different than the first rectangular cross-section, a second bevel portion with a second triangular cross-section different from the first triangular cross-section, the second closure region has a third rectangular cross-section different than the first rectangular cross-section, and a third bevel portion with a third triangular cross-section different from the first triangular cross-section and different from the second triangular cross-section.

15 Claims, 47 Drawing Sheets

102
812
802
113
814
816
804
107
801
Closure Region B
z
x 102
820
818
113
811
822
107
801
Closure Region B 102
824
113
H_total
826
803
828
107
801
Closure Region B
z
x 102
830
113
834
811
832
107
801
Closure Region B 102
836
113
838
811
840
107
801
Closure Region B
z
x Closure Region B
107

102
842
113
844
811
801
846

102
848
113
42 44 46
850
852
107
Closure Region B
z
x 854
102
113
S M L
856
858
801
107
Closure Region B

METHODS AND APPARATUS FOR ADJUSTING THE FIT PROFILE OF CLOTHING ITEMS

CROSS-REFERENCE TO RELATED APPLICATIONS

This application is a continuation-in-part of, and claims priority to, co-pending U.S. application Ser. No. 16/900,892, filed 13 Jun. 2020, entitled "Methods and Apparatus for Adjusting The Fit Profile Of Clothing Items," the entirety of which is hereby incorporated by reference.

FIELD

The present application relates to methods and apparatus for adjusting the fit profile of clothing items.

BACKGROUND

Fit is an important aspect of fashion. While many items of clothing are designed for people having either thin or athletic forms, significant portions of the population have figures that do not correspond with the thin or athletic categories of clothing cuts and styles. For many people, off-the-shelf clothing often does not fit well. By way of example, a man having a gut and butt that do not correspond to the cut and fit of commonly-sized off-the-shelf pants may find it necessary to purchase pants with a fit profile that results in the waist of those pants slipping below the gut and consequently being held up only very loosely, or not at all. The combination of a person's non-thin or non-athletic shape coupled with commonly-sized off-the-shelf pants may result in those pants sliding down when the wearer is in the standing position thus creating a socially awkward and embarrassing moment. Additionally, the poor fit profile of this combination also adversely affects those wearers that tuck in their shirts. That is, the tails of a tucked-in shirt tend to ride up and over the waist of the aforementioned pants.

What is needed are methods and apparatus for providing a better match, i.e., a better fit profile, for the non-thin or non-athletic shaped wearer of commonly-sized off-the-shelf pants.

BRIEF DESCRIPTION OF THE DRAWINGS

Aspects of the present disclosure are best understood from the following detailed description when read with the accompanying figures. It is noted that, various features may not be drawn to scale. In fact, the dimensions of the various features may be arbitrarily increased or reduced for clarity of discussion.

FIG. 1C shows a gap between closure region A 103 and Closure Region B 107. In some implementations of the aforementioned various embodiments, the illustrated gap would not be present in a closed configuration of the foam belt.

DETAILED DESCRIPTION

Various example embodiments herein relate to methods and apparatus for adjusting the fit profile of clothing.

Figure 1A:
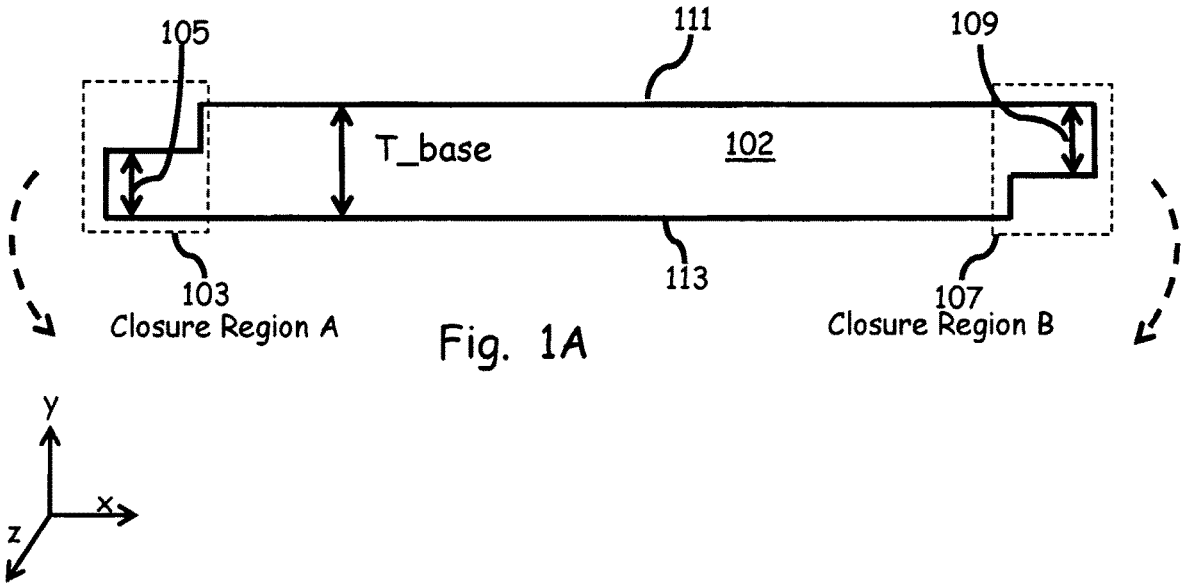
FIG. 1A is a top view, i.e., looking down in the z-direction, of an apparatus in an open configuration in accordance with this disclosure.

FIG. 1A is a top view of an apparatus in an open configuration in accordance with this disclosure. More specifically, FIG. 1A illustrates a foam belt 102 in an open configuration. Foam belt 102 has a base portion with a thickness T_base, a first closure region 103 (Closure Region A) having a thickness 105 (T_base_A), and a second closure region 107 (Closure Region B) having a thickness 109 (T_base_B). Foam belt 102 has a first surface 111 and a second surface 113. First surface 111 has a first coefficient of friction in the open configuration, and a first coefficient of friction in the closed configuration. Likewise, second surface 113 has a second coefficient of friction in the open configuration, and a second coefficient of friction in the closed configuration. In some embodiments, the first coefficient of friction in the open configuration may be, but is not required to be, nominally equal to the second coefficient of friction in the open configuration.

In this illustrative embodiment, foam belt 102 is made of a foam rubber. By way of example, and not limitation, the foam rubber may be a polyurethane foam rubber or a latex foam rubber. The foam rubber has a density, an indentation load deflection, and a cell type. In this illustrative embodiment, the foam rubber has an open-cell structure.

Figure 1B:
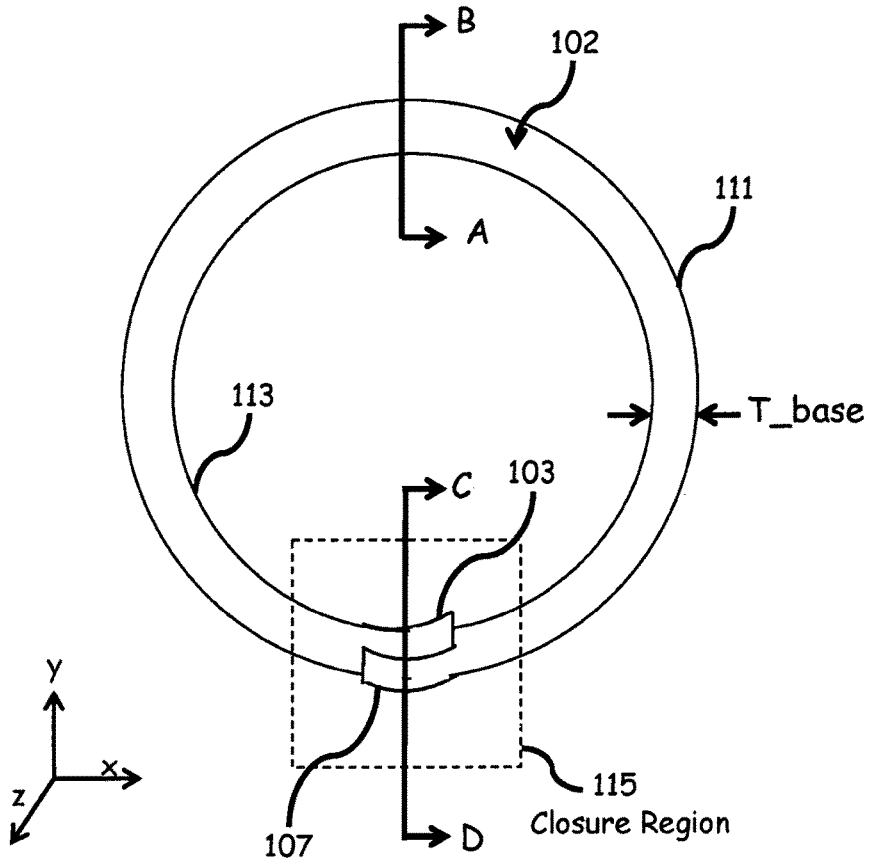
FIG. 1B is a top, i.e., looking down in the z-direction, view of an apparatus in a closed configuration in accordance with this disclosure.

FIG. 1B is a top view of the apparatus of FIG. 1A in a closed configuration. In the closed configuration, at least a portion of Closure Region A 103 and at least a portion of Closure Region B 107 are detachably attached to each other so as to form a closure region 115. Foam belt 102 in the closed configuration has an outer surface, referred to above as first surface 111, and an inner surface, referred to above as second surface 113. Hereinafter, for the sake of convenience, discussion of foam belt 102 will use the terms outer surface 111 and inner surface 113. It will be appreciated that at the base portion of foam belt 102, the circumference of outer surface 111 is greater than the circumference of inner surface 113 because the radius of outer surface 111 is greater than the radius of inner surface 113 by the thickness, T_base, of the base portion of foam belt 102. Thus, outer surface 111, relative to inner surface 113 is in a greater state of tension in the circumferential direction; and inner surface 113, relative to outer surface 111 is in a greater state of compression in the circumferential direction.

It is noted that various embodiments in accordance with this disclosure may be implemented such that foam belt 102 has a color selected from a wide range of commercially available colors.

Still referring to FIG. 1B, the closed configuration may be achieved with an attachment mechanism, for example a fastener. By way of example, and not limitation, a hook and loop fastener may be an attachment mechanism. In such an arrangement, one of Closure Region A and Closure Region B has a hook portion of a hook and loop fastener disposed thereon, and the other has a loop portion of the hook and loop fastener disposed thereon. Similarly, snaps may be used as an attachment mechanism. Likewise, magnets may be used as an attachment mechanism, and are described in greater below in connection with FIGS. 9A-9F, 10, and 11A-11E. Other suitable means for achieving the closed configuration of foam belt 102 may be used.

Figure 1C:
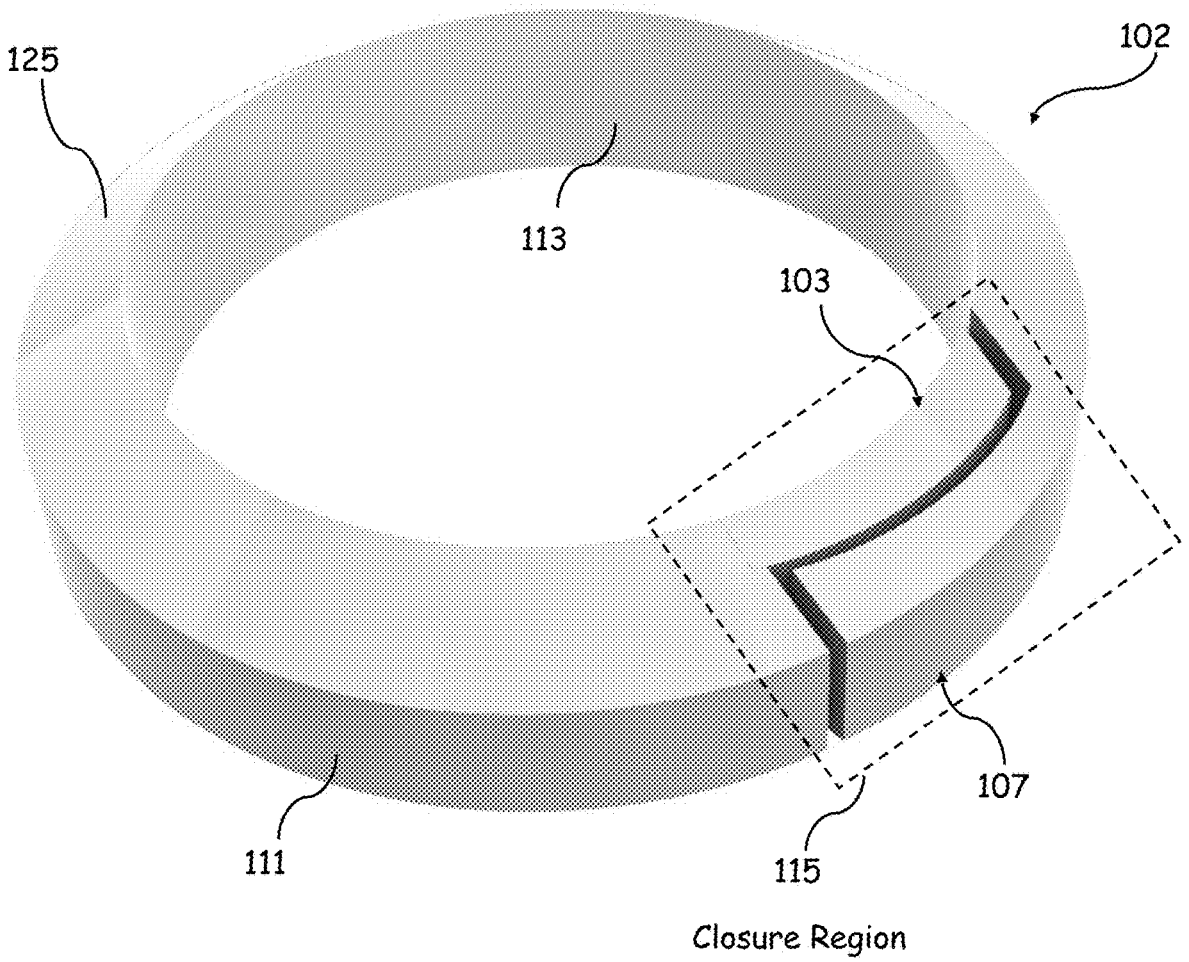
FIG. 1C is an idealized 3D rendering of the foam belt of FIG. 1B. Solely for the purpose of explaining foam belts in accordance with various embodiments of this disclosure.

FIG. 1C is an idealized 3D rendering of the foam belt of FIG. 1B. Solely for the purpose of explaining foam belts in accordance with various embodiments of this disclosure, FIG. 1C shows a gap between Closure Region A 103 and Closure Region B 107. In some implementations of the aforementioned various embodiments, the illustrated gap width in Closure Region 115 between Closure Region A 103 and Closure Region B 107 would not necessarily be present in a closed configuration of foam belt 102. Also illustrated in FIG. 1C is the beveled (i.e., sloped) top surface 125 of illustrative foam belt 102.

Figure 2A:
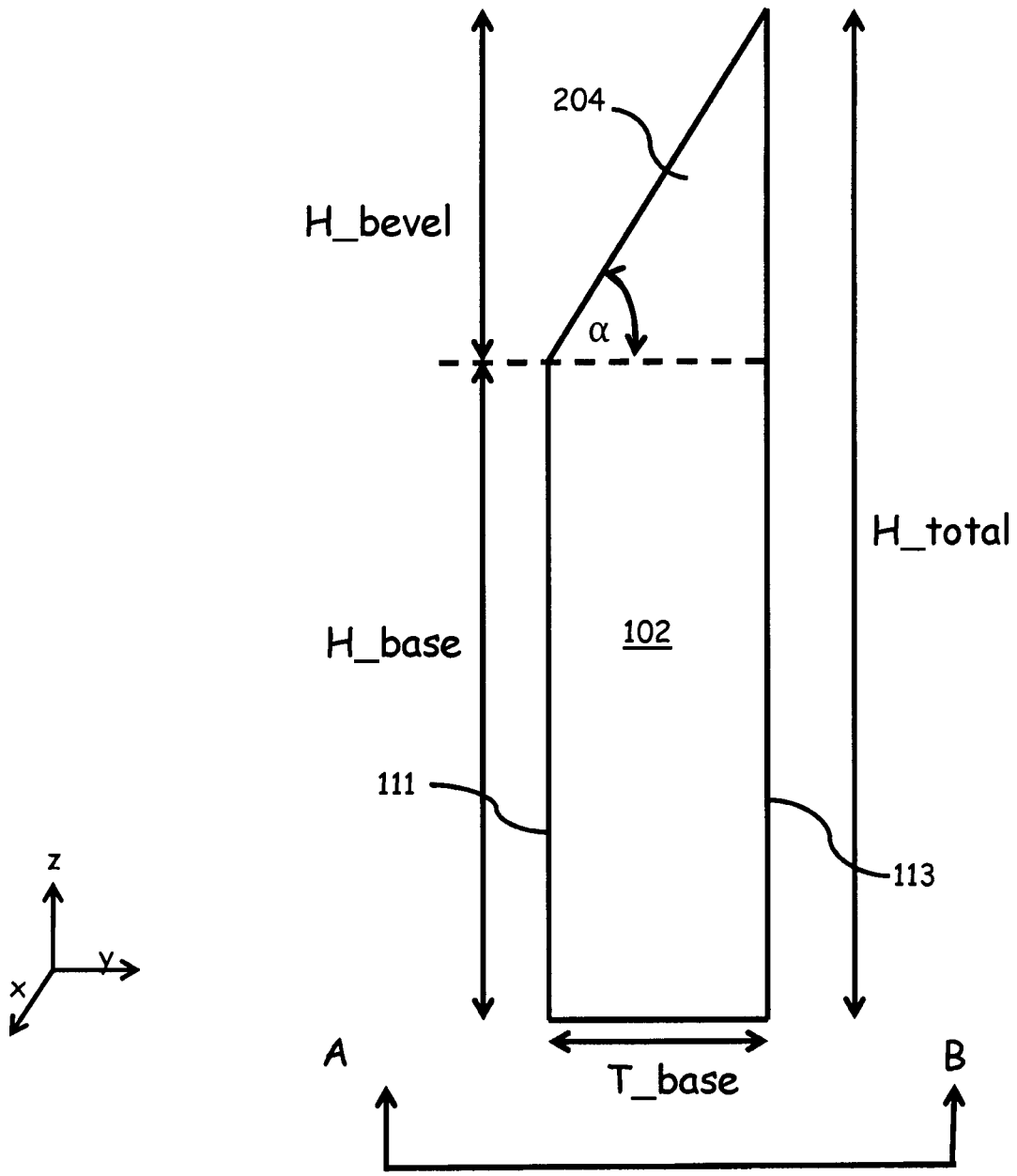
FIG. 2A is a cross-sectional view, i.e., the x-axis is perpendicular to the plane of the page, of the non-closure region of the apparatus of FIG. 1B taken across line AB in FIG. 1B, and including the beveled portion.

FIG. 2A illustrates a cross-section of foam belt 102 shown in FIG. 1B taken across line AB. Foam belt 102 includes a base portion 202 having a rectangular cross-section, and further includes a bevel portion 204 having a triangular cross-section. Base portion 202 has a thickness, T_base, and a height H_base. Bevel portion 204 has a height H_bevel, and a slope specified herein by the angle $\alpha$ ($\angle\alpha$) as shown in FIG. 2A.

Figure 2B:
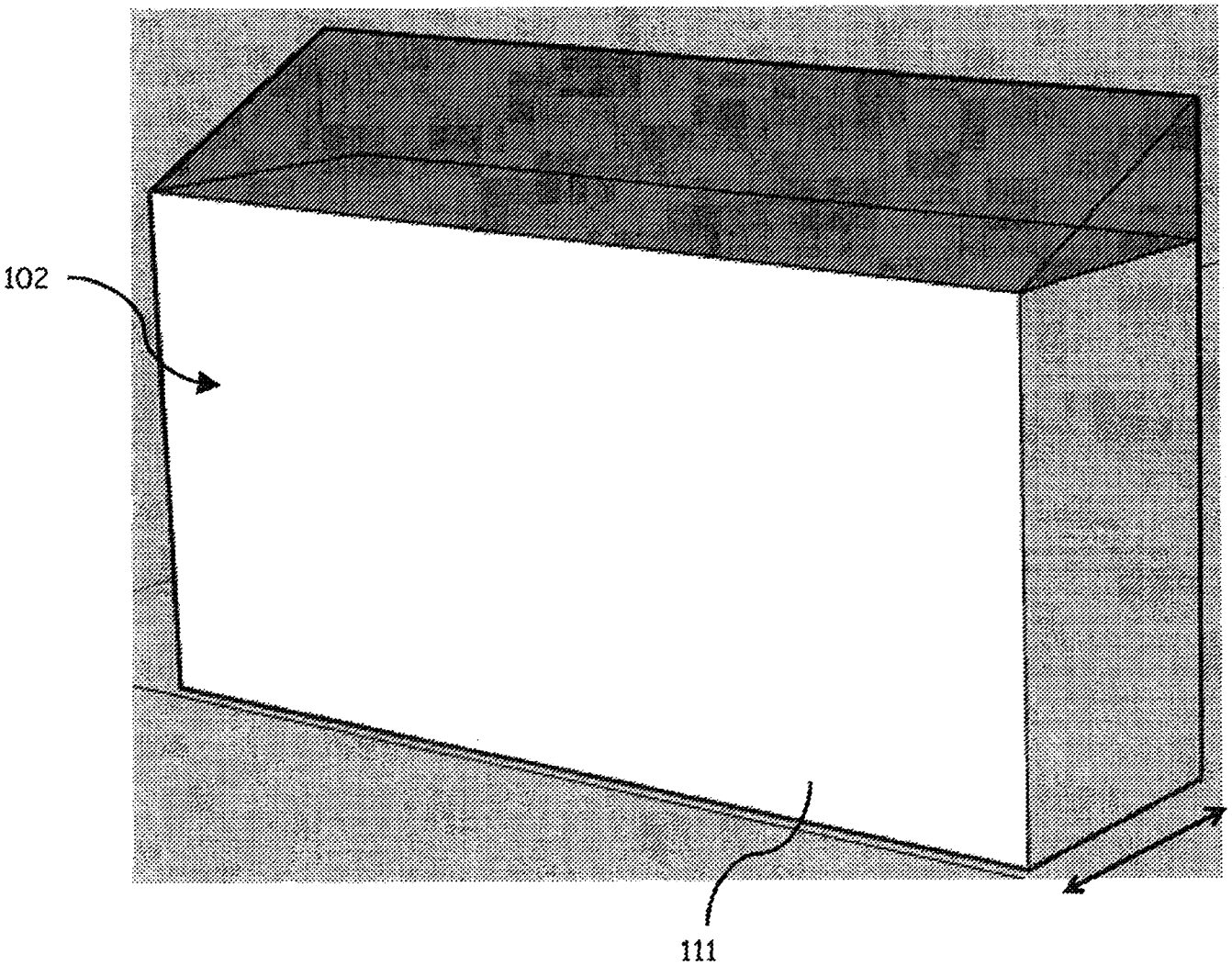
FIG. 2B is a perspective view of the non-closure region of the apparatus of FIG. 1B providing a different view of the beveled portion.

FIG. 2B is a perspective view of the non-closure region of the apparatus of FIG. 1B providing a different view of the beveled portion. The perspective provide shows illustrative foam belt 102 with outer surface 111 appearing as the major surface in this drawing figure, and with the beveled portion shown extending longitudinally along illustrative foam belt 102.

Figure 2C:
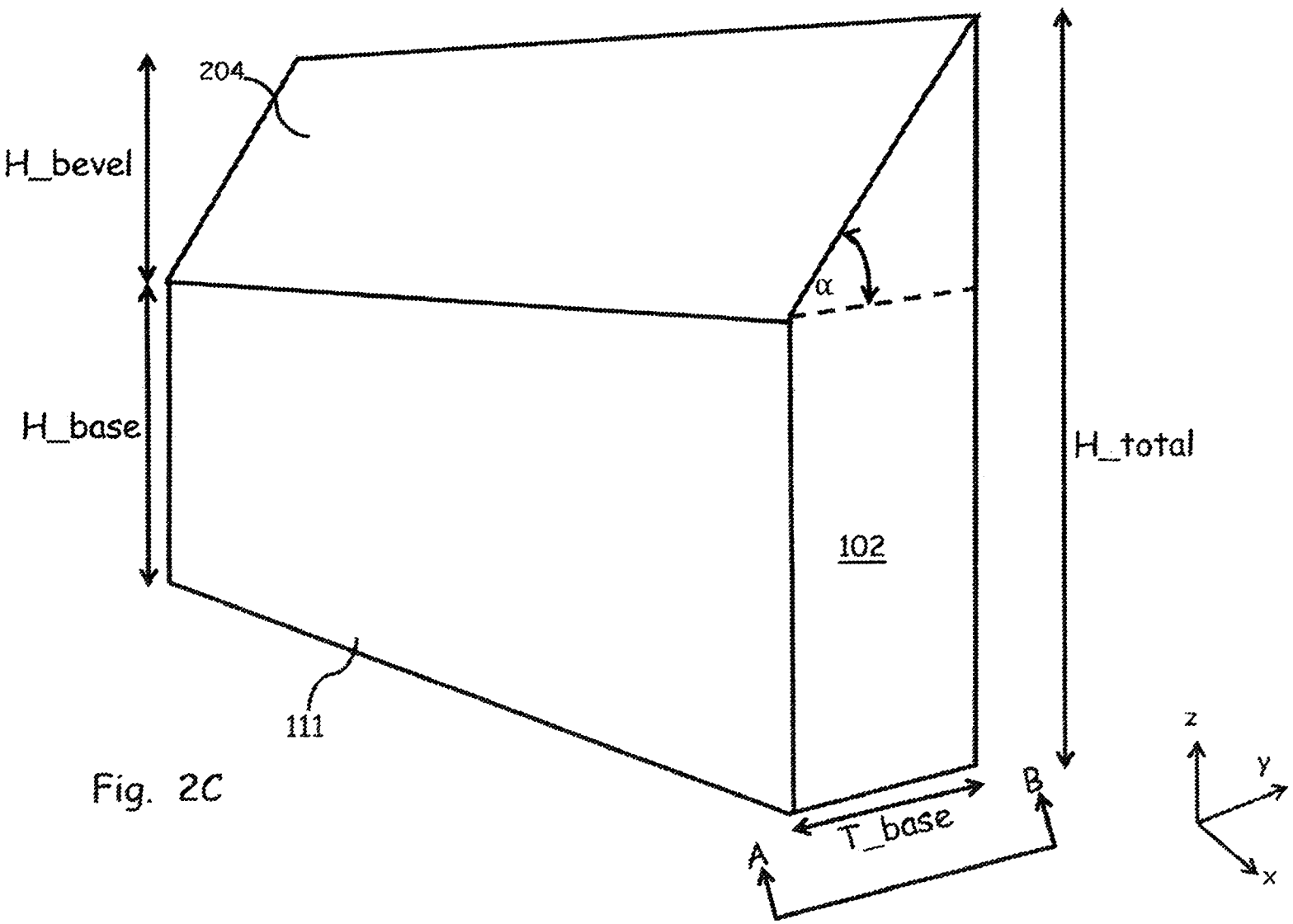
FIG. 2C is a perspective view of the non-closure region of the apparatus of FIG. 1B providing additional details.

FIG. 2C is a perspective view of the non-closure region of the apparatus of FIG. 1B illustrating additional details from those shown in FIG. 2B. FIG. 2C shows the height of the base (H_base) and the height of a bevel (H_bevel) 204. It can be seen in FIG. 2C that the total height (H_total) of illustrative foam belt 102 is equal to the sum of H_base plus H_bevel. The thickness of illustrative foam belt 102, T_base, and the slope, $\angle\alpha$, of bevel 204 are also shown in this perspective view. The $\angle\alpha$ is shown with respect to a dashed line. The dashed line is a phantom line and does not represent a structural part of the illustrative foam belt 102, rather the dashed line is for the convenience of expressing the slope of bevel 204. The dashed line is parallel to the longitudinal bottom cross-section of illustrative foam belt 102.

In one illustrative embodiment in accordance with FIGS. 2A-2C, T_base is nominally 25 mm, H_base is nominally 50 mm, and H_bevel is nominally 20 mm. In this illustrative embodiment, the ratio of the height of the bevel portion to the height of the base portion (H_bevel/H_base) is nominally 0.4. Various other embodiments may be implemented with the ratio H_bevel/H_base having other values. For example, in other embodiments the ratio H_bevel/H_base may be in the range of 0.3 to 0.5. In still other embodiments, the ratio H_bevel/H_base may be in the range of 0.2 to 0.6.

Figure 2D:
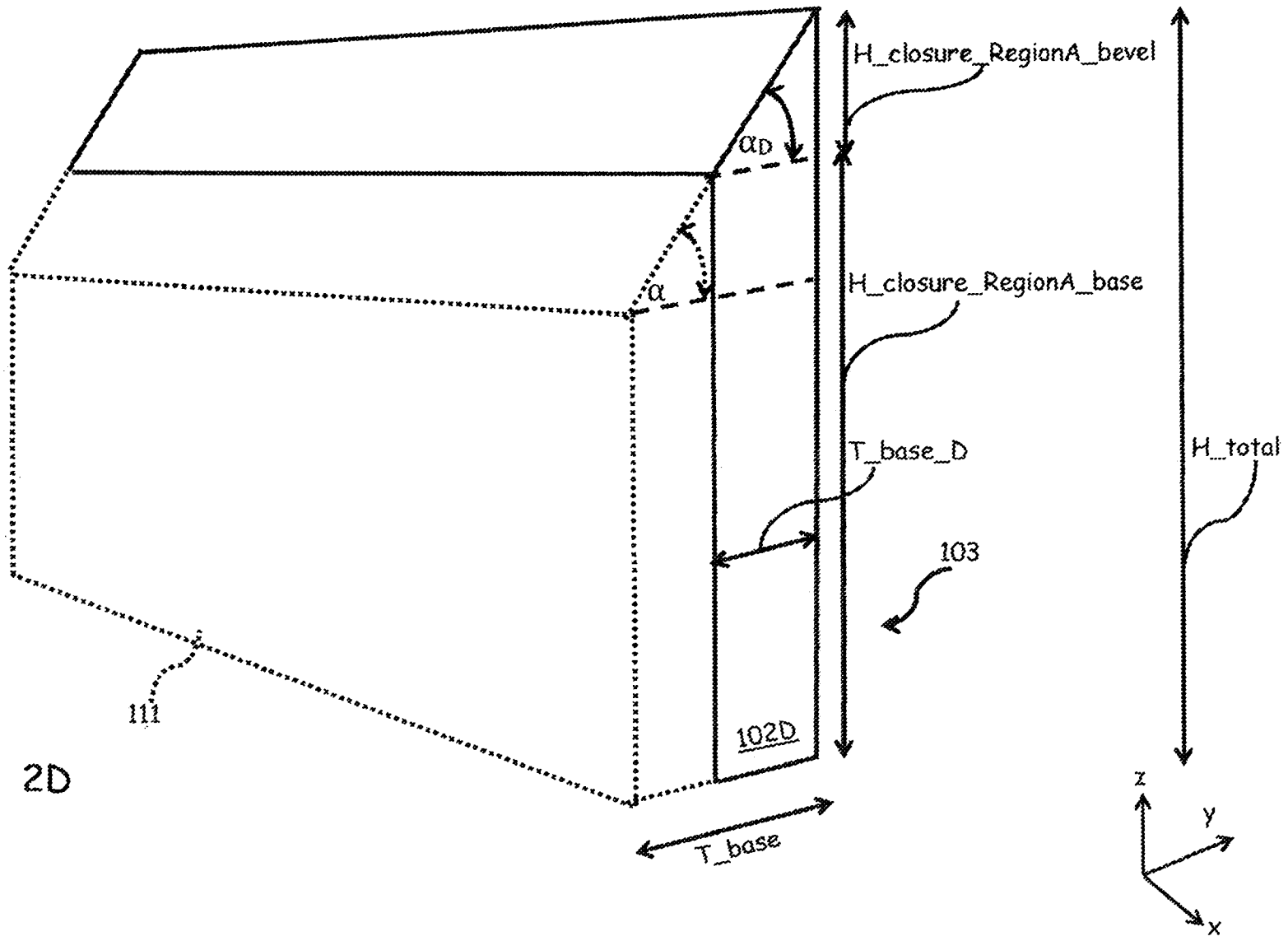
FIG. 2D is a perspective view of Closure Region A of the apparatus of FIGS. 1A-1B. The dashed lines represent a cutout portion of the foam belt in closure region A. The heights of the base and bevel portions of Closure Region A are shown relative to the total height of the foam belt.

FIG. 2D is a perspective view of Closure Region A of the apparatus of FIGS. 1A-1B. The dashed lines represent a cutout portion of the foam belt in Closure Region A. The heights of the base and bevel portions of Closure Region A are shown relative to the total height of the foam belt. The height, H_Closure_RegionA_base, plus the height, H_Closure_RegionA_bevel, equals the height H_total, as indicated in FIG. 2D. FIG. 2D further shows the thickness, T_base, of the foam rubber prior to removing a portion thereof to form the cutout, is greater than the thickness, T_base_D, of the foam rubber after removal of a portion thereof to form the cutout. See FIG. 12C for a different perspective view showing Closure Region A including the Closure Region cutout as it appears in the context of the rest of the foam rubber workpiece. Also see FIG. 12G for a view of the foam rubber removed from the Closure Region A cutout.

Figure 2E:
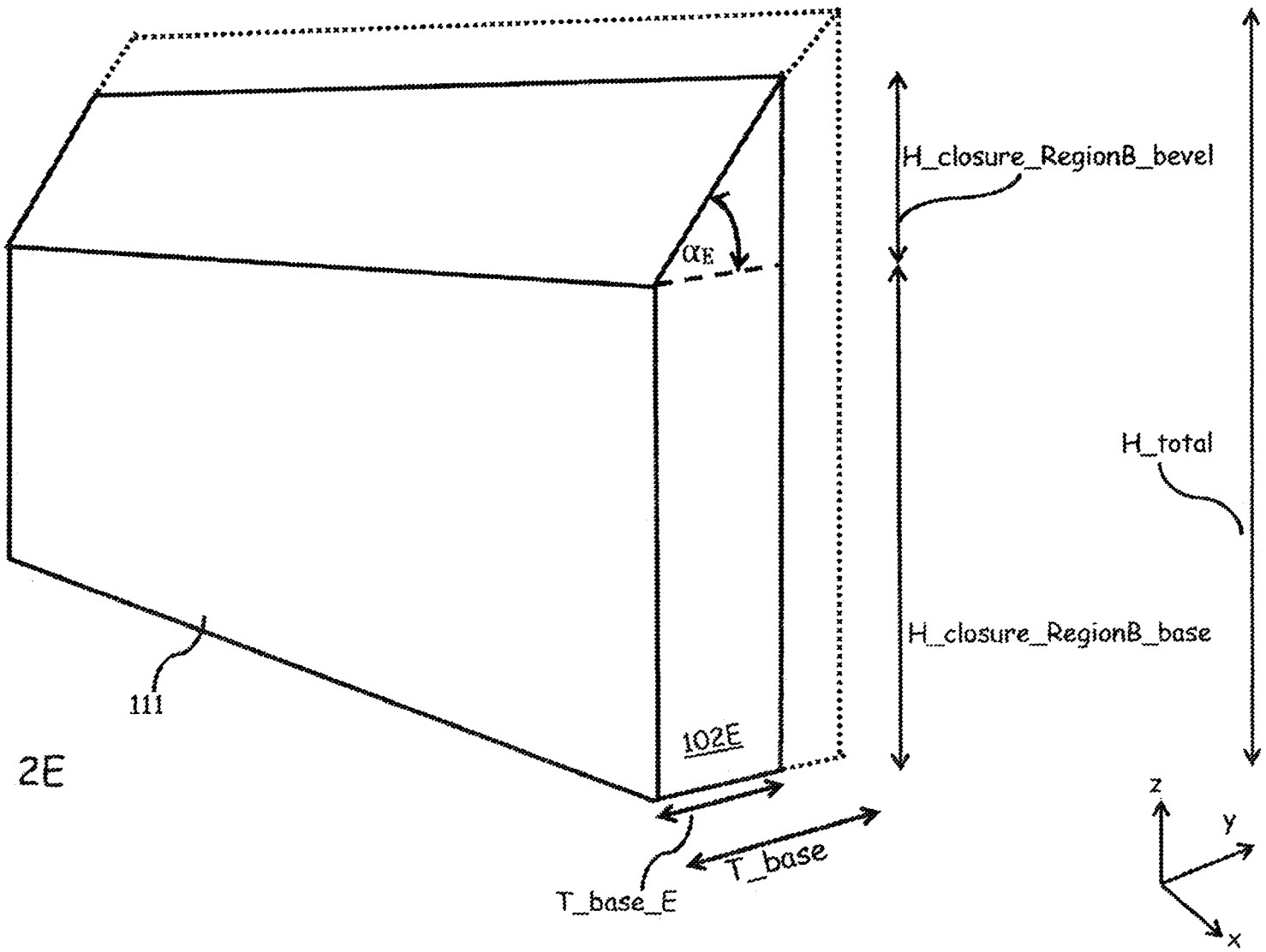
FIG. 2E is a perspective view of Closure Region B of the apparatus of FIGS. 1A-1B. The dashed lines represent a cutout portion of the foam belt in Closure Region B. The heights of the base and bevel portions of Closure Region B are shown relative to the total height of the foam belt.

FIG. 2E is a perspective view of Closure Region B of the apparatus of FIGS. 1A-1B. The dashed lines represent a cutout portion of the foam belt in Closure Region B. The heights of the base and bevel portions of Closure Region B are shown relative to the total height of the foam belt. The heights of the base and bevel portions of Closure Region B are shown relative to the total height, H_total, of the foam belt. The height, H_Closure_RegionB_base, plus the height, H_Closure_RegionB_bevel, is less than the height H_total, as indicated in FIG. 2E. FIG. 2E further shows the thickness, T_base, of the foam rubber prior to removing a portion thereof to form the Closure Region B cutout, is greater than the thickness, T_base_E, of the foam rubber after removal of a portion thereof to form the Closure Region B cutout. It is noted that height, H_Closure_RegionB_base, is equal to the height, H_base, because they are both measured from the bottom of the foam belt to the beginning of the most forward beveled top surface, i.e., the bevel closest to the outer surface 111 (see FIGS. 2A and 2C together with FIG. 2E). And see FIG. 12E for a different perspective view showing Closure Region B including the Closure Region B cutout as it appears in the context of the rest of the foam rubber workpiece. Also see FIG. 12H for a view of the foam rubber removed from the Closure Region B cutout.

Figure 3A:
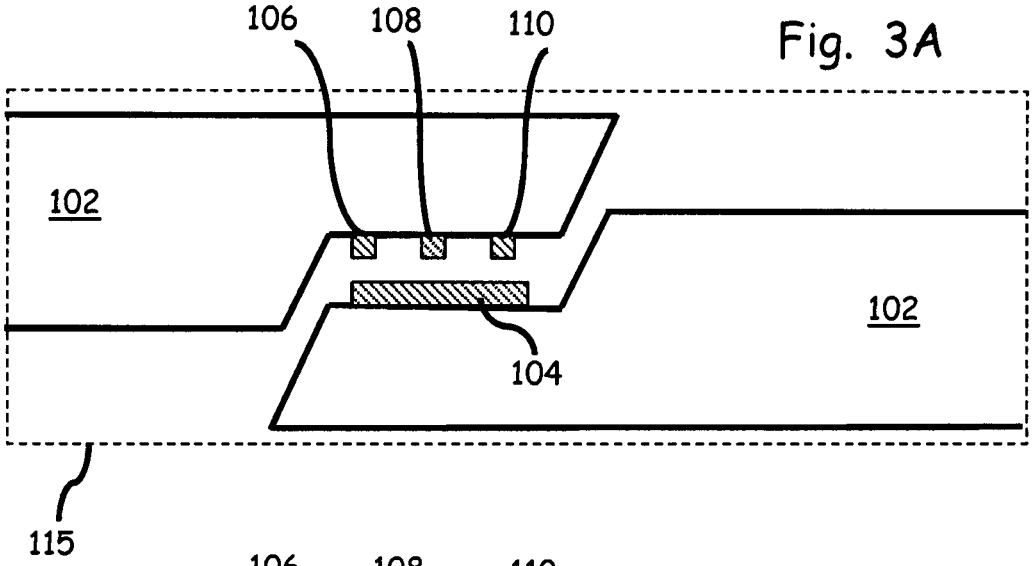
FIG. 3A is a top view of the closure region of a first embodiment showing a first amount of overlap between Closure Region A and Closure Region B prior to engagement.
Figure 3B:
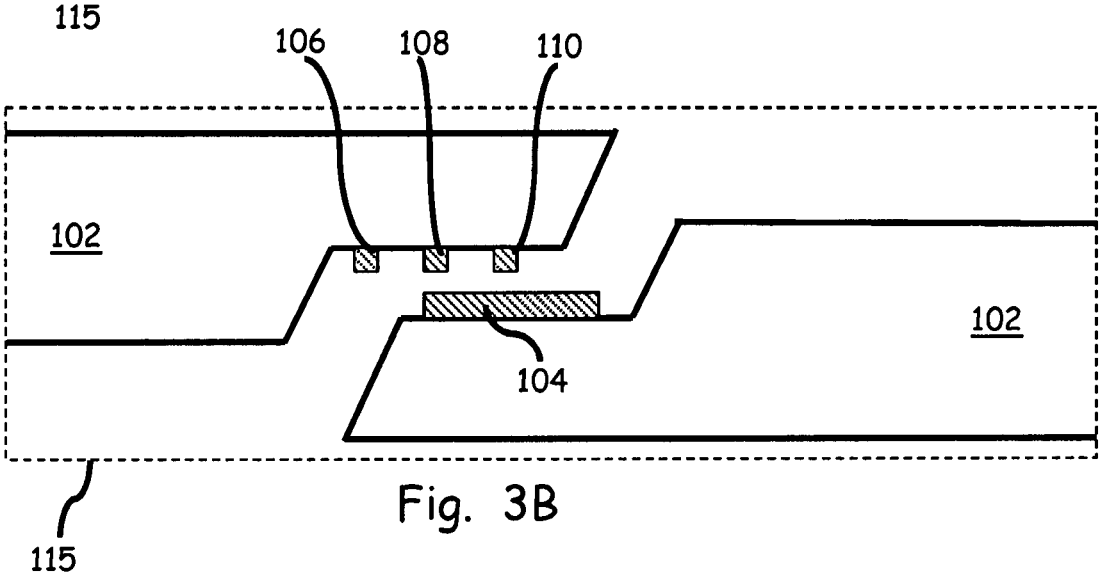
FIG. 3B is a top view of the closure region of the first embodiment showing a second amount of overlap between Closure Region A and Closure Region B prior to engagement.
Figure 3C:
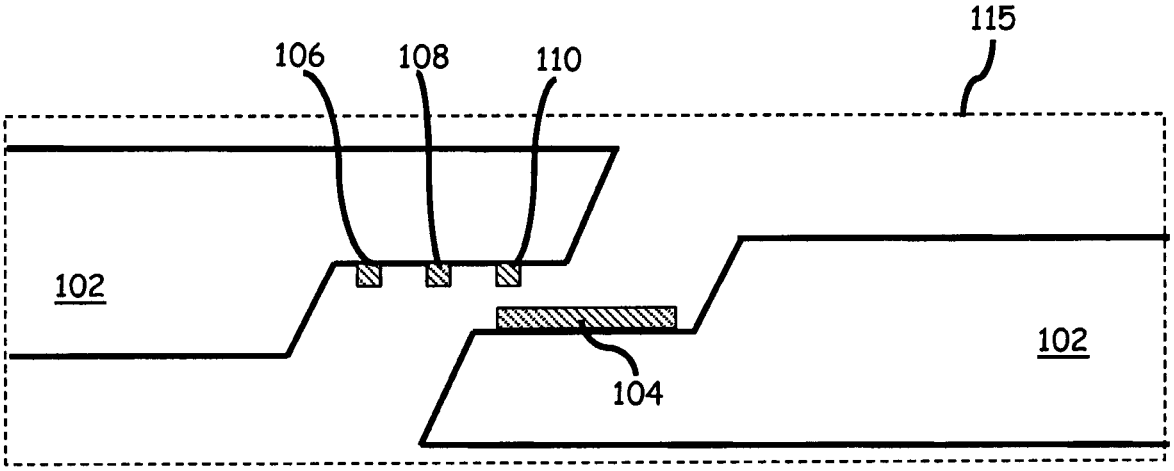
FIG. 3C is a top view of the closure region of the first embodiment showing a third amount of overlap between Closure Region A and Closure Region B prior to engagement.

Various factors may influence the coefficients of friction described above. For example, the density, indentation load deflection (ILD), cell type, and thickness are factors that may be varied in the design of a foam belt in accordance with this disclosure FIGS. 3A-3C illustrate the overlap of Closure Region A and Closure Region B, prior to attachment, used to achieve different belt circumferences in this illustrative embodiment. FIG. 3A shows Closure Region A of foam belt 102 having a loop portion 104 of a hook and loop fastener disposed thereon. FIG. 3A also shows Closure Region B of foam belt 102 having a plurality of hook portions 106, 108, 110, disposed on foam belt 102 in a spaced-apart pattern. The alignment of hook portions 106, 108, 110 to loop portion 104 is such that when moved into engagement, each of hook portions 106, 108, 110 engages with loop portion 104, thereby placing foam belt 102 into the closed configuration. In this illustrative embodiment, loop portion 104 is attached to foam belt 102 by an adhesive, and hook portions 106, 108, 110 are likewise attached to foam belt 102 by an adhesive. Alternatively, loop portion 104 may be attached to foam belt 102 by sewing; and hook portion 106, 108, 110 may be attached to foam belt 102 by sewing. Further alternatives include, but are not limited to, attaching loop portion 104 to foam belt 102 by both sewing and adhesive. Still further alternatives include, but are not limited to, attaching hook portions 106, 108, 110 to foam belt 102 by both sewing and adhesive. In the illustrative embodiment of FIGS. 3A-3C, loop portion 104 extends horizontally beyond the point at which hook portion 110 aligns for engagement with loop portion 104. Extending loop portion 104 in this manner gives it greater adhesion to the underlying foam. In this way, the possibility of loop portion being unintentionally removed from the underlying foam 102 may be reduced or eliminated.

It is noted that both the hook portions and the loop portions of the hook and loop fastener have a color that may be selected from a wide range of commercially available colors. Although both the hook portion and the loop portion of the hook and loop fastener may have the same color, various embodiments in accordance with this disclosure are not so limited. That is, the hook portion may have a color that is different from the color of the loop portion. Moreover, the hook portion may match or be different from the color of foam belt 102. Likewise, the color of the loop portion may match or be different from the color of foam belt 102.

FIG. 3B is similar to FIG. 3A except that the alignment of hook portions 106, 108, 110 to loop portion 104 is such that when moved into engagement, only hook portions 108 and 110 engage with loop portion 104, thereby placing foam belt 102 into the closed configuration with a larger circumference than the configuration of FIG. 3A.

FIG. 3C is similar to FIG. 3B except that the alignment of hook portions 106, 108, 110 to loop portion 104 is such that when moved into engagement, only hook portion 110 engages with loop portion 104, thereby placing foam belt 102 into the closed configuration with a larger circumference than the configuration of FIG. 3B.

Figure 3D:
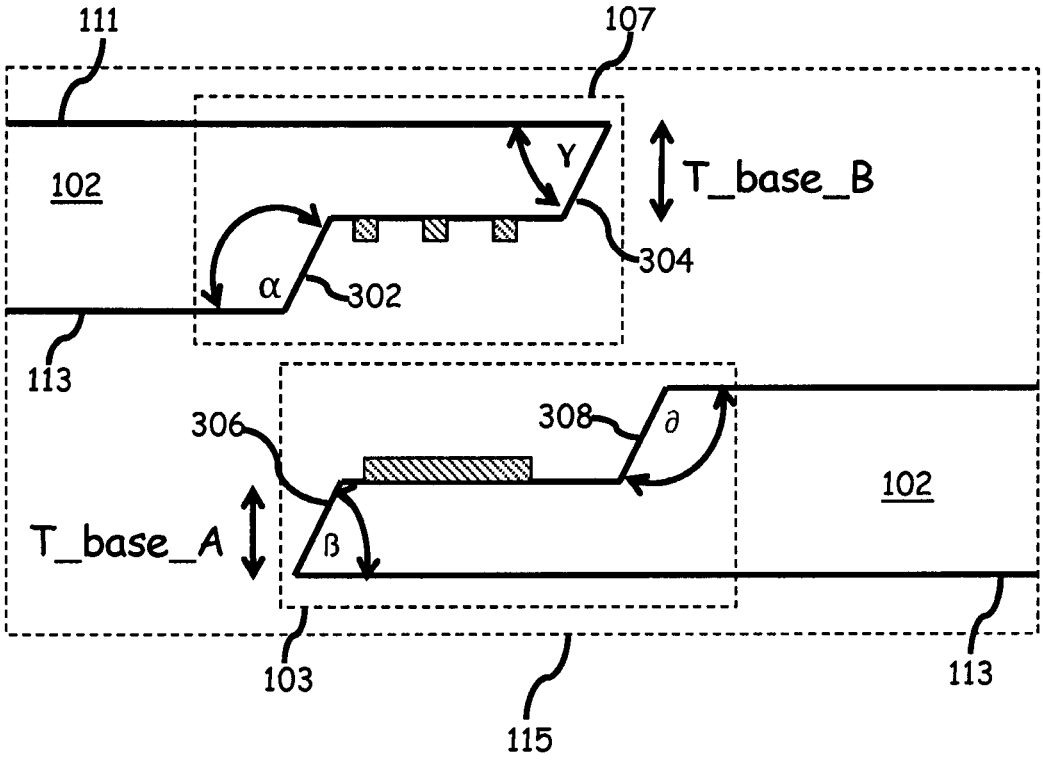
FIG. 3D is similar to FIG. 3A and shows angles of several surfaces relative to inner and outer surfaces of the first embodiment.

FIG. 3D is similar to FIG. 3A and illustrates the angles of several surfaces in closure region 115 of illustrative foam belt 102 relative to inner surface 113 and outer surface 111. As can be seen in FIG. 3D, closure region 115 includes Closure Region A 103 and Closure Region B 107. Referring to Closure Region A 107, an angle, $\angle\alpha$, is formed between inner surface 113 and a surface 302; and an angle $\angle\gamma$ is formed between outer surface 111 and a surface 304. Similarly, referring to Closure Region B 103, an angle, $\angle$ß, is formed between inner surface 113 and a surface 306; and an angle $\angle\partial$, is formed between outer surface 111 and a surface 308.

Figure 3E:
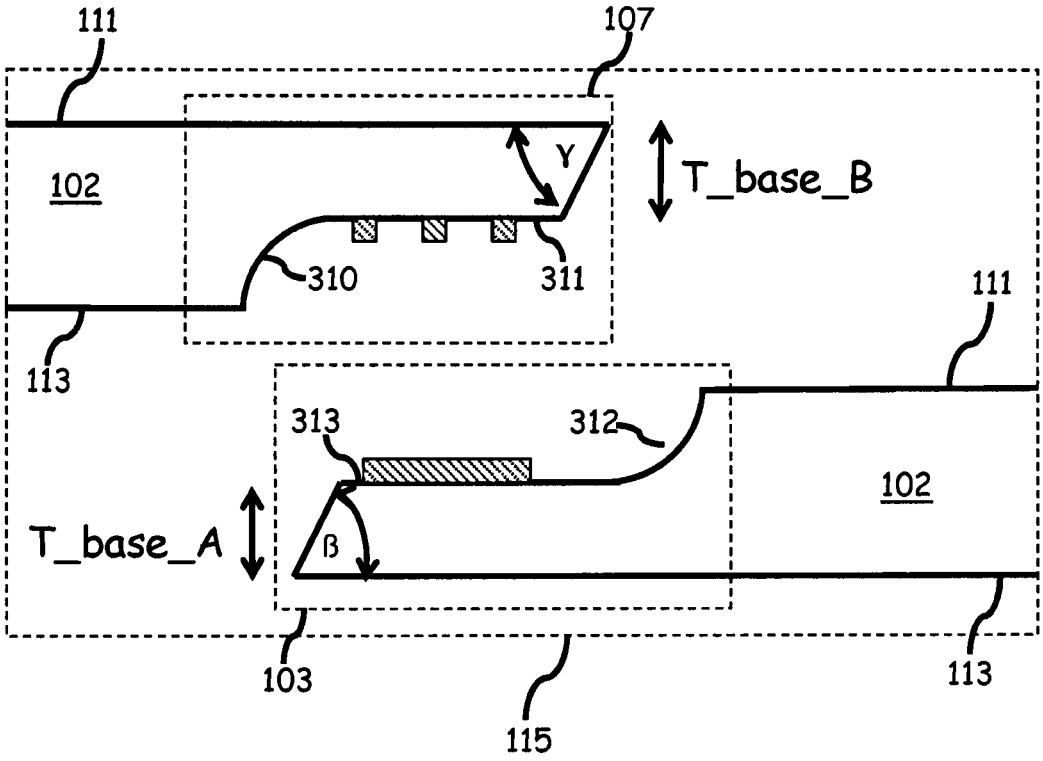
FIG. 3E is similar to FIG. 3D, except rather than a linear transition path between the thick and thin portions of the foam belt in the closure regions, there is an arcuate transition path.

FIG. 3E is similar to FIG. 3D, except rather than a linear transition path between the thick and thin portions of foam belt 102 in the closure regions (e.g., surface 302 and surface 308, of FIG. 3D) there are corresponding arcuate transition paths, for example, an arcuate surface 310 and an arcuate surface 312. More particularly, Closure Region B 107 includes arcuate surface 310 between inner surface 113 and a surface 311 on which an attachment mechanism is disposed as shown in the figure. Likewise, Closure Region A 103 includes arcuate surface 312 between outer surface 111 and a surface 313 on which an attachment mechanism is attached as shown in the figure.

In alternative embodiments, the positions of the hook portions and loop portion relative to Closure Region A and Closure Region B may be reversed.

Figure 4A:
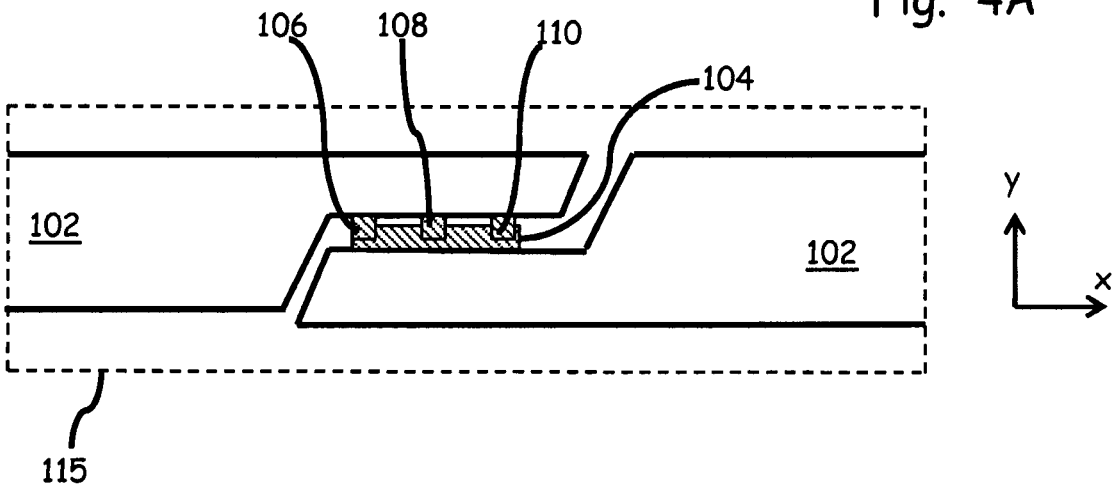
FIG. 4A is a is a top view of the closure region of the first embodiment showing a first amount of overlap between Closure Region A and Closure Region B subsequent to engagement.
Figure 4B:
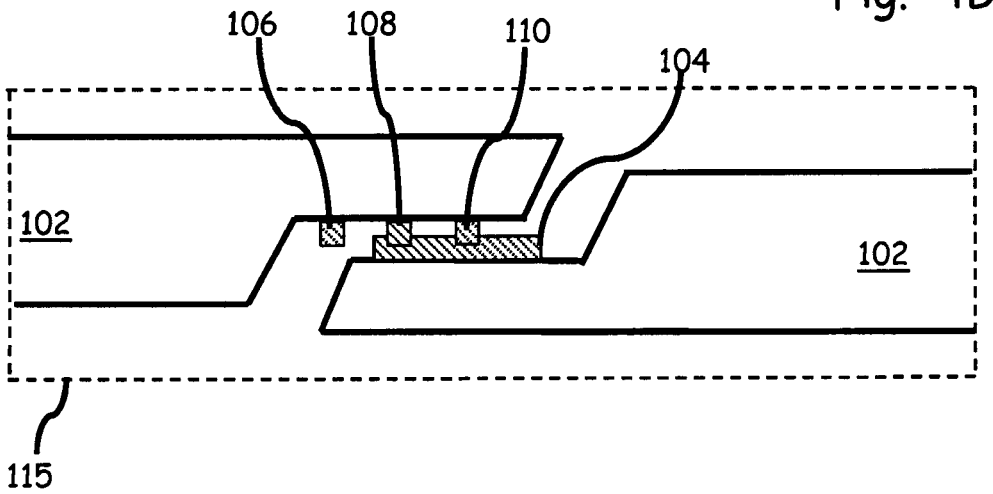
FIG. 4B is a top view of the closure region of the first embodiment showing a second amount of overlap between Closure Region A and Closure Region B subsequent to engagement.
Figure 4C:
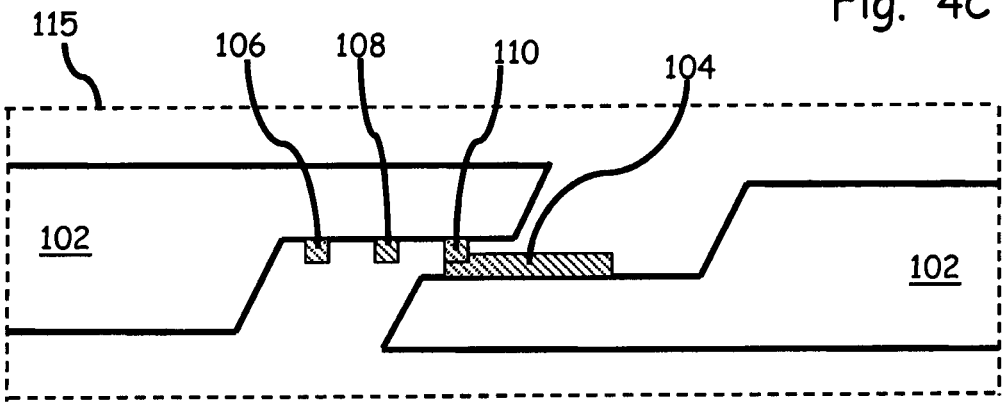
FIG. 4C is a top view of the closure region of the first embodiment showing a third amount of overlap between Closure Region A and Closure Region B subsequent to engagement.

FIGS. 4A-4C are similar to FIGS. 3A-3C except that FIGS. 4A-4C show the hook portions and loop portion in their engaged states. In FIG. 4A, hook portions 106, 108, 110 are engaged with loop portion 104. The configuration of FIG. 4A results in foam belt 102 having its smallest closed state circumference. FIG. 4B illustrates hook portions 108, 110, but not hook portion 106, engaged with loop portion 104. FIG. 4C illustrates hook portion 110, but not hook portions 106, 108, engaged with loop portion 104. The configuration of FIG. 4C results in foam belt 102 having its largest closed state circumference.

Figure 5A:
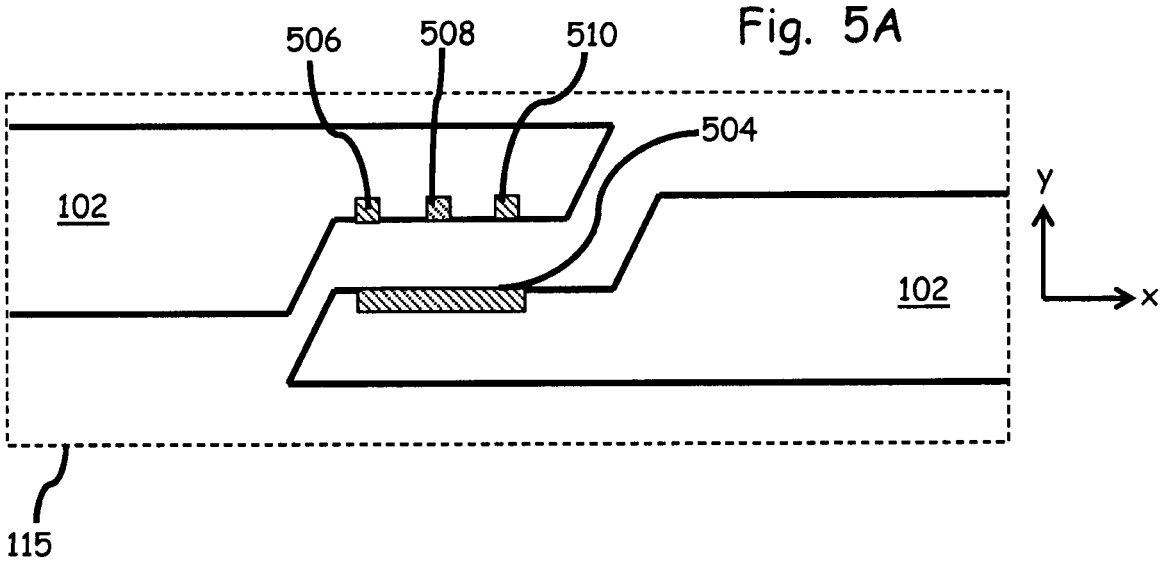
FIG. 5A is a top view of the closure region of a second embodiment showing a first amount of overlap between Closure Region A and Closure Region B prior to engagement.
Figure 5B:
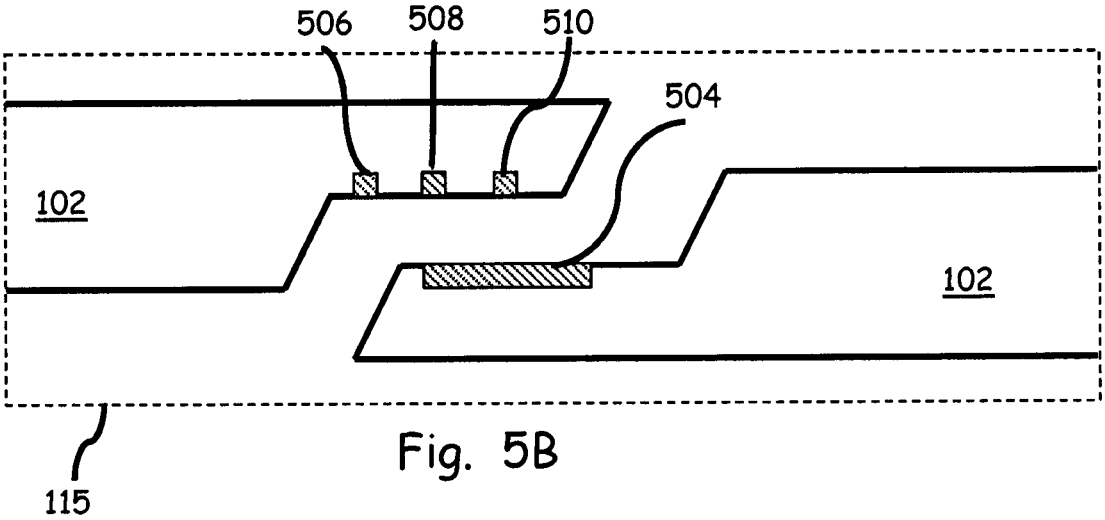
FIG. 5B is a top view of the closure region of the second embodiment showing a second amount of overlap between Closure Region A and Closure Region B prior to engagement.
Figure 5C:
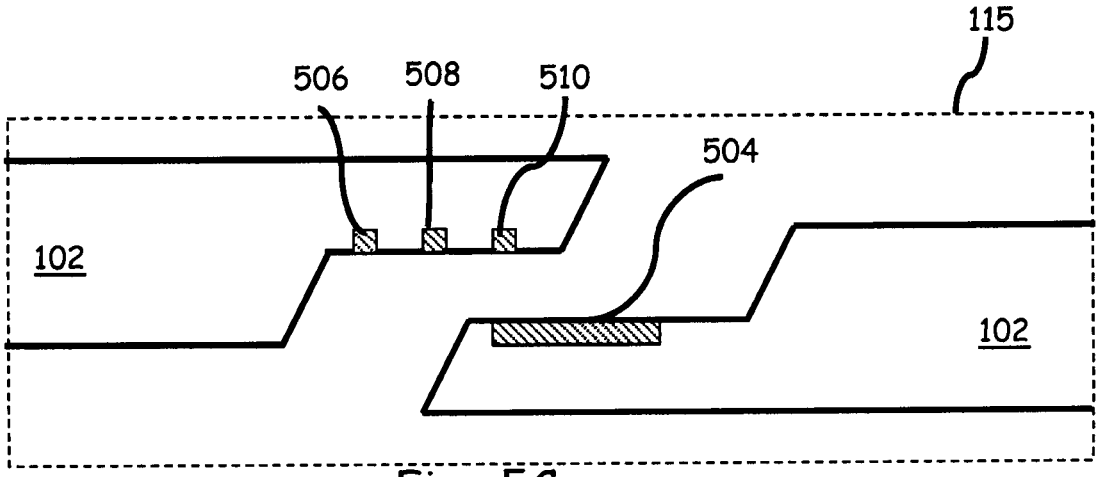
FIG. 5C is a top view of the closure region of the second embodiment showing a third amount of overlap between Closure Region A and Closure Region B prior to engagement.

FIGS. 5A-5C illustrate an alternative embodiment to that shown in FIGS. 3A-3C. Although this alternative embodiment is similar, it differs in that a loop portion 504 of a hook and loop fastener is set into a recess in foam belt 102 such that a surface of loop portion 504 is nominally flush with Closure Region A of foam belt 102. Likewise, hook portions 506, 508, 510 of the hook and loop fastener are set into corresponding recesses in foam belt 102 such that the respective surfaces of hook portions 506, 508, 510 are nominally flush with Closure Region B of foam belt 102. FIG. 5A shows an alignment of hook portions 506, 508, 510 to loop portion 504 is such that when moved into engagement, each of hook portions 506, 508, 510 engages with loop portion 504, thereby placing foam belt 102 into the closed configuration. This closed configuration results in foam belt 102 being in its smallest closed state circumference. FIG. 5B shows an alignment of hook portions 506, 508, 510 to loop portion 504 is such that when moved into engagement, only hook portions 508, and 510 engage with loop portion 504, thereby placing foam belt 102 into the closed configuration, but with a circumference larger than that of the arrangement in FIG. 5A. FIG. 5C shows an alignment of hook portions 506, 508, 510 to loop portion 504 such that when moved into engagement, only hook portion 510 engages with loop portion 504, thereby placing foam belt 102 into the closed configuration, but with a circumference larger than that of the arrangement in FIG. 5B.

Figure 6A:
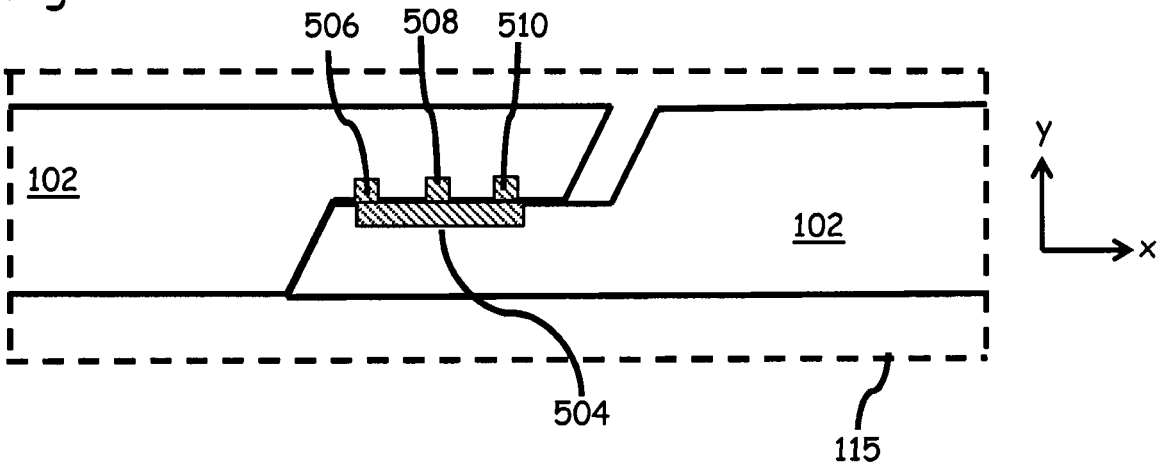
FIG. 6A is a top view of the closure region of a second embodiment showing a first amount of overlap between Closure Region A and Closure Region B subsequent to engagement.
Figure 6B:
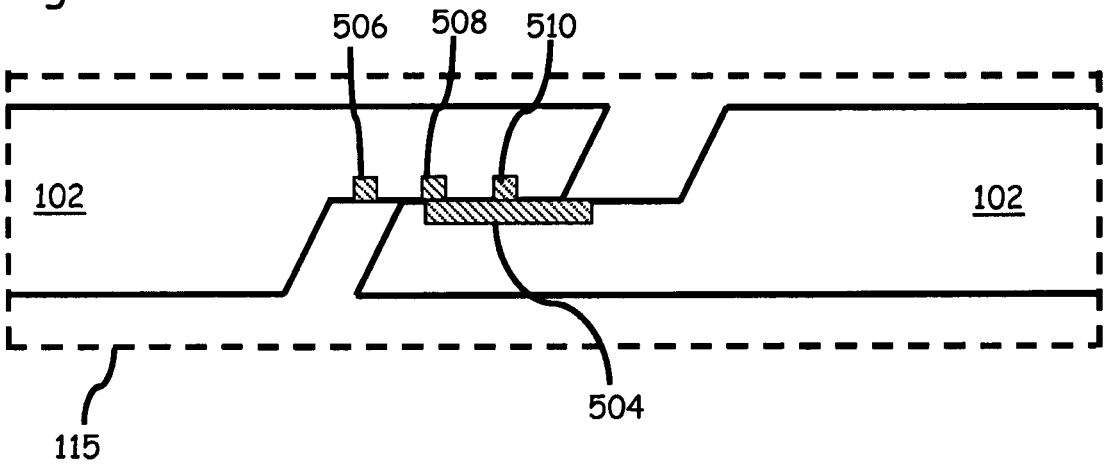
FIG. 6B is a top view of the closure region of the second embodiment showing a second amount of overlap between Closure Region A and Closure Region B subsequent to engagement.
Figure 6C:
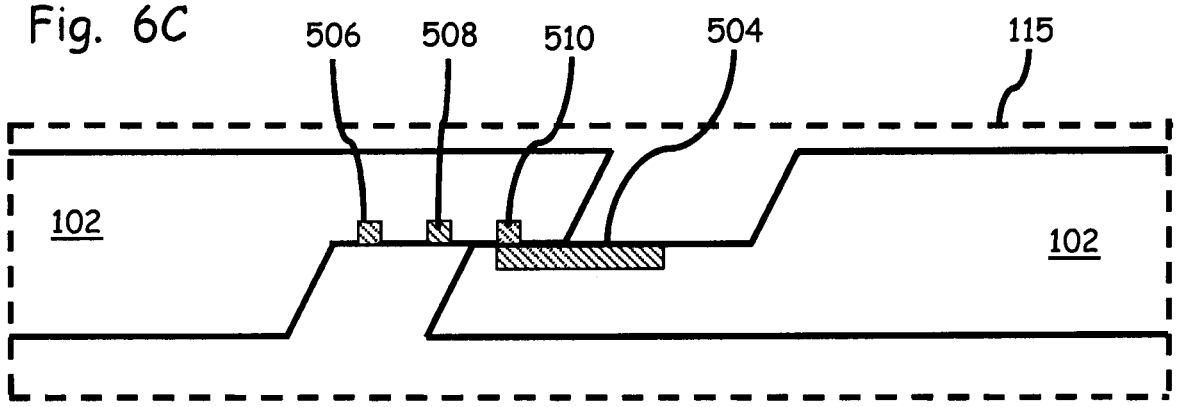
FIG. 6C is a top view of the closure region of the second embodiment showing a third amount of overlap between Closure Region A and Closure Region B subsequent to engagement.

FIGS. 6A-6C are similar to FIGS. 5A-5C except that FIGS. 6A-6C show the hook portions and loop portion in their engaged state. In the engaged state, hooks of the hook portions engage with loops of the loop portion such that Closure Region A and Closure Region B are detachably attached to each other. The attachment force between Closure Region A and Closure Region B is a matter of design choice, and that attachment force depends of factors including but not limited to the number of hooks per unit area, the number of loops per unit area, the total area of overlap between the hook portion and the loop portion of a hook and loop fastener, and the amount of pressure applied when engaging the hook portion and the loop portion.

Figure 7A:
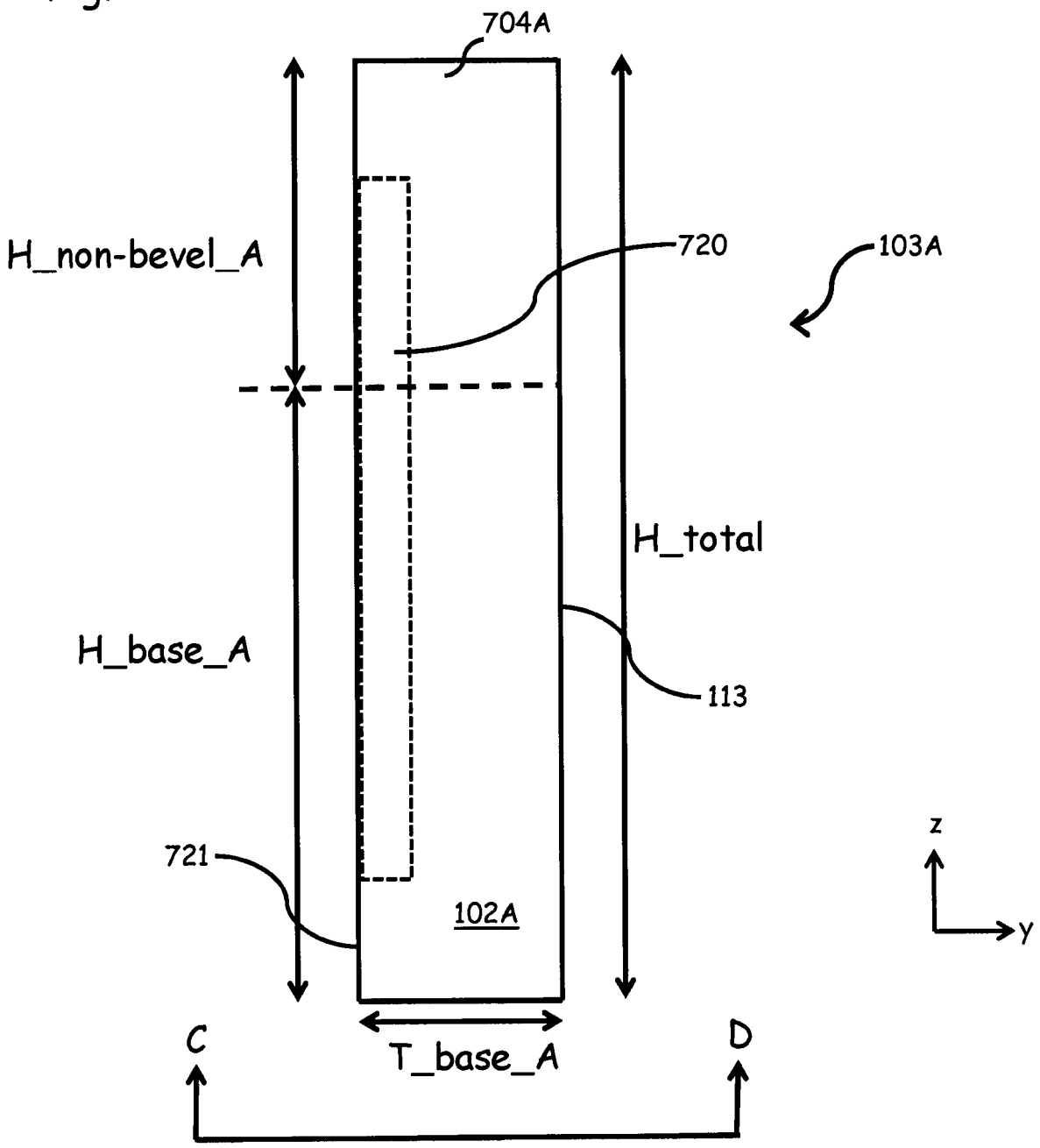
FIG. 7A is a cross-sectional view of Closure Region A of the apparatus of FIG. 1B, without a beveled section, taken across line CD in FIG. 1B.

FIG. 7A is a cross-sectional view of the illustrative apparatus of FIG. 1B, taken across line CD, of Closure Region A, wherein Closure Region A is without a beveled portion, unlike the remainder of foam belt 102 (except for Closure Region B). As shown in FIG. 7A, a Closure Region A 103A presents a rectangularly-shaped cross-section 102A having a thickness T_base_A, and a height H_total. In this illustrative embodiment, Closure Region A 103A includes a foam rubber material 704A, and a first portion 720 of an attachment mechanism. In this illustrative embodiment, foam rubber material 704A is comprised of the same type of material as the remainder of foam belt 102. T_base_A is less than T_base, which is the thickness of foam belt 102 outside of Closure Region A 103 and outside of Closure Region B 107. The magnitude of H_total is the same for Closure Region A 103 as it is for foam belt 102 outside of Closure Region A 103. For the sake of convenience only, rectangularly-shaped cross-section 102A is marked with a horizontal dashed line indicating where the base portion and bevel portion of foam belt 102 are located relative to each other in the portion of foam belt 102 that is not a part of Closure Region A or Closure Region B. In this illustrative embodiment, first portion 720 is a loop portion of a hook and loop fastener, and configured to engage with a hook portion of the hook and loop fastener. In an alternative arrangement, first portion 720 may be a hook portion of a hook and loop fastener, and configured to engage with a loop portion of the hook and loop fastener. First portion 720 may be disposed on and attached to a surface 721 of foam rubber material 704A, or it may be disposed in and attached to a recess in the surface 721 of foam rubber material 704A. Surface 721 is opposite to inner surface 113. The attachment of first portion 720 may be by way of, for example, an adhesive.

Figure 7B:
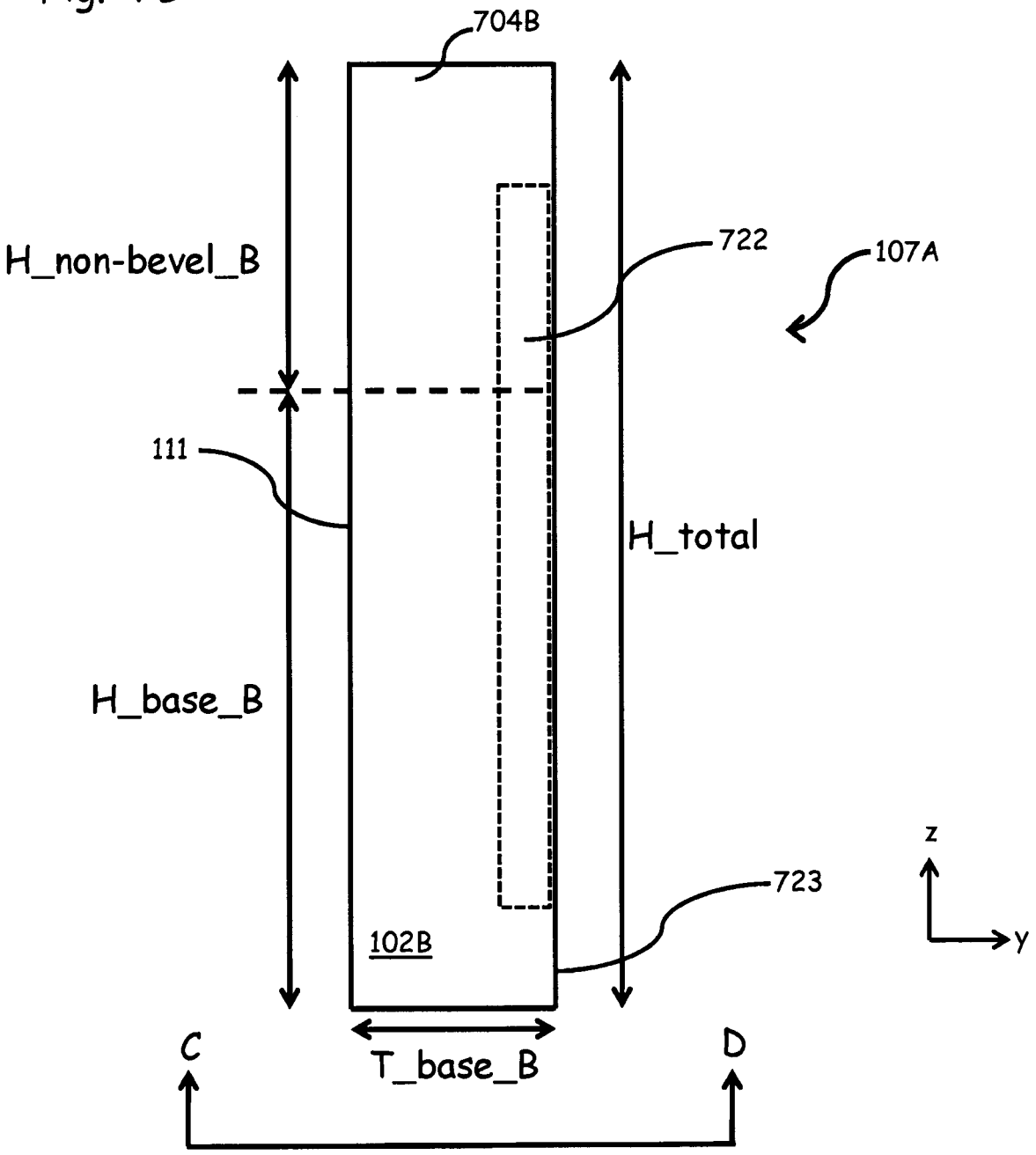
FIG. 7B is a cross-sectional view of the Closure Region B of the apparatus of FIG. 1B, without a beveled section, taken across line CD in FIG. 1B.

FIG. 7B is a cross-sectional view of the apparatus of FIG. 1B, taken across line CD, of Closure Region B, wherein Closure Region B is without a beveled portion, unlike the remainder of foam belt 102 (except for Closure Region A). As shown in FIG. 7B, a Closure Region A 107A presents a rectangularly-shaped cross-section 102B having a thickness T_base_B, and a height H_total. In this illustrative embodiment, Closure Region B 107A includes a foam rubber material 704B, and a second portion 722 of the attachment mechanism. In this illustrative embodiment, foam rubber material 704B is comprised of the same type of material as the remainder of foam belt 102. T_base_B is less than T_base. The magnitude of H_total is the same for Closure Region B 107B as it is for foam belt 102 outside of Closure Region B 107B. For the sake of convenience only, rectangularly-shaped cross-section 102B is marked with a horizontal dashed line indicating where the base portion and bevel portion of foam belt 102 are located relative to each other in the portion of foam belt 102 that is not a part of Closure Region A or Closure Region B. In this illustrative embodiment, second portion 722 is a hook portion of a hook and loop fastener, and configured to engage with a loop portion of the hook and loop fastener. In an alternative arrangement, second portion 722 may be a loop portion of a hook and loop fastener, and configured to engage with a hook portion of the hook and loop fastener. Second portion 722 may be disposed on and attached to a surface 723 of foam rubber material 704B, or it may be disposed in and attached to a recess in surface 723 of foam rubber material 704B. Surface 723 is opposite outer surface 111. The attachment of second portion 720 may be by way of an adhesive.

Figure 7C:
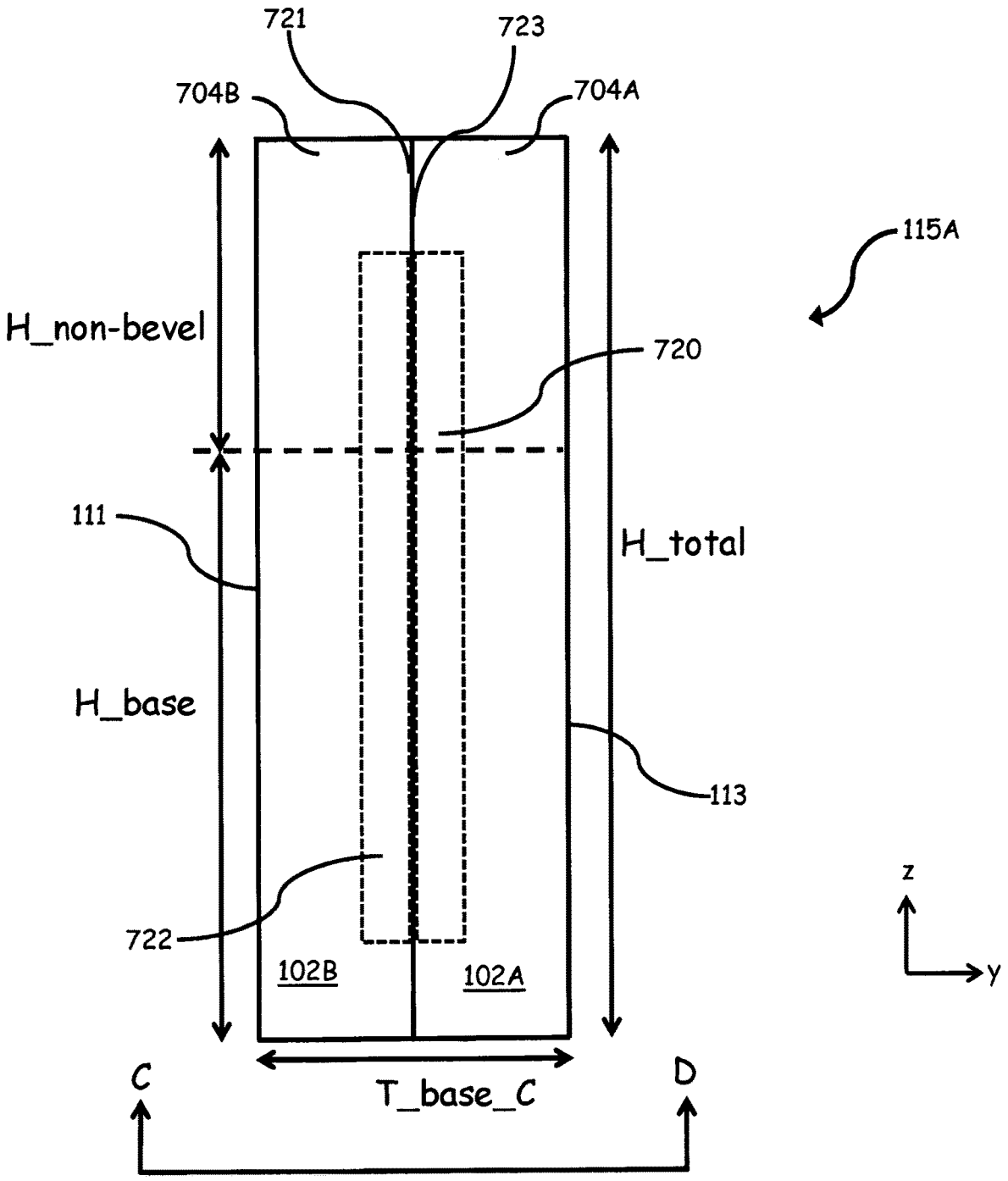
FIG. 7C is a cross-sectional view of the closure region of the apparatus of FIG. 1B, without a beveled section, in the engaged position taken across line CD in FIG. 1B.

FIG. 7C is a cross-sectional view of the closure region of the apparatus of FIG. 1B, without a beveled section, in the engaged position, i.e., Closure Region A and Closure Region B engaged with each other by a fastener, taken across line CD in FIG. 1B. As shown in the figure, surface 721 of foam rubber portion 704B, and surface 723 of foam rubber portion 704A face each other in this configuration. In this illustrative embodiment, Closure Region A and Closure Region B are attached by means of a hook and loop fastener. Although portions 720, 722 of the hook and loop fastener are shown in the figure as having a certain height and width, relative to the foam rubber portions 704A, 704B, of closure region 115A, this is for illustrative purposes. The actual physical dimensions of the hook and loop portions 722, 720 relative to the foam rubber portions 704B, 704A, and relative to each other, are a designer's choice, provided that engagement of the hook and loop portions 722, 720 provides sufficient attachment force to keep closure region 115A in the engaged state while foam belt 102 is being worn by a user.

Still referring to FIG. 7C, Closure Region A 115A in the engaged position, and uncompressed, has a thickness T_base_C. In this illustrative embodiment, the magnitude of T_base_C is nominally equal to the sum of T_base_A and T_base_B when those corresponding portions of foam rubber 704A, 704B are likewise uncompressed, and loop portion 720 and hook portion 722, taken together, combine to add to the magnitude of T_base_C. In other words, if loop portion 720, and/or hook portion 722 extends outwardly from their respective surfaces 723, 721, by an amount sufficient to prevent surfaces 721 and 723 to remain flush against each other while uncompressed, then T_base_C may be greater than the sum of T_base_A and T_base_B.

FIGS. 7A, 7B, and 7C show an illustrative embodiment in which Closure Region A and Closure Region B are formed without a beveled section. In this way, a sloped groove between the overlapping Closure Region A and Closure Region B is avoided when Closure Region A and Closure Region B are in the engaged position. Forming foam belt 102 with a beveled portion and non-beveled closure regions may make manufacturing slightly more complex, but the finished product in the engaged position is less likely to collect lint, dust, dirt, crumbs, or other debris. Since the foam belt in accordance with this disclosure may be worn repeatedly by a user, the ability of the foam belt to resist dirt collection may be important to customers. Regarding FIGS. 7A, 7B, and 7C, the following equations and inequalities apply:

$$T_base_A < T_base;$$

$$T_base_B < T_base;$$

$$T_base_C \geq T_base;$$

$$T_base_A + T_base_B \geq T_base_C;$$

$$H_base_A + H_non\text{-}bevel_A = H_total_A;$$

$$H_base_B + H_non\text{-}bevel_B = H_total_B;$$

$$H_total_A = H_total_B = H_total; \text{ and}$$

$$H_non\text{-}bevel_A = H_non\text{-}bevel_B = H_bevel.$$

Figure 7D:
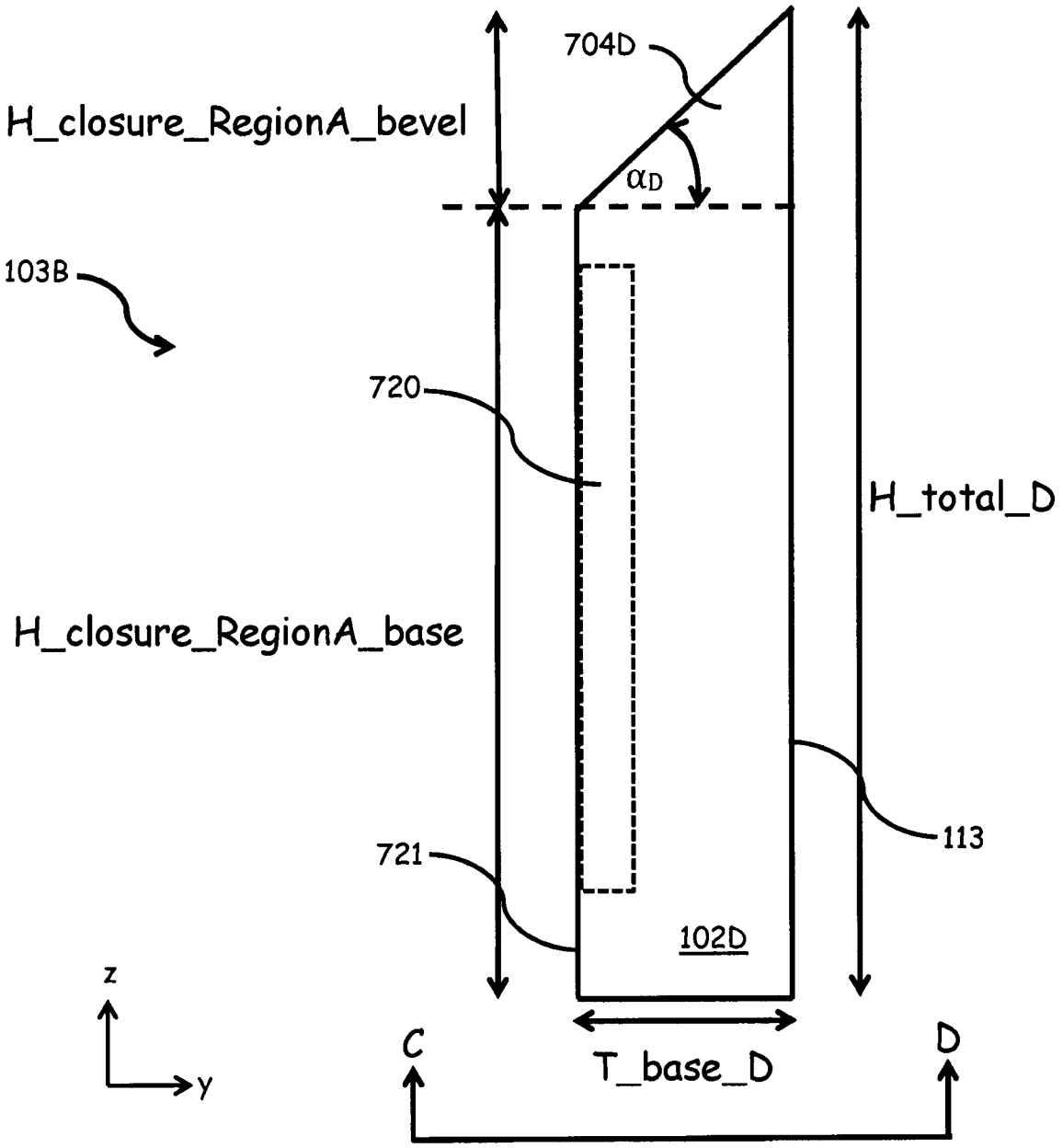
FIG. 7D is a cross-sectional view of Closure Region A of the apparatus of FIG. 1B, taken across line CD in FIG. 1B, and including a beveled section.

FIG. 7D is a cross-sectional view of the illustrative apparatus of FIG. 1B, taken across line CD, of Closure Region A, wherein Closure Region A has a beveled portion. As shown in FIG. 7D, a Closure Region A 103B presents a rectangularly-shaped cross-section 102D having a thickness T_base_D, and a height H_total_D. In this illustrative embodiment, Closure Region A 103B includes a foam rubber material 704D, and first portion 720 of an attachment mechanism. In this illustrative embodiment, foam rubber material 704D is comprised of the same type of material as the remainder of foam belt 102. T_base_D is less than T_base, which is the thickness of foam belt 102 outside of Closure Region A 103B and outside of Closure Region B 107B. The magnitude of H_total_D is the same for Closure Region A 103B as it is for foam belt 102 outside of Closure Region A 103B (except for Closure Region B 107B), i.e., H_total. In other words, H_total_D=H_total. For the sake of convenience only, rectangularly-shaped cross-section 102D is marked with a horizontal dashed line indicating where the base portion and bevel portion of foam belt 102 are located relative to each other in the portion of foam belt 102 that is not a part of Closure Region A or Closure Region B. In this illustrative embodiment, first portion 720 is a loop portion of a hook and loop fastener, and configured to engage with a hook portion of the hook and loop fastener. In an alternative arrangement, first portion 720 may be a hook portion of a hook and loop fastener, and configured to engage with a loop portion of the hook and loop fastener. First portion 720 may be disposed on and attached to surface 721 of foam rubber material 704A, or it may be disposed in and attached to a recess in the surface 721 of foam rubber material 704A. Surface 721 is opposite to inner surface 113. The attachment of first portion 720 may be by way of, for example, an adhesive. The attachment of second portion 722 may be by way of, for example, an adhesive. The attachment of first portion 720 to surface 723 is not limited to the use of adhesive alone, and other suitable means of chemical or mechanical bonding, or combinations thereof, may be used.

Figure 7E:
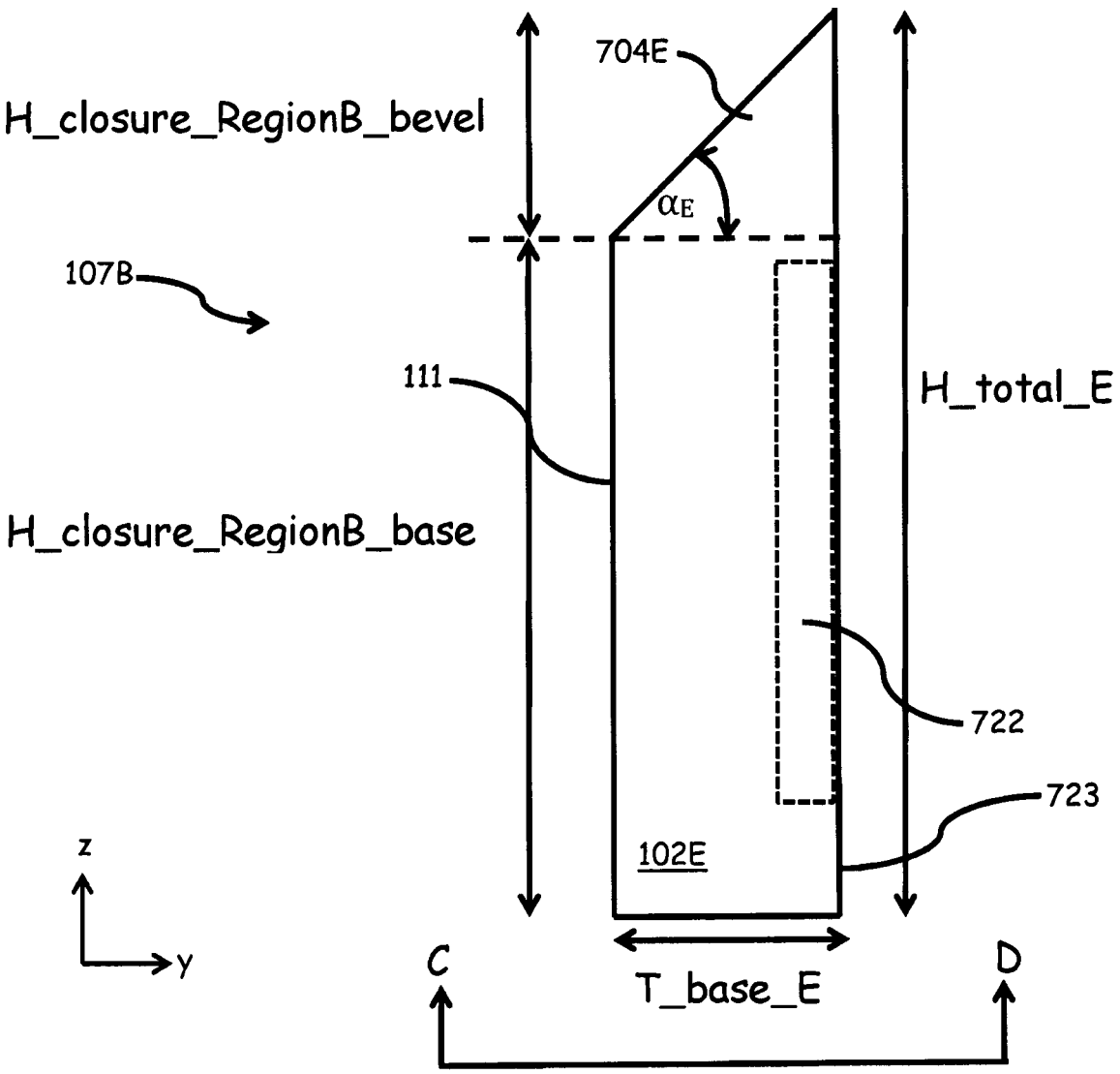
FIG. 7E is a cross-sectional view of Closure Region B of the apparatus of FIG. 1B, taken across line CD in FIG. 1B, and including a beveled section.

FIG. 7E is a cross-sectional view of the apparatus of FIG. 1B, taken across line CD, of Closure Region B, wherein Closure Region B has a beveled portion. As shown in FIG. 7E, a Closure Region B 107B presents a rectangularly-shaped cross-section 102E having a thickness T_base_E, and a height H_total_E. In this illustrative embodiment, Closure Region B 107B includes a foam rubber material 704E, and a second portion 722 of the attachment mechanism. In this illustrative embodiment, foam rubber material 704E is comprised of the same type of material as the remainder of foam belt 102. T_base_E is less than T_base, and H_total_E is less than H_total. For the sake of convenience only, rectangularly-shaped cross-section 102E is marked with a horizontal dashed line indicating where the base portion and bevel portion of foam belt 102 are located relative to each other in the portion of foam belt 102 that is not a part of Closure Region A or Closure Region B. In this illustrative embodiment, second portion 722 is a hook portion of a hook and loop fastener, and configured to engage with a loop portion of the hook and loop fastener. In an alternative arrangement, second portion 722 may be a loop portion of a hook and loop fastener, and configured to engage with a hook portion of the hook and loop fastener. Second portion 722 may be disposed on and attached to a surface 723 of foam rubber material 704E, or it may be disposed in and attached to a recess in surface 723 of foam rubber material 704E. Surface 723 is opposite outer surface 111. The attachment of second portion 722 to surface 723 of foam rubber material 704E may be by way of, for example, an adhesive. The attachment of second portion 722 to surface 723 is not limited to the use of adhesive alone, and other suitable means of chemical or mechanical, attachment or bonding, or combinations thereof, may be used.

Figure 7F:
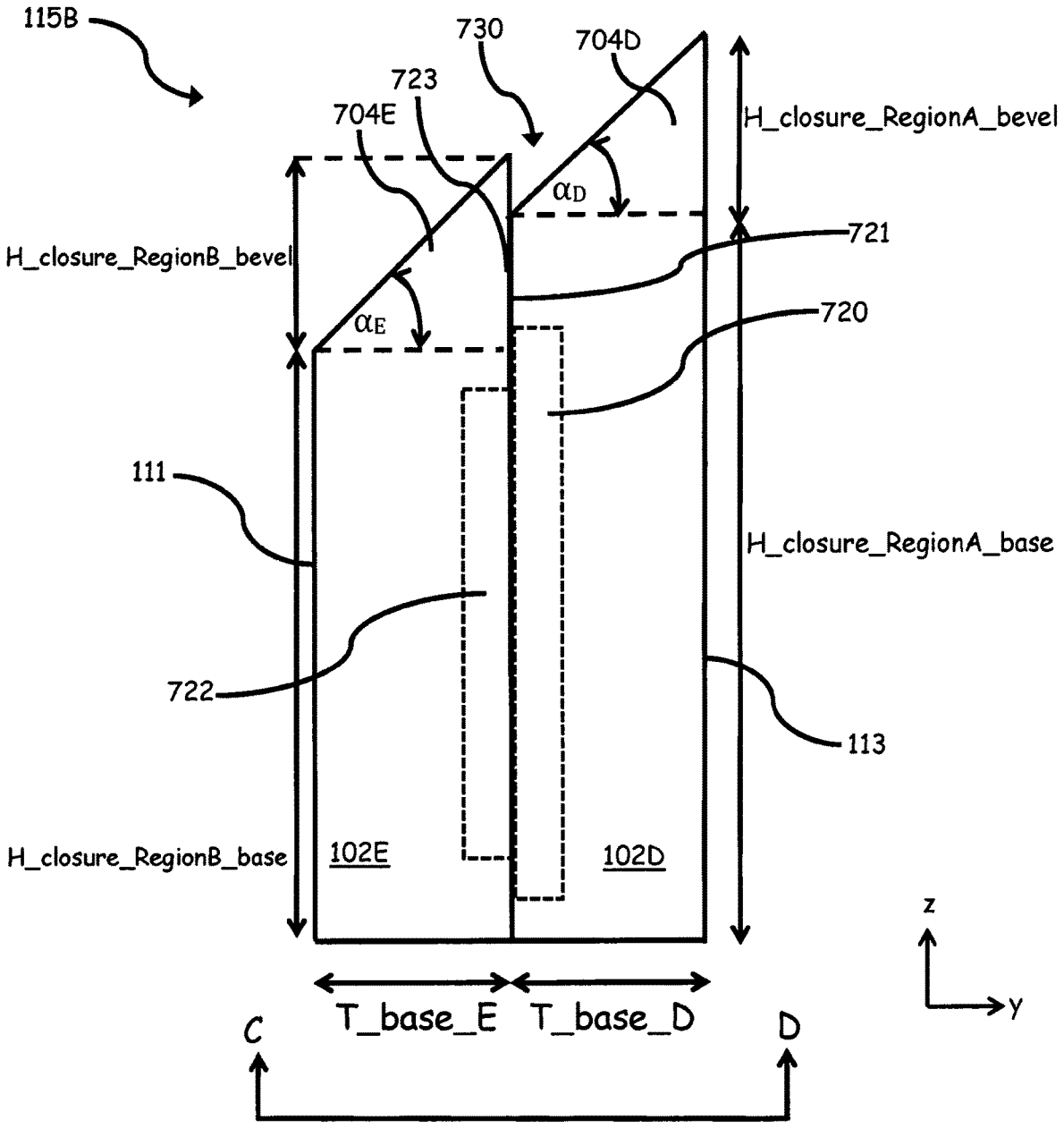
FIG. 7F is a cross-sectional view of the closure region of the apparatus of FIG. 1B, with each of Closure Region A and Closure Region B having a beveled section, in the engaged position taken across line CD in FIG. 1B.

FIG. 7F is a cross-sectional view of closure region 115B of the apparatus of FIG. 1B, with a beveled sections, in the engaged position, i.e., Closure Region A 103B and Closure Region B 107B engaged with each other by a fastener, taken across line CD in FIG. 1B. As shown in the figure, surface 721 of foam rubber portion 704E, and surface 723 of foam rubber portion 704D face each other in this configuration. In this illustrative embodiment, Closure Region A 103B and Closure Region B 107B are attached by means of a hook and loop fastener. Although portions 720, 722 of the hook and loop fastener are shown in the figure as having a certain height and width, relative to the foam rubber portions 704A, 704B, of closure region 115B, this is for illustrative purposes. The actual physical dimensions of the hook and loop portions 722, 720 relative to the foam rubber portions 704E, 704D, and relative to each other, are a designer's choice, provided that engagement of the hook and loop portions 722, 720 provides sufficient attachment force to keep closure region 115B in the engaged state while foam belt 102 is being worn by a user.

Still referring to FIG. 7F, closure region 115B in the engaged position, and uncompressed, has a thickness T_base. In this illustrative embodiment, the magnitude of T_base is nominally equal to the sum of T_base_E and T_base_D when those corresponding portions of foam rubber 704E, 704E are uncompressed, and loop portion 720 and hook portion 722, taken together, combine to add to the magnitude of T_base. In other words, if loop portion 720, and/or hook portion 722 extends outwardly from their respective surfaces 723, 721, by an amount sufficient to prevent surfaces 721 and 723 from remaining flush against each other while uncompressed, then T_base may be greater than the sum of T_base_E and T_base_D.

Still referring to the illustrative embodiment shown in FIG. 7F, a groove 730 is formed between upper portions of foam rubber 102E and 102D. (This groove is not present in the embodiment shown the illustrative embodiment of FIG.

7G, which is described below.). Illustrative embodiments having groove 730 meet the condition of T_base_D+T_base_E>T_base.

Regarding FIGS. 7D, 7E, and 7F, the following equations and inequalities apply:

$$T_base_D+T_base_E \geq T_base;$$

$$T_base_D<T_base;$$

$$T_base_E<T_base;$$

$$H_total_E<H_total;$$

$$H_closure_Region_A_bevel+H_closure_Region_A_base=H_total;$$

$$H_closure_Region_B_bevel+H_closure_Region_B_base=H_total_E;$$

$$H_closure_Region_B_base<H_closure_Region_A_base; \text{ and}$$

$$\angle\alpha_D=\angle\alpha_E=\angle\alpha$$

wherein T_base is the thickness of foam belt 102, T_base_D is the thickness of the base portion 102D of Closure Region A, T_base_E is the thickness of the base portion of Closure Region B 102E, H_total is the total height of foam belt 102, H_total_E is the total height of foam belt 102E of Closure Region B, H_closure_Region_A_bevel is the height of a bevel portion 704D, H_closure_Region_A_base is the height of the base portion of Closure Region A 102D, H_closure_Region_B_bevel is the height of a bevel portion 704E, H_closure_Region_B_base is the height of the base portion of Closure Region B 102E.

Figure 7G:
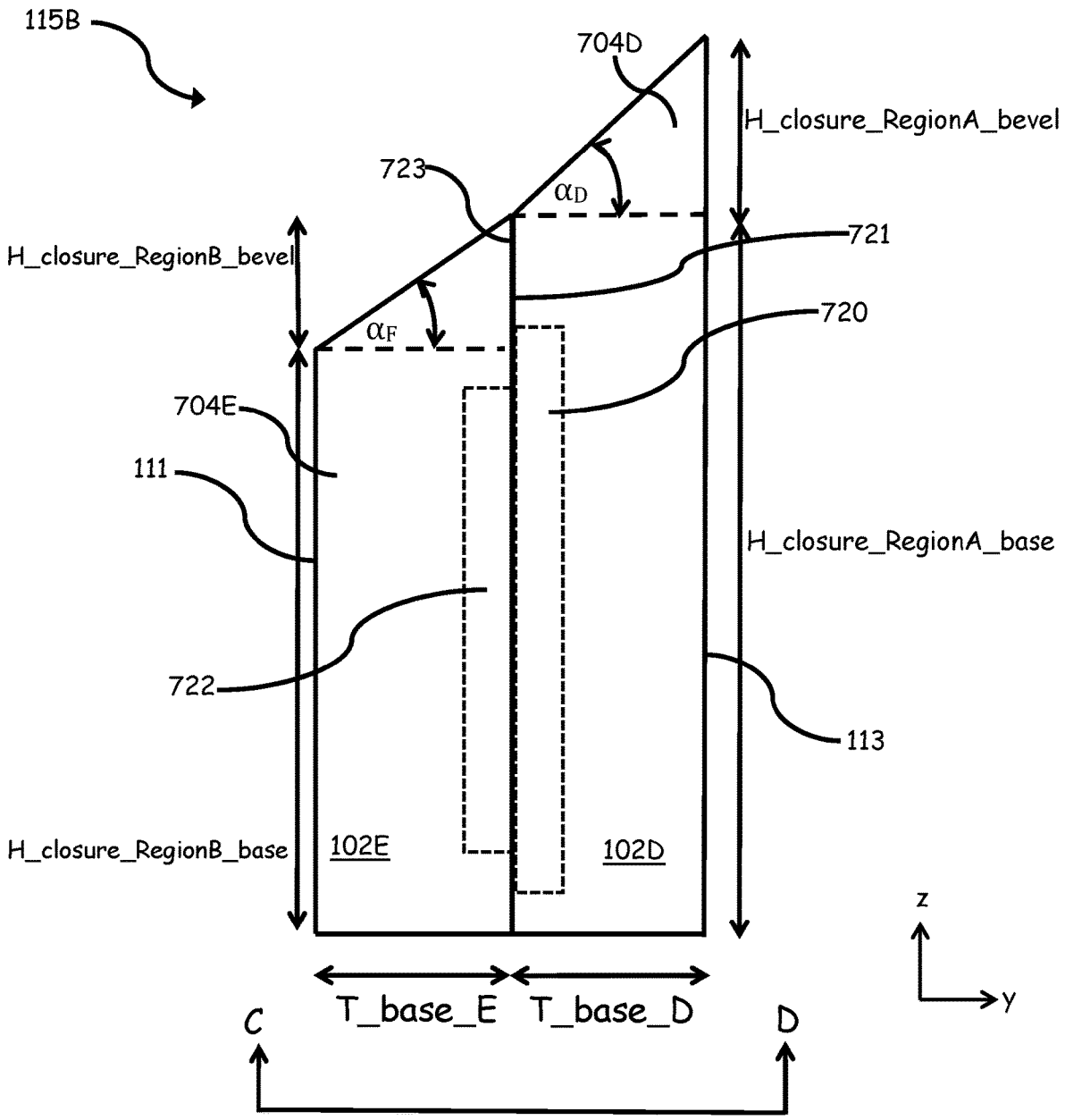
FIG. 7G is a cross-sectional view of the closure region of the apparatus of FIG. 1B, with each of Closure Region A and Closure Region B having a beveled section with different bevel slope angles, in the engaged position taken across line CD in FIG. 1B.

FIG. 7G is a cross-sectional view of the closure region of the apparatus of FIG. 1B, with each of Closure Region A and Closure Region B having a beveled section with different bevel slope angles, in the engaged position taken across line CD in FIG. 1B. FIG. 7G is the same as FIG. 7F except that the bevel slope angle of closure Region A is different. That is, $\angle\alpha_E$ of FIG. 7F is nominally equal to $\angle\alpha_D$, whereas $\angle\alpha_F$ of FIG. 7G is different from $\angle\alpha_D$. More particularly, $\angle\alpha_F$ has been reduced, relative to $\angle\alpha_E$, such that groove 730 (shown in FIG. 7F) does not appear in the embodiment of FIG. 7G. By eliminating groove 730, the possibility of collecting dust, dirt, debris, and so on is substantially reduced or eliminated. The equations and inequalities set forth above in connection with FIGS. 7D, 7E, and 7F apply to the illustrative embodiment of FIG. 7G, with the exception of the bevel slope angles, which for this embodiment are:

$$\angle\alpha_F<\angle\alpha_D; \text{ and}$$

$$\angle\alpha_F\neq\angle\alpha.$$

Figure 8A:
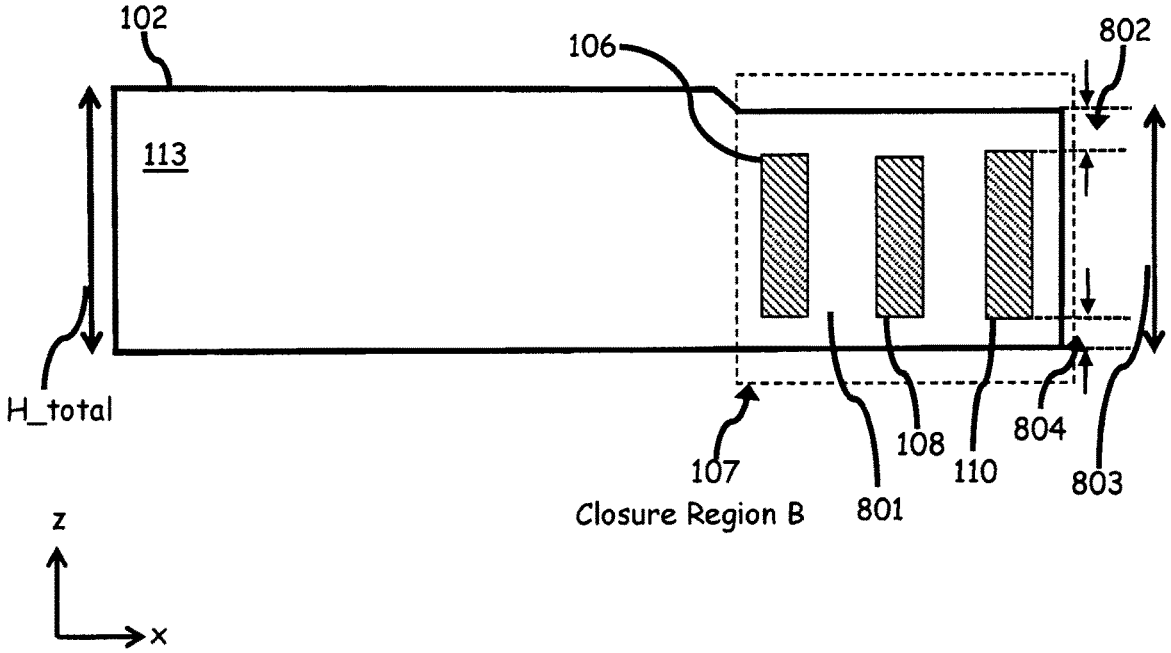
FIG. 8A is a side view of the first embodiment showing Closure Region B.

FIG. 8A is a side view of the first embodiment showing Closure Region B 107. As shown in FIG. 8A, hook portions 106, 108, 110 are disposed on surface 801 of Closure Region B 107 of foam belt 102. Surface 113 of foam belt 102 has a height H_total as shown in FIG. 8A. Surface 801 of Closure Region B 107 has a height 803 as shown in FIG. 8A. Height 803 equals the height of Closure Region B's base, plus the height of its bevel (see H_closure_RegionB_base and H_closure_RegionB_bevel in FIG. 7F). The shape of each hook portion 106, 108, 110 is quadrilateral, and in this particular illustrative embodiment, hook portions 106, 108, 110 are rectangularly shaped, with their shorter sides nominally parallel (i.e., nominally 0°) to the top and bottom edges of foam belt 102, and their longer sides nominally perpendicular (i.e., nominally 90°) to the top and bottom edges of foam belt 102. It will be appreciated that although three separate hook portions are shown in FIG. 8A, various alternative embodiments may have more or fewer hook portions. It will further be appreciated that the shorter sides of hook portions 106, 108, 110 may be disposed on foam belt 102 at angles other than nominally 0° with respect to the top and bottom edges of foam belt 102; and that the longer sides of hook portions 106, 108, 110 may be set at angles other than nominally 90° with respect to the to the top and bottom edges of foam belt 102. FIG. 8A illustrates that hook portions 106, 108, 110 are set back from the top edge of foam belt 102 by a first setback distance 802, and are further set back from the bottom edge of foam belt 102 by a second setback distance 804. In this illustrative embodiment, first setback distance 802 and second setback distance 804 are nominally the same. In various alternative embodiments, first setback distance 802 and second setback distance 804 may be different from each other.

Still referring to FIG. 8A, each of rectangularly-shaped hook portions 106, 108, 110 are nominally the same size and the same shape. It will be appreciated that even though hook portions 106, 108, 110 are shown with their shorter sides set back slightly from the top and bottom edges respectively of foam belt 102, various embodiments may implement hook portions 106, 108, 110 such that their shorter edges are nominally coincident with the top and bottom edges respectively of foam belt 102. In this illustrative embodiment, the shorter sides of rectangularly-shaped hook portions 106, 108, 110 are nominally 19 mm. In other embodiments, the shorter sides of rectangularly-shaped hook portions 106, 108, 110 may be in the range of 18 mm to 22 mm, or even in the range of 15 mm to 25 mm, or even in the range of 10 mm to 30 mm, but are not limited to these specific ranges. In this illustrative embodiment, the longer sides of rectangularly-shaped hook portions 106, 108, 110 are nominally 55 mm. In other embodiments, the longer sides of rectangularly-shaped hook portions 106, 108, 110 may be in the range of 50 mm to 60 mm, or even the range of 45 mm to 65 mm, but are not limited to these specific ranges.

With reference to FIGS. 2 and 8A, in other embodiments, the longer sides of rectangularly-shaped hook portions 106, 108, 110 may be in the range of (H_total−1 mm) to H_total mm, or even in the range of (H_total−2 mm) to H_total mm, or even in the range of (H_total−5 mm) to H_total mm. That is, the length of the longer sides of rectangularly-shaped hook portions 106, 108, 110 may be in a range from the total height of foam belt 102 (shown as H_total in FIG. 2) to the total height of foam belt 102 minus the amount of first setback distance 802 from the top edge of foam belt 102, and minus the amount of second setback distance 804 from the bottom edge of foam belt 102. In some embodiments, the first setback 802 may be nominally equal to, or greater than, H_bevel (see FIG. 2).

Figure 8B:
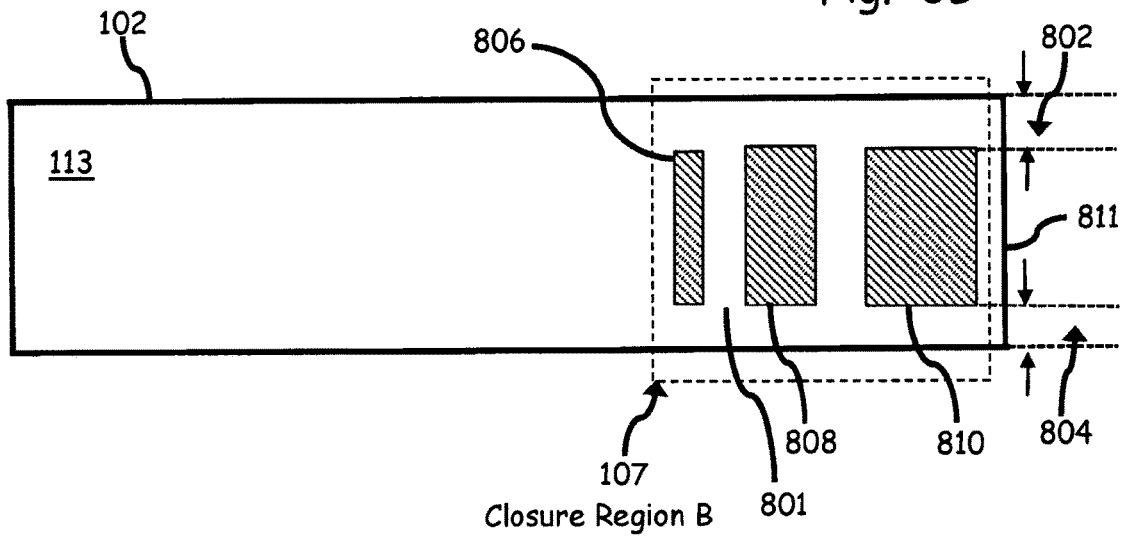
FIG. 8B is a side view of the second embodiment showing Closure Region B.

FIG. 8B is a side view of the second embodiment showing Closure Region B 107. As shown in FIG. 8B, hook portions 806, 808, 810 are disposed on a surface 801. The embodiment of FIG. 8B is similar to that of FIG. 8A, but differs in that hook portions 806, 808, 810 are each differently sized from each other. In this illustrative embodiment, hook portions 806, 808, 810 are each rectangularly shaped, have longer sides nominally of the same length, and have shorter sides that are not nominally of the same length. More particularly, in the illustrative embodiment of FIG. 8B, the length of the shorter sides of each hook portion is selected to be shorter than a preceding hook portion as the distance from an edge 811 increases. In this illustrative embodiment, the selected length of the shorter sides of each hook portion is monotonically decreasing with increasing distance from edge 811, and the decrease is not necessarily linearly related to the distance from edge 811. As shown in FIG. 8B, hook portion 810 is a first distance from edge 811 of foam belt 102, hook portion 808 is a second distance from edge 811, the second distance being greater than the first distance, and hook portion 806 is a third distance from edge 811, the third distance being greater than the second distance. The area of each hook portion likewise decreases with increasing distance from edge 811. In this way, when only hook portion 810 engages with the loop portion (not shown in FIG. 8B) a sufficient connection force is established to maintain the connection of closure regions A and B. And when hook portions 808, or 808 and 806, along with hook portion 810 engages with the loop portion (not shown here) the sufficient connection force is guaranteed by engagement of hook portion 810 thereby allowing the areas of hook portions 808 and 806 to be less than that of hook portion 810. One advantage of this arrangement is that it consumes less hook material. Another advantage of this arrangement is that it is easier to disengage closure regions A and B because there is less area of hook and loop engagement when two or more of the hook portions are engaged. And that decrease in area translates into less pull force being required to open foam belt 102, thus foam belt 102 may be easier of a user to open. In an alternative embodiments, the sufficient connection force, which is guaranteed by engagement of hook portion 810 as described above, obviates the monotonically decreasing hook portion areas, and permits all subsequent hook portions to be implemented using the same small size. That is, since hook portion 810, by itself, provides sufficient connection force to maintain foam belt 102 in the closed configuration, additional hook portions disposed on or in surface 801 do not need to decrease in area as a function of distance from edge 811, but rather can be the same size, and that size being smaller than hook portion 810.

Figure 8C:
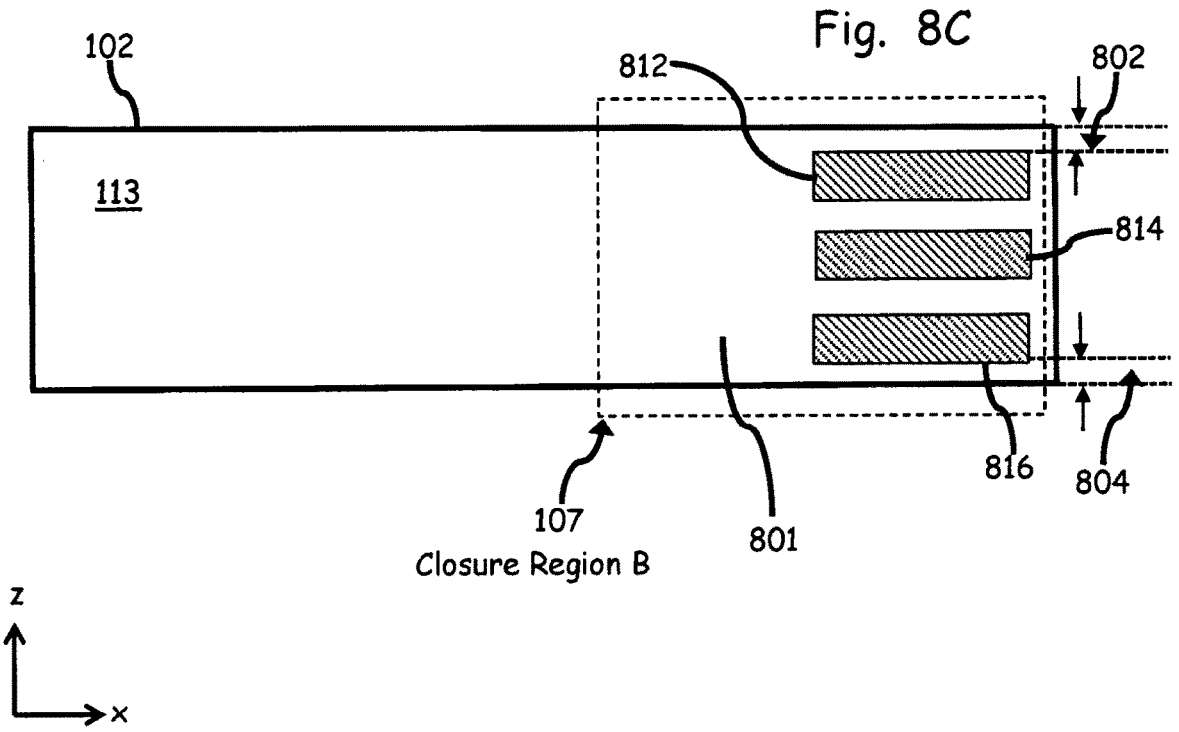
FIG. 8C is a side view of a third embodiment showing Closure Region B.

FIG. 8C is a side view of a third embodiment showing Closure Region B 107. As shown in FIG. 8C, rectangularly-shaped hook portions 812, 814, 816 are disposed on surface 801 of Closure Region B 107. The illustrative embodiment of FIG. 8C is similar to that of FIG. 8A, but differs in that rectangularly-shaped hook portions 812, 814, 816 are arranged so as to be horizontally oriented. That is, the longer sides of hook portions 812, 814, 816 are nominally parallel (i.e., nominally 0°) to the top and bottom edges of foam belt 102, and their shorter sides are nominally perpendicular (i.e., nominally 90°) to the top and bottom edges of foam belt 102. In various alternative embodiments, rather than being disposed on surface 801, rectangularly-shaped hook portions 812, 814, 816 may be disposed in corresponding grooves, or recesses, in surface 801. And, in some of these embodiments, the depth of the grooves, or recesses, relative to the thickness of the hook portions is such that the hook-bearing surface of the hook portions is substantially flush with surface 801.

Figure 8D:
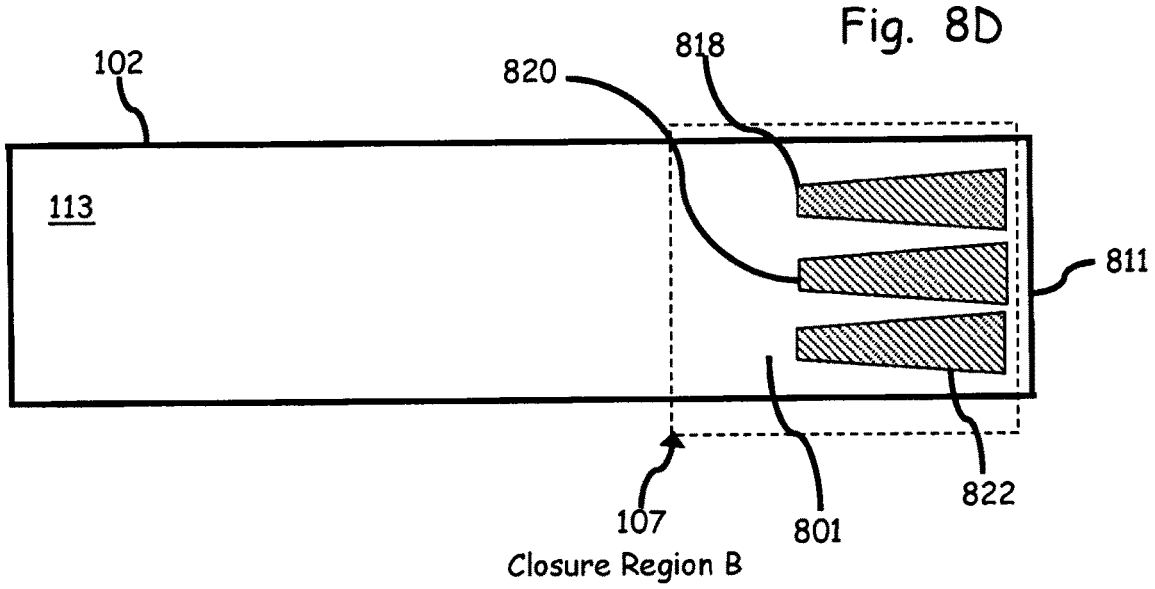
FIG. 8D is a side view of a fourth embodiment showing Closure Region B.

FIG. 8D is a side view of a fourth embodiment showing Closure Region B 107. As shown in FIG. 8D, hook portions 818, 820, 822 are shaped as isosceles trapezoids, and are disposed on surface 801 of Closure Region B 107. In the illustrative embodiment of FIG. 8D, the isosceles-trapezoid-shaped hook portions 818, 821, 822 are arranged so as to be horizontally oriented. That is, the shorter sides are nominally perpendicular to the top and bottom edges of foam belt 102. In this illustrative embodiment, the base of each isosceles-trapezoid-shaped hook portion 818, 821, 822 is disposed closest to edge 811, and each isosceles-trapezoid-shaped hook portion 818, 821, 822 tapers, i.e., becomes narrower as the distance from edge 811 increases. In various alternative embodiments, hook portions 818, 820, 822 may be shaped as triangles, or even as isosceles triangles.

Figure 8E:
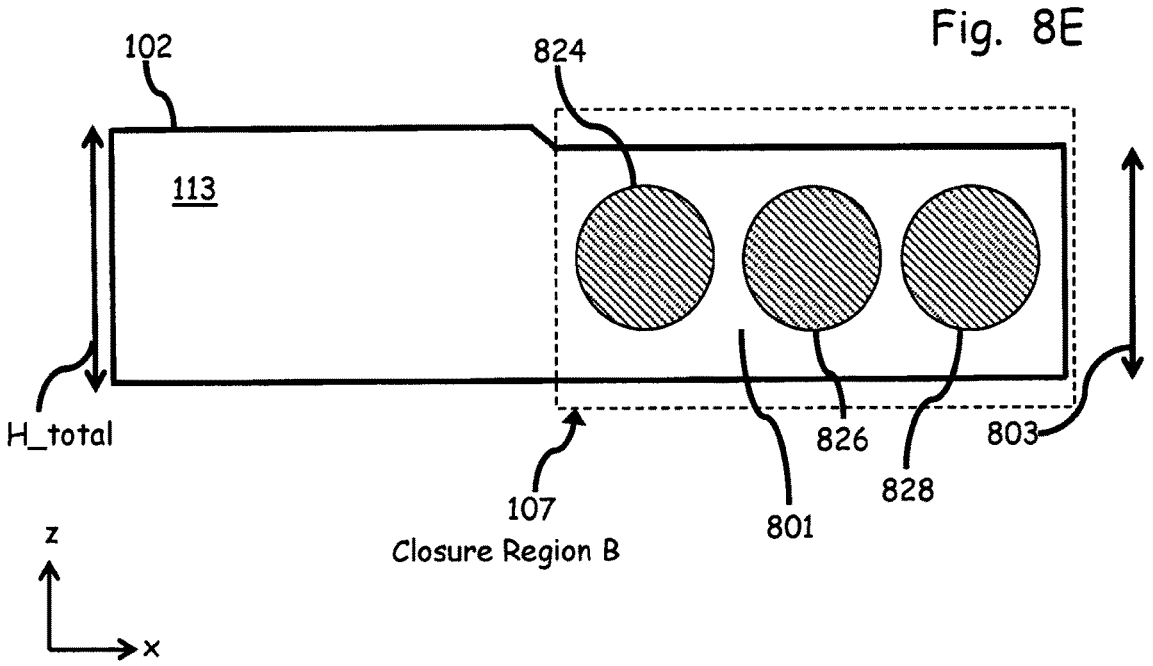
FIG. 8E is a side view of a fifth embodiment showing Closure Region B.

FIG. 8E is a side view of a fifth embodiment showing Closure Region B 107. As shown in FIG. 8E, hook portions 824, 826, 828 are circularly-shaped, and are disposed on surface 801 of Closure Region B 107. Surface 113 of foam belt 102 has a height H_total as shown in FIG. 8E. Surface 801 of Closure Region B 107 has a height 803 as shown in FIG. 8E. Height 803 equals the height of Closure Region B's base, plus the height of its bevel (see H_closure_RegionB_base and H_closure_RegionB_bevel in FIG. 7F). In this alternative, fifth embodiment, circularly-shaped hook portions 824, 826, 828 are shown as being nominally the same size, i.e., circles having a nominally equal radius. Circularly-shaped hook portions perform in a hook and loop fastener in the same manner as hook portions having rectangular or polygonal shapes.

Figure 8F:
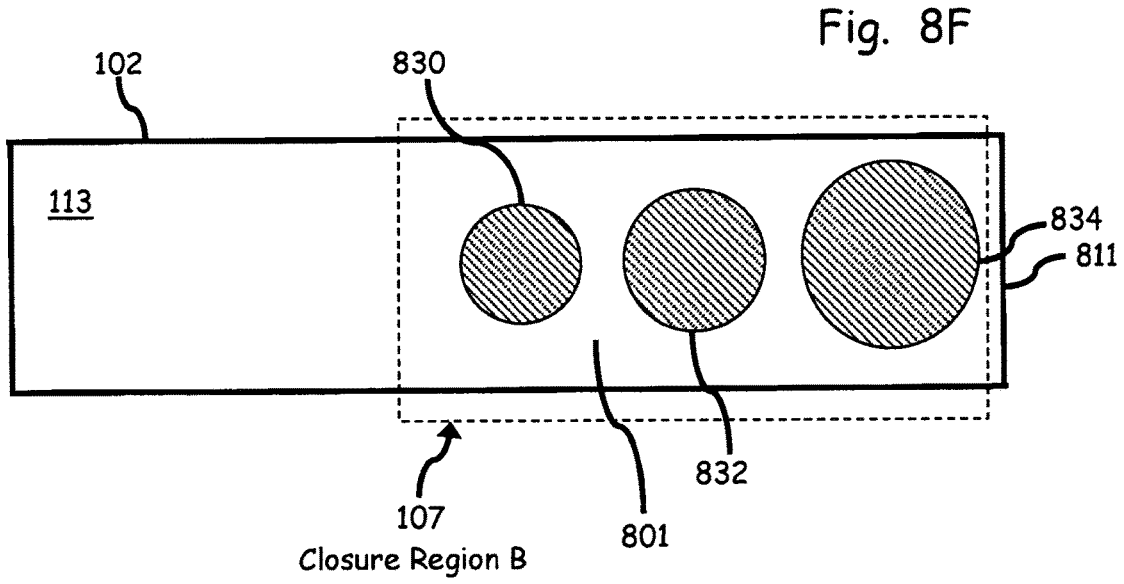
FIG. 8F is a side view of a sixth embodiment showing Closure Region B.

FIG. 8F is a side view of a sixth embodiment showing Closure Region B 107. As shown in FIG. 8F, hook portions 830, 832, 834 are circularly-shaped, and are disposed on surface 801 of Closure Region B 107. In this alternative, sixth embodiment, circularly-shaped hook portions 830, 832, 834 are shown to be monotonically decreasing in area with increasing distance from edge 811. As described above in connection with alternatives of the second embodiment and FIG. 8B, an alternative arrangement for the sixth embodiment is to provide hook portion 834 with an area capable of engaging with the loop portion of a hook and loop fastener so as to provide sufficient connection force to maintain foam belt 102 in a closed configuration. Given the connection force provided by hook portion 834, all the subsequent hook portions may be of an equal size rather than monotonically decreasing sizes.

Figure 8G:
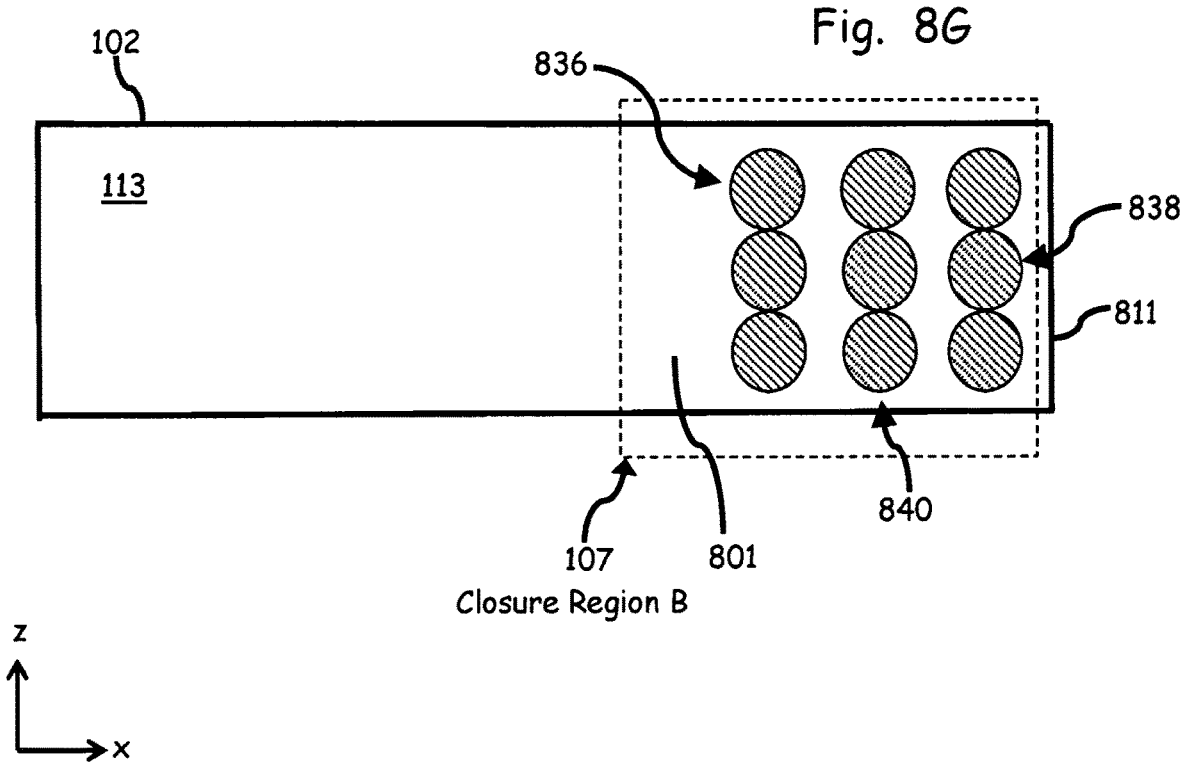
FIG. 8G is a side view of a seventh embodiment showing Closure Region B.

FIG. 8G is a side view of a seventh embodiment showing Closure Region B 107. As shown in FIG. 8G, hook portions 836, 838, 840 are each composed of a vertically-oriented grouping of circularly-shaped hook sections of a hook and loop fastener, and are disposed on surface 801 of Closure Region B 107. In various alternative arrangements, hook portions 836, 838, 840 may be disposed in corresponding recesses in surface 801. In this alternative, fifth embodiment, hook portions 824, 826, 828 are shown as being nominally the same size, i.e., circles having a nominally equal radius. Circularly-shaped hook sections perform in a hook and loop fastener in the same manner as hook portions having rectangular or polygonal shapes.

Figure 8H:
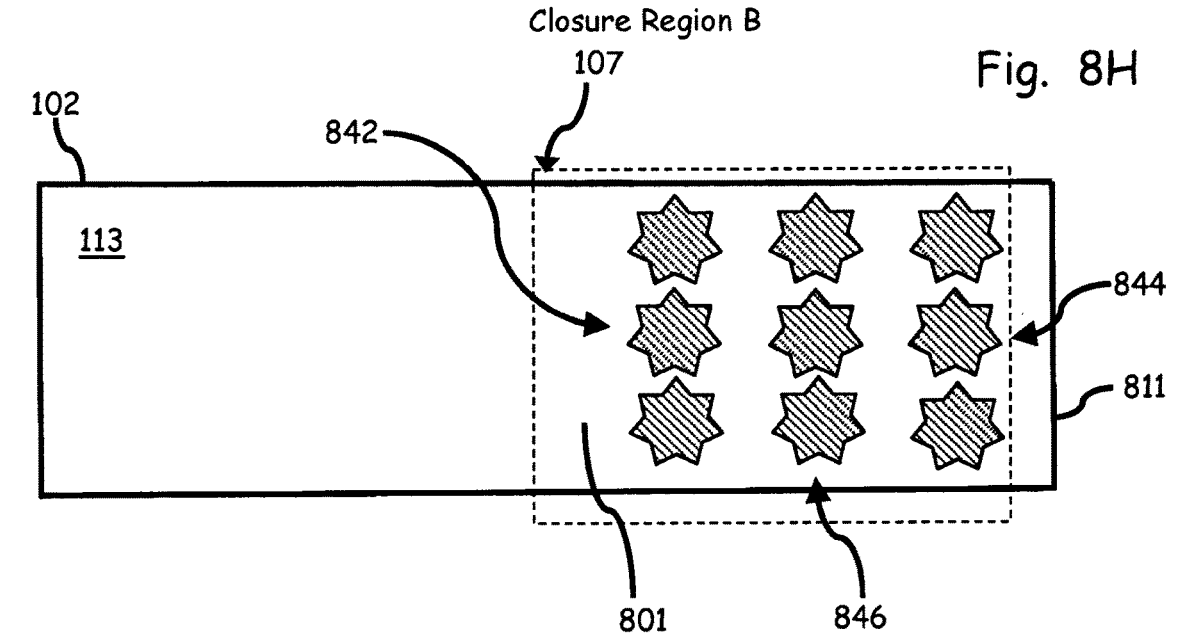
FIG. 8H is a side view of an eighth embodiment showing Closure Region B.
Figure 14:
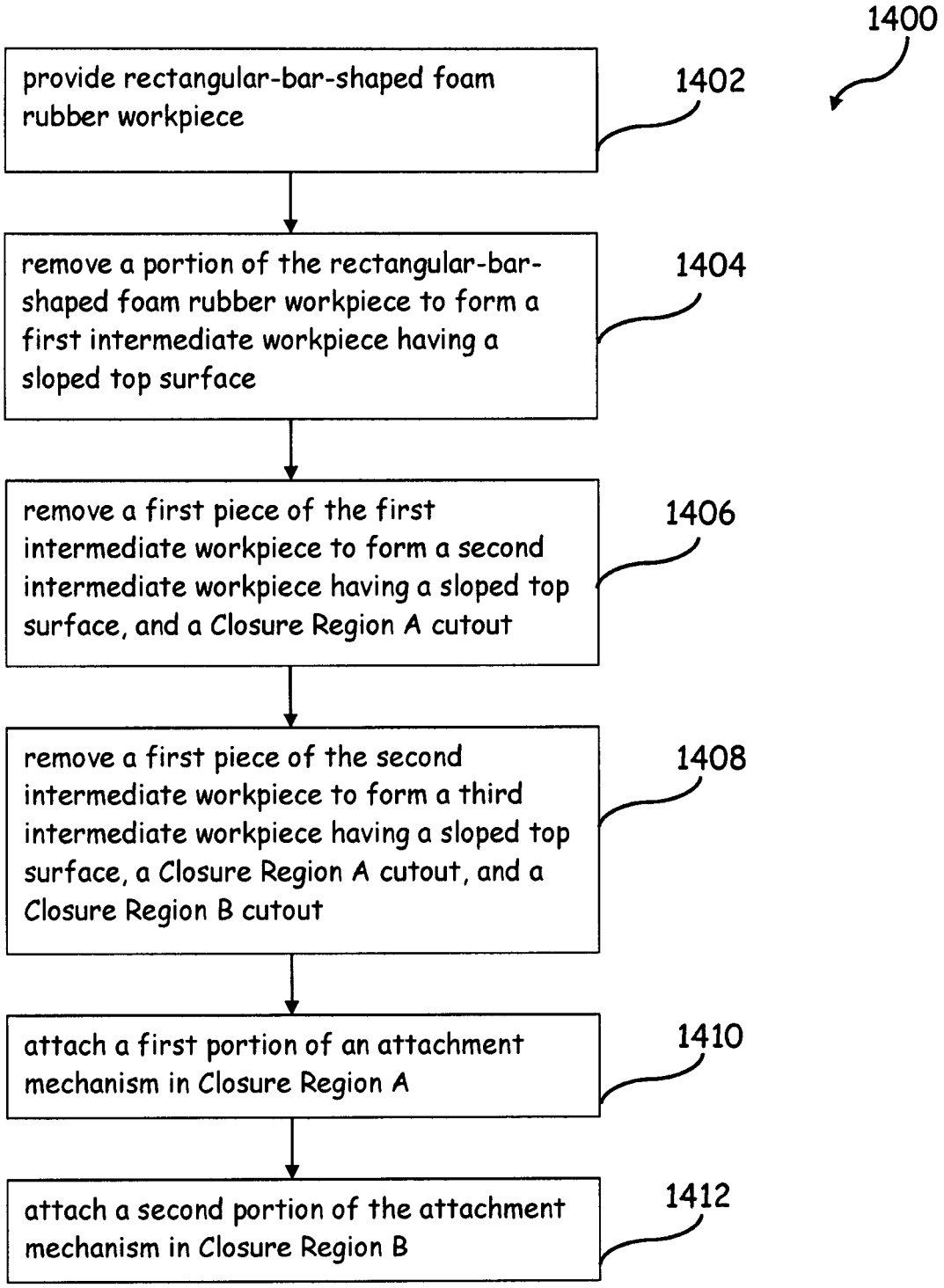
FIG. 14 is a flow diagram of an illustrative method in accordance with this disclosure.

FIG. 8H is a side view of an eighth embodiment showing Closure Region B 107. This embodiment is similar to that shown in FIG. 8G, except that rather than a vertically-oriented grouping of circularly-shaped hook sections, the hook portions 842, 844, 846 in this illustrative embodiment comprise vertically-oriented groupings of polygonal-shaped hook sections. As illustrated in FIG. 8G, 14-sided polygons, configured as 7-pointed stars, are used. However polygonal embodiments in accordance with this disclosure may have more or fewer sides, and are not limited to any particular shape or pattern. Hook portions 842, 844, 846 are disposed on surface 801 of Closure Region B 107. In alternative embodiments, hook portions 842, 844, 846 may be disposed in corresponding recesses in surface 801.

Figure 8I:
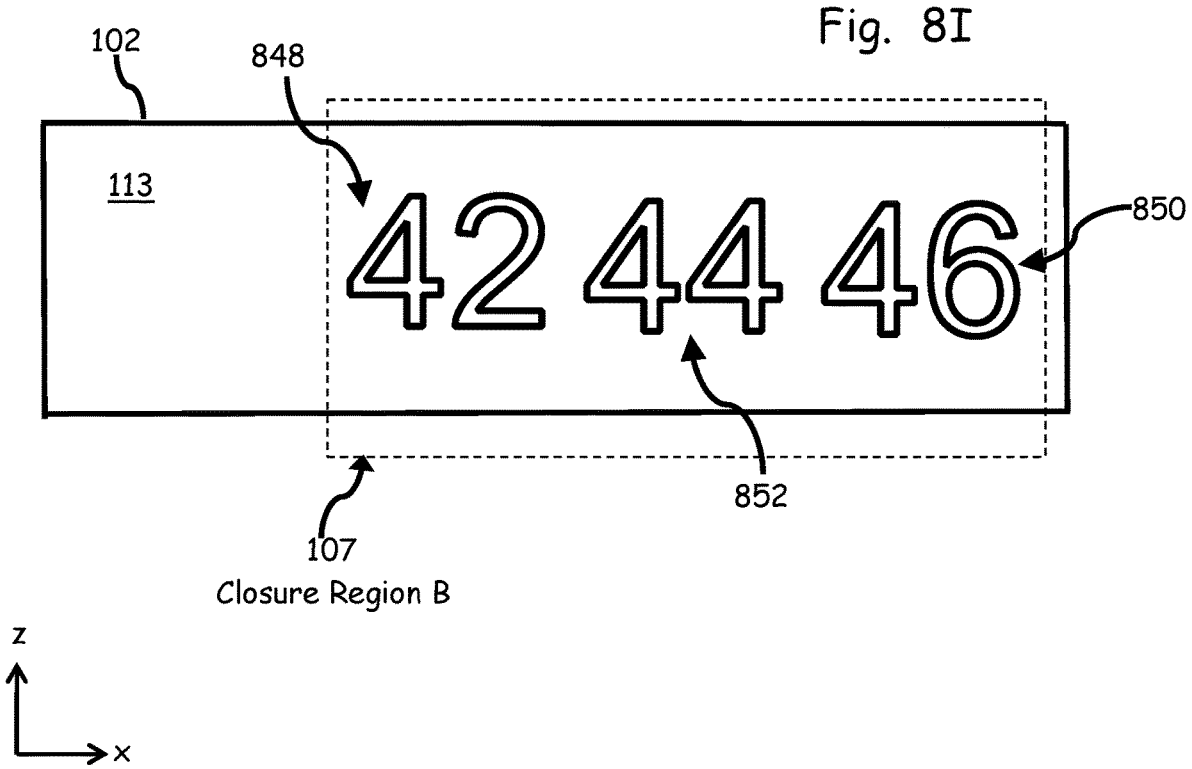
FIG. 8I is a side view of a ninth embodiment showing Closure Region B.

FIG. 8I is a side view of a ninth embodiment showing Closure Region B 107 of foam belt 102. FIG. 8I shows hook portions 848, 850, 852 disposed on surface 801 of Closure Region B 107. In this illustrative embodiment, hook portions 848, 850, 852 are shaped as numerals, and more particularly as pairs of numerals that indicate a size, such as but not limited to, a waist size. In this way, the size of the foam belt can be determined by a user. In alternative embodiments, hook portions 848, 850, 852 may be disposed in corresponding recesses in surface 801.

Figure 8J:
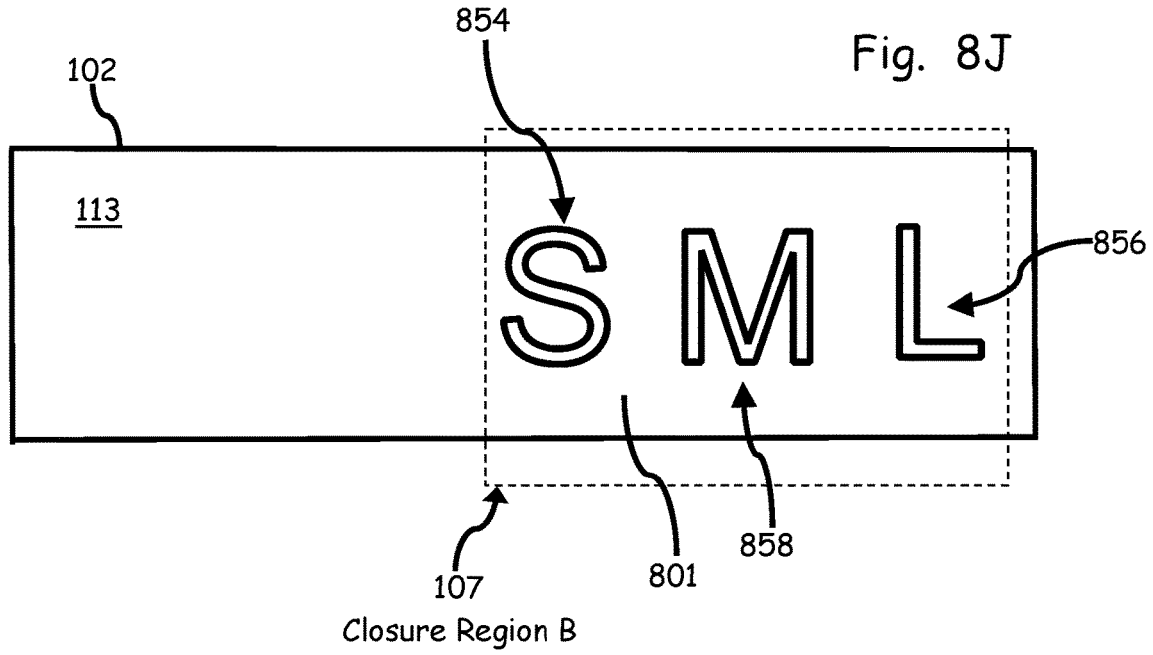
FIG. 8J is a side view of a tenth embodiment showing Closure Region B.

FIG. 8J is a side view of a tenth embodiment showing Closure Region B 107 of foam belt 102. FIG. 8J shows hook portions 854, 856, 858 disposed on surface 801 of Closure Region B 107. In this illustrative embodiment, hook portions 854, 856, 858 are shaped as letters that indicate a size, such as but not limited to, a waist size. In this way, the size of the foam belt can be determined by a user. In alternative embodiments, hook portions 854, 856, 858 may be disposed in corresponding recesses in surface 801.

Regarding the various embodiments shown and described in connection with FIGS. 8A-8J, the hook portions disposed on surface 801, or in grooves or recesses in surface 801, are attached respectively to surface 801, or the grooves or recesses in surface 801. The attachment of the hook portions provides a connection force that is greater than the pull force or tear force required to disengage the hook portions from the corresponding loop portion to which they are engaged when foam belt 102 is in its closed configuration. The attachment of the hook portions to the underlying foam should be greater than the pull force needed to disengage the hook and loop connection so that the hook portions are not dislodged or torn out of their respective locations on or in Closure Region B 107 when disengaged. Such attachment between the hook portions and the underlying foam may be achieved through the application of an adhesive, such as but not limited to a fabric adhesive.

Magnetic Closure Embodiments

Various embodiments of the foam belt apparatus in accordance with this disclosure use magnetic fasteners rather than, for example, hook and loop fasteners, or snap fasteners. As used herein, magnetic fasteners refer to one or more pairs of magnets. A first magnet of each pair of magnets is disposed on a first closure region of the foam belt, and a corresponding second magnet of each pair of magnets is disposed on a second closure region of the foam belt. In order for the magnets to act as fasteners, when aligned with each other along a common axis and brought within a predetermined distance of each other, the pair of magnets must be arranged such that opposite magnetic poles face each other. Such magnets may be permanent magnets, electromagnets without a ferromagnetic core, or electromagnets with a ferromagnetic core. Moreover, there are six possible magnet options, i.e., combinations of the foregoing three types of magnets: (1) a pair of permanent magnets; (2) a permanent magnet and an electromagnet without a ferromagnetic core; (3) a permanent magnet and an electromagnet with a ferromagnetic core; (4) a pair of electromagnets each without a ferromagnetic core; (5) an electromagnet without a ferromagnetic core and an electromagnet with a ferromagnetic core; and (6) a pair of electromagnets each with a ferromagnetic core.

Selecting a combination of magnets is a design choice based on a number of factors such as, but not limited to, the cost of the required components; the manufacturing lead time required to obtain the required components; the weight of the different magnet options; the physical size of the different magnet options; the lifetime of a battery or supercapacitor needed to power the electromagnets and the electromagnet control circuitry; and which advanced features may be desired by customers.

A pair of permanent magnets is the simplest combination to implement. On the other hand, the use of electromagnets allows for the implementation of advanced features. For example, unlike permanent magnet options that require the application of force by a user to separate the closure regions of a foam belt in accordance with this disclosure, electromagnetic options allow (1) an attractive magnetic force to be turned off; and (2) a repulsive magnetic force to be turned on. Turning off the attractive magnetic force makes separating the closure regions easy. Turning on the repulsive magnetic force makes separating the closure regions easier still by pushing the closure regions apart.

As described above, in various illustrative magnetic closure embodiments, the aforementioned pair of magnets may be a pair of permanent magnets. In such an arrangement, one magnet of a pair of magnets may be disposed on one of Closure Region A or Closure Region B, and the other magnet of the pair of magnets may be disposed on the other of Closure Region A or Closure Region B. Magnets in this arrangement are disposed such that in the closed configuration, opposite magnetic poles of the pair of magnets face each other so that the magnets attract each other. As described in greater detail below, the magnets may be permanent magnets, electromagnets, or combinations of permanent magnets and electromagnets.

Figure 9A:
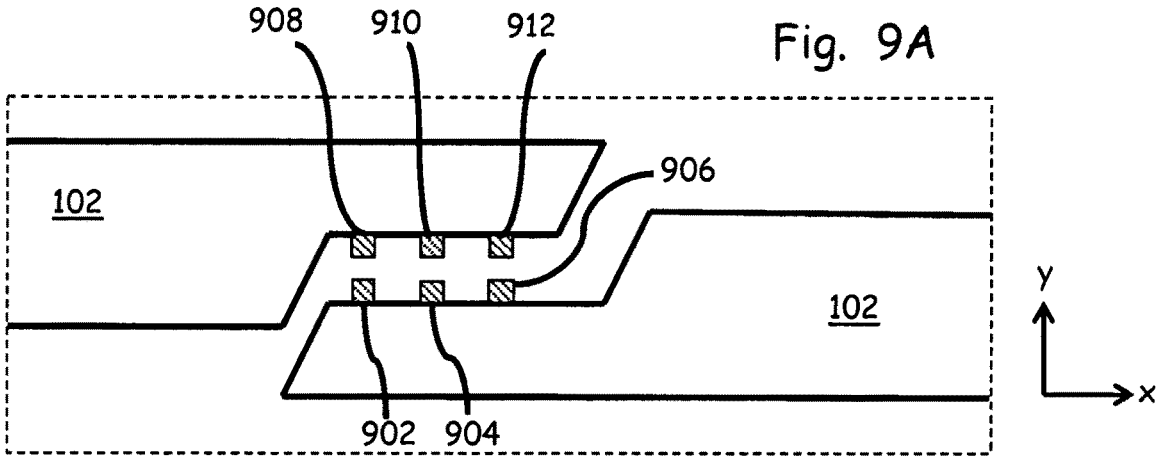
FIG. 9A is a top view, i.e., looking down in the z-direction which is perpendicular to the plane of the page, of the closure region of an eleventh embodiment showing a first amount of overlap between Closure Region A and Closure Region B prior to engagement.

FIG. 9A is a top view of the closure region of an eleventh embodiment showing a first amount of overlap between Closure Region A and Closure Region B prior to engagement.

Figure 9B:
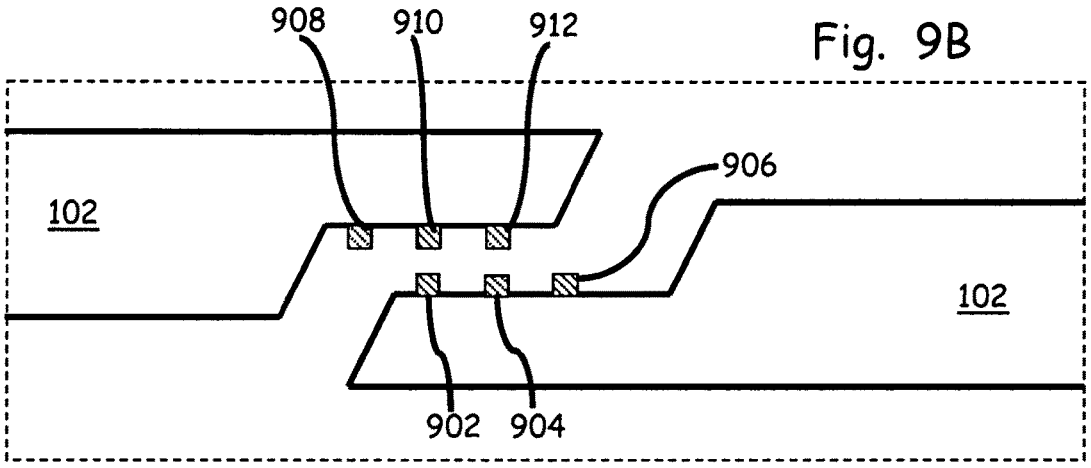
FIG. 9B is a top view of the closure region of the eleventh embodiment showing a second amount of overlap between Closure Region A and Closure Region B prior to engagement.

FIG. 9B is a top view of the closure region of the eleventh embodiment showing a second amount of overlap between Closure Region A and Closure Region B prior to engagement.

Figure 9C:
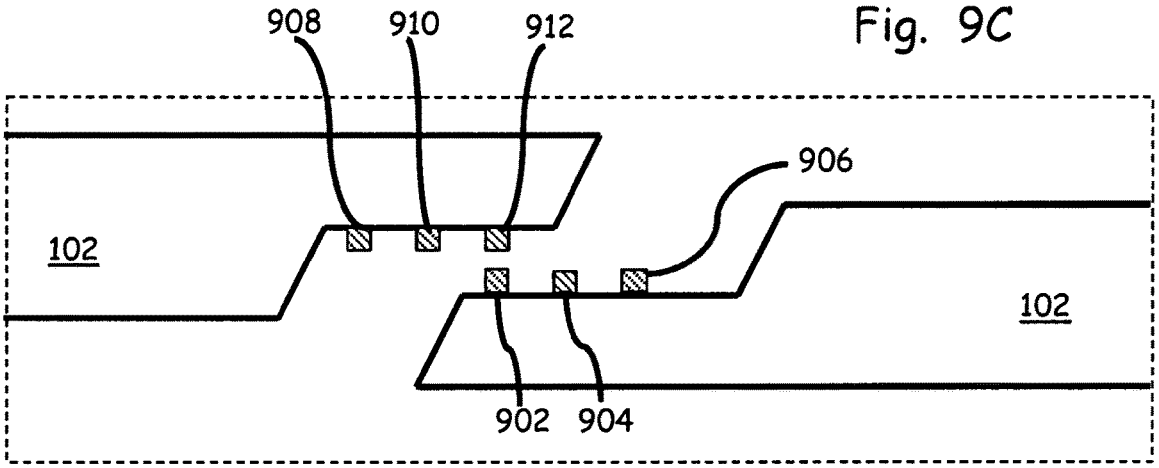
FIG. 9C is a top view of the closure region of the eleventh embodiment showing a third amount of overlap between Closure Region A and Closure Region B prior to engagement.

FIG. 9C is a top view of the closure region of the eleventh embodiment showing a third amount of overlap between Closure Region A and Closure Region B prior to engagement.

Figure 9D:
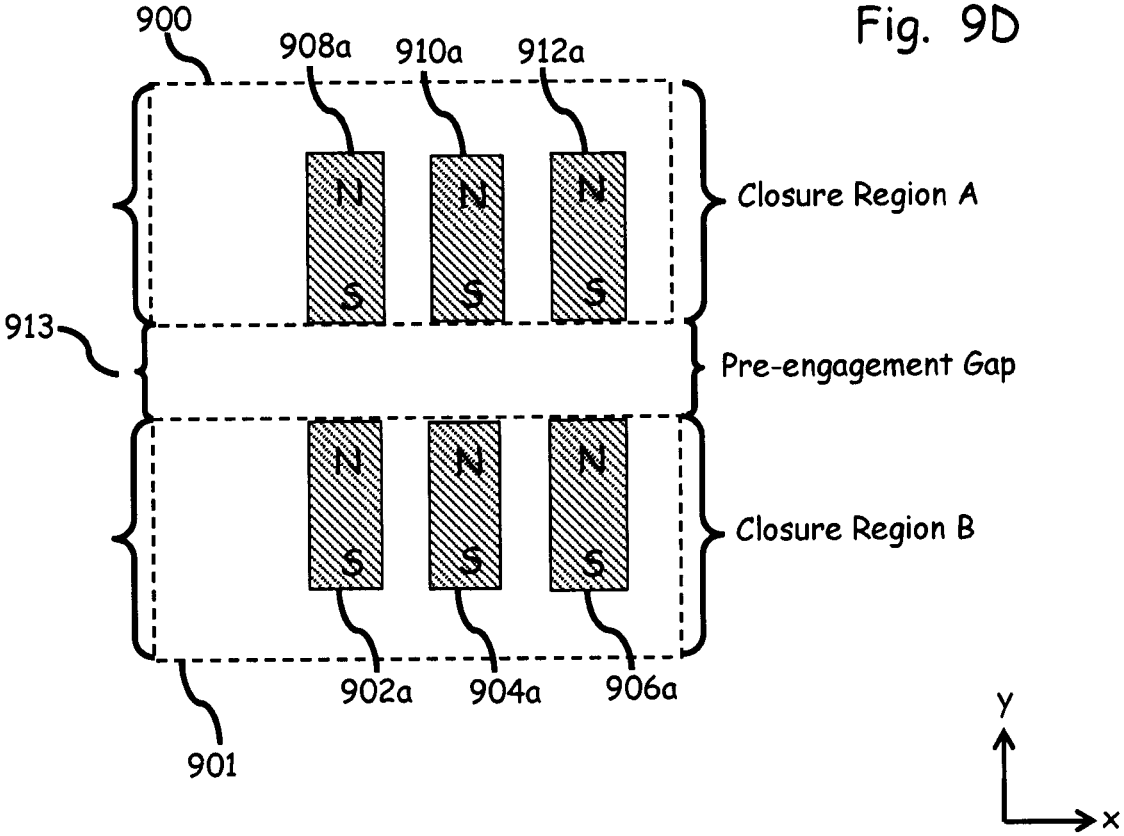
FIG. 9D is a cut-away top view, i.e., looking down in the z-direction, showing the orientation of the magnetic poles in an implementation of the eleventh embodiment.

FIG. 9D shows the orientation of the magnetic poles in an implementation of the eleventh embodiment. FIG. 9D illustrates magnets 902*a*, 904*a*, 906*a*, disposed within Closure Region B 901, and magnets 908*a*, 910*a*, 912*a* disposed within Closure Region A 900, wherein Closure Region A and Closure Region B are not yet engaged with each other, but rather separated, i.e., spaced apart by a distance labeled as a pre-engagement gap 913. Magnets 902*a*, 904*a*, 906*a*, 908*a*, 910*a*, and 912*a* are permanent magnets. As shown in FIG. 9D, each of magnets 902*a*, 904*a*, and 906*a* are oriented so that their respective north poles (designated by the letter "N" in the figure) are facing a pre-engagement gap 913. Further, each of magnets 908*a*, 910*a*, and 912*a* are oriented so that their respective south poles (designated by the letter "S" in the figure) are facing pre-engagement gap 913, and are also facing the north poles of magnets 902*a*, 904*a*, 906*a*. In this pre-engagement configuration, there are three pairs of permanent magnets (i.e., 902*a*, and 908*a*; 904*a*, and 910*a*; 906*a* and 912*a*) with each pair of magnets having opposite magnetic poles facing each other. Bringing the pairs of magnets closer together increases the attractive magnetic force between them.

Figure 9E:
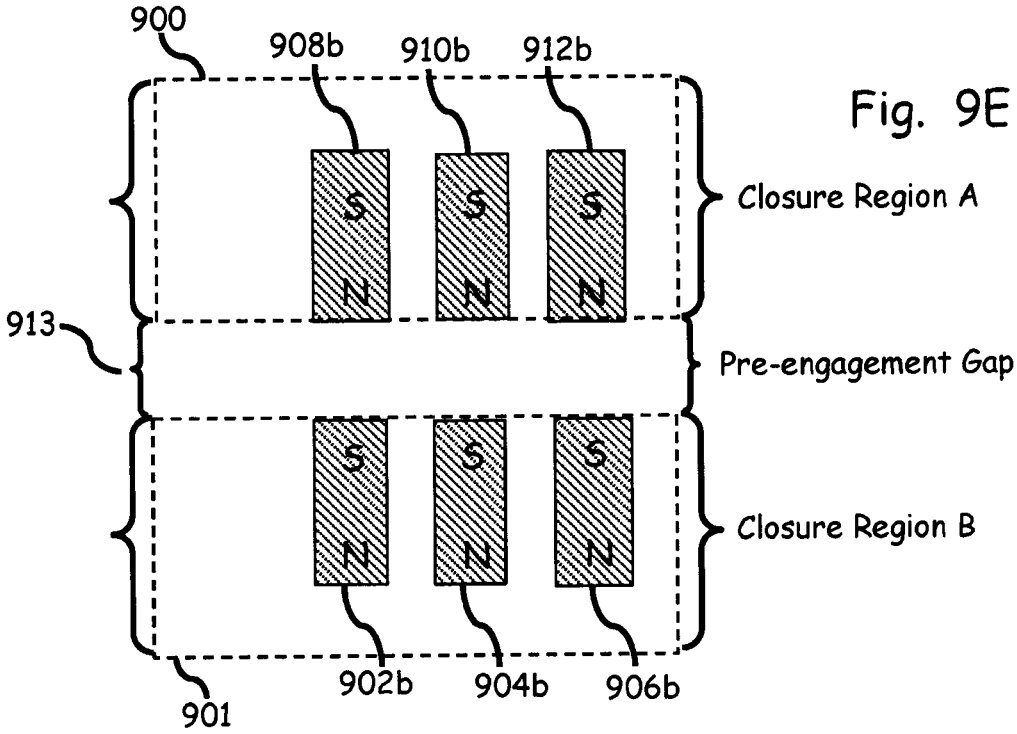
FIG. 9E is a cut-away top view, i.e., looking down in the z-direction, showing the orientation of the magnetic poles in another implementation of the eleventh embodiment.

FIG. 9E shows the orientation of the magnetic poles in another implementation of the eleventh embodiment. This implementation is similar to that of FIG. 9D except that each of magnets 902*b*, 904*b*, and 906*b*, which are all permanent magnets, are oriented so that their respective south poles (designated by the letter "S" in the figure) are facing pre-engagement gap 913. Further, each of magnets 908*b*, 910*b*, and 912*b* are oriented so that their respective north poles (designated by the letter "N" in the figure) are facing pre-engagement gap 913, and are also facing the south poles of magnets 902*a*, 904*a*, 906*a*. In this pre-engagement configuration, there are three pairs of permanent magnets (i.e., 902*b*, and 908*b*; 904*b*, and 910*b*; 906*b* and 912*b*) with each pair of magnets having opposite magnetic poles facing each other. As these pairs of magnets are brought closer together, the attractive magnetic force between them increases.

Figure 9F:
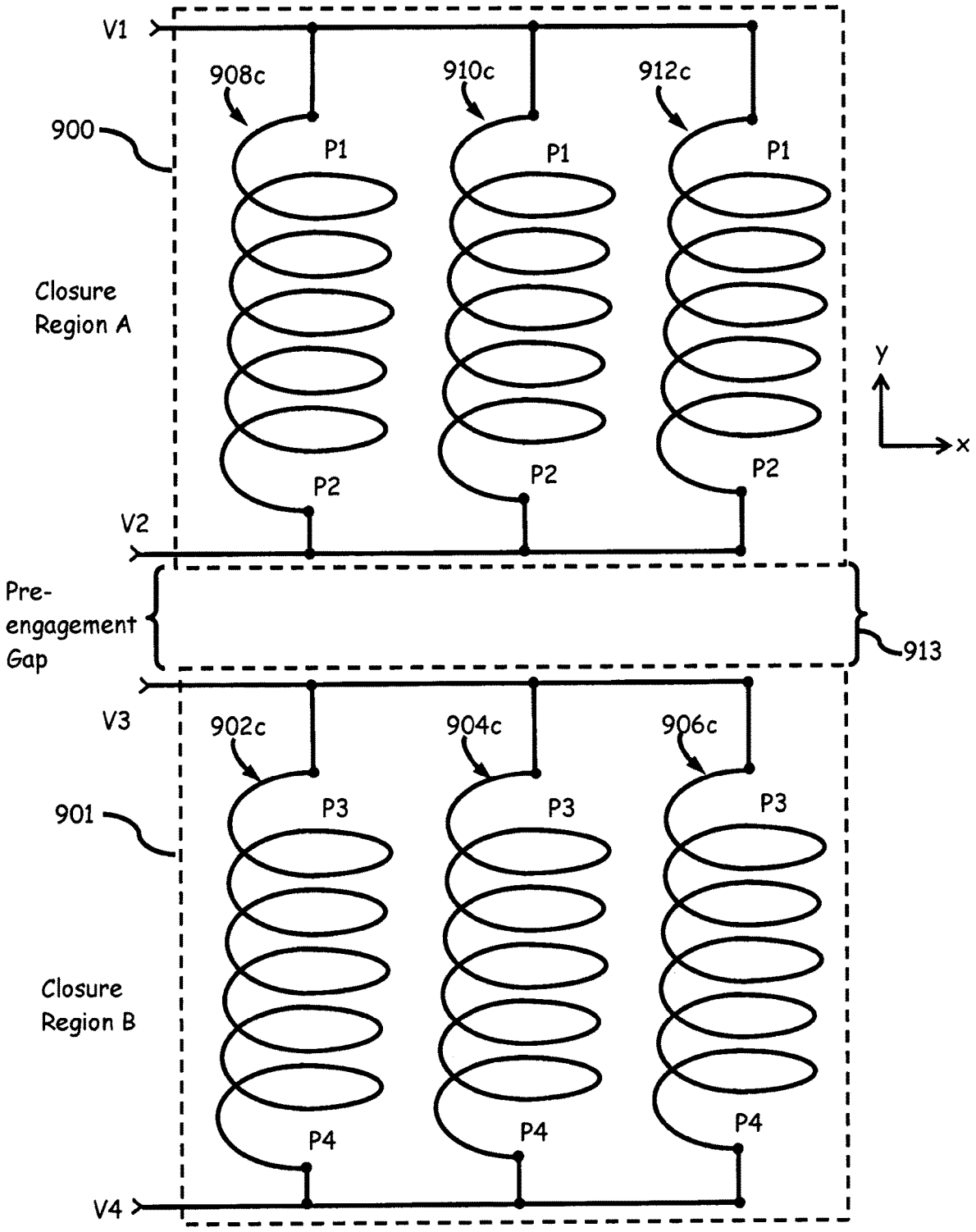
FIG. 9F is a cut-away top view, i.e., looking down in the z-direction, illustrating the eleventh embodiment implemented with electromagnetic coils rather than permanent magnets.

FIG. 9F illustrates the eleventh embodiment implemented with electromagnetic coils rather than permanent magnets. As shown, electromagnetic coils 902*c*, 904*c*, and 906*c* are disposed in Closure Region B 901 such that they are perpendicular to outer surface 111 (not shown in FIG. 9F, see FIGS. 1A and 1B) of foam belt 102, and electromagnet coils 908*c*, 910*c*, and 912*c* are disposed in Closure Region A 900 such that they are perpendicular to inner surface 113 (not shown in FIG. 9F, see FIGS. 1A and 1B) of foam belt 102. Electromagnetic coils are sometimes referred to as "windings," since the coils are formed by winding (insulated) wire into the shape of a coil. It is well known in the art that a magnetic field is generated when a current is passed through the wire windings of an electromagnetic coil. And, while the current is maintained through the wire windings of an electromagnetic coil, the electromagnetic coil acts as a magnet. Again, electromagnets are very well known in the art, and further details of the theory of electromagnetism are omitted here. However, from the perspective of some of the design choices available, it is known that the magnitude of the generated magnetic field is a function of at least the magnitude of the current through the wire, and the number of turns of wire in the coil; and the orientation of the magnetic field depends on the direction of current flow through the wire windings of the coil.

FIG. 9F further illustrates an arrangement in which electromagnetic coils 908*c*, 910*c*, and 912*c*, are coupled in parallel between a first power supply node V1 and a second power supply node V2; and electromagnetic coils 902*c*, 904*c*, and 906*c*, are coupled in parallel between a third power supply node V3, and a fourth power supply node V4. Since electromagnetic coils 908*c*, 910*c*, and 912*c*, are coupled in parallel, the magnetic poles, generated when current flows through the wire of these coils, will all be oriented in the same direction. Thus the same magnetic pole labels, P1 and P2, are used for each of electromagnetic coils 908*c*, 910*c*, and 912*c*, as shown in FIG. 9F. Likewise, since electromagnetic coils 902*c*, 904*c*, and 906*c*, are coupled in parallel, the magnetic poles generated when current flows through the wire of these coils will all be oriented in the same direction. Thus the same magnetic pole labels, P3 and P4, are used for each of electromagnetic coils 902*c*, 904*c*, and 906*c*, as shown in FIG. 9F Still referring to FIG. 9F, when current flows through electromagnetic coils 902*c*, 904*c*, and 906*c*, magnetic poles P3 and P4 are respectively established for each of them. Since each of electromagnetic coils 902*c*, 904*c*, and 906*c*, are coupled in parallel to power supply nodes V3 and V4, the orientation of their respective magnetic fields are the same. And, since the orientation of magnetic poles depends on the direction of current flow, P3 and P4 may be N-S oriented, or S-N oriented depending on how power supply nodes V3 and V4 are operated. In other words, by controlling the power supply that is coupled to the electromagnetic coils, the orientation of their magnetic fields can be flipped between N-S and S-N. Likewise, the arrangement of electromagnetic coils 908*c*, 910*c*, and 912*c*, allows the orientation of magnetic poles P1 and P2 to be flipped between N-S and S-N by controlling power supply nodes V1 and V2. Thus, by controlling power supply nodes V1, V2, V3, and V4, the magnetic poles of the electromagnets in Closure Region A 900, and Closure Region B 901, can be controlled such that Closure Region A 900 and Closure Region B 901 either magnetically attract each other, or magnetically repel each other. And, by turning off at least the electromagnets of Closure Region A 900, or the electromagnets of Closure Region B 901, there will be neither magnetic attraction nor magnetic repulsion between Closure Region A 900 and Closure Region B 901, with respect to the implementation of FIG. 9F.

Still referring to the implementation of FIG. 9F, Table I, below, lists the relationship between applied voltages, magnetic pole orientations, and the action states due to the resulting magnetic fields. In this illustrative embodiment, the direction of current flow in the wire of each electromagnetic coil, is determined by the relative magnitude of voltages of the power supply nodes to which those coils are coupled. Since the direction of current flow in an electrical circuit is from a higher voltage to a lower voltage, controlling the magnitude of the voltages on power supply nodes V1, V2, V3, and V4, allows the magnetic pole orientation of the electromagnetic coils to be correspondingly controlled. Magnetic pole P2 of Closure Region A 900, and magnetic pole P3 of Closure Region B 901, face each other across pre-engagement gap 913, and therefore the respective orientation of those poles determines whether Closure Region A 900 and Closure Region B 901 are magnetically attracted to, or magnetically repelled from, each other. Note that, when P2 and P3 are both configured as north magnetic poles, or when P2 and P3 are both configured as south magnetic poles, the result is that Closure Region A 900 and Closure Region B 901 will be subjected to a repulsive magnetic force. On the other hand, when P2 and P3 are configured respectively as a north magnetic pole and a south magnetic pole, or when P2 and P3 are configured as a south magnetic pole and a north magnetic pole, the result is that Closure Region A 900 and Closure Region B 901 will be subjected to an attractive magnetic force. So, as they say, opposites attract.

TABLE I

| V1 | V2 | V3 | V4 | P1 | P2 | P3 | P4 | Action State |
|---|---|---|---|---|---|---|---|---|
| + | − | − | + | S | N | N | S | push open |
| − | + | − | + | N | S | N | S | pull closed |
| = | = | X | X | n/a | n/a | X | X | no action |
| X | X | = | = | X | X | n/a | n/a | no action |
| + | − | + | − | S | N | S | N | pull closed |
| − | + | + | − | N | S | S | N | push open |

Figure 9G:
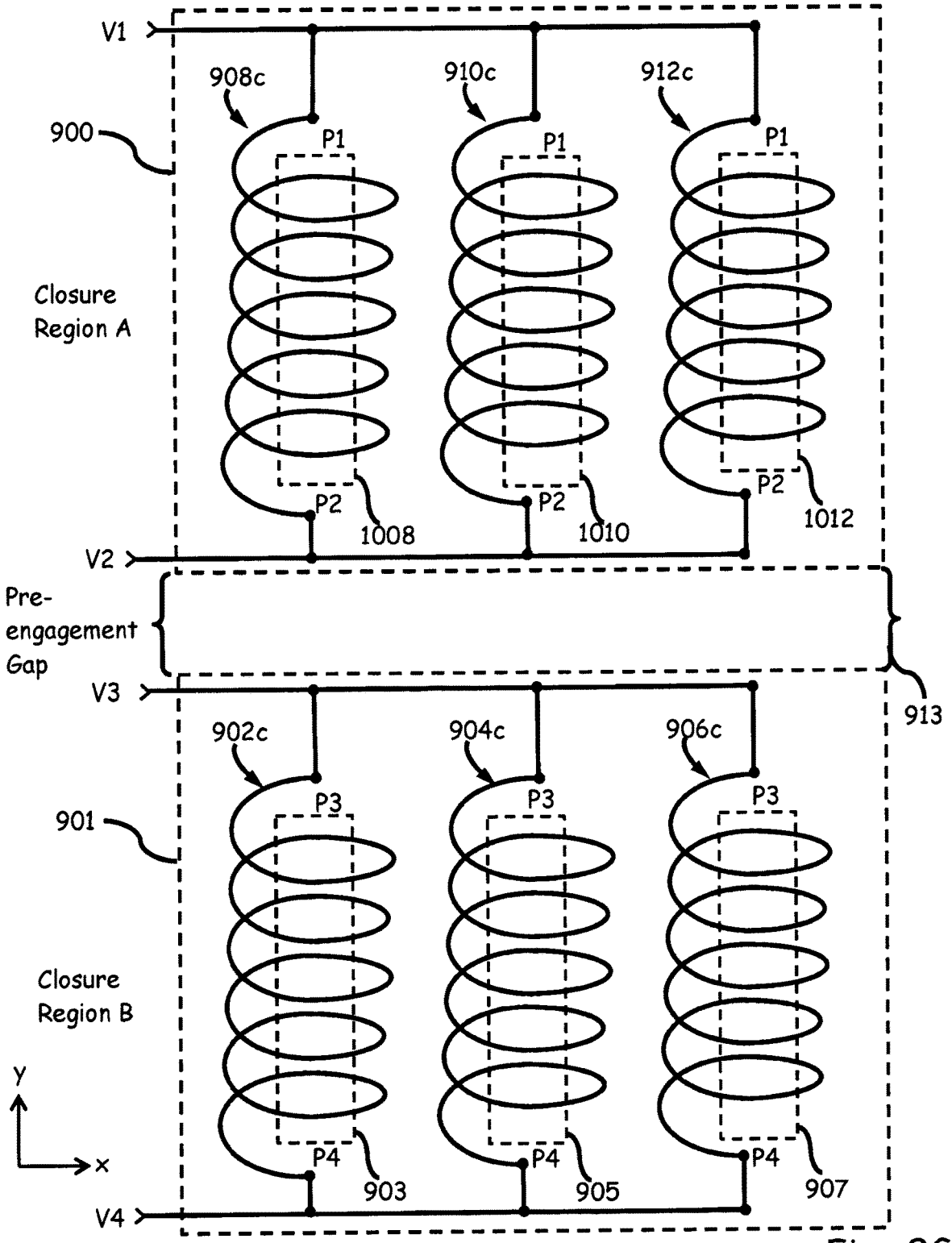
FIG. 9G is a cut-away top view, i.e., looking down in the z-direction, illustrating the eleventh embodiment implemented with electromagnetic coils combined, respectively, with corresponding ferromagnetic cores.

FIG. 9G illustrates the eleventh embodiment implemented with electromagnetic coils combined, respectively, with corresponding ferromagnetic cores. FIG. 9G is the same as FIG. 9F except that each electromagnetic coil is provided with a ferromagnetic core. As is well known in the art, including a ferromagnetic core around which the electromagnetic coil is disposed increases the strength of that electromagnet's magnetic field. Referring to FIG. 9G, an electromagnetic coil 902*c* includes a ferromagnetic core 903; an electromagnetic coil 904*c* includes a ferromagnetic core 905; an electromagnetic coil 906*c* includes a ferromagnetic core 907; an electromagnetic coil 908*c* includes a ferromagnetic core 1008; an electromagnetic coil 910*c* includes a ferromagnetic core 1010; and an electromagnetic coil 912*c* includes a ferromagnetic core 1012.

Still referring to the implementation of FIG. 9G, Table II, below, lists the relationship between applied voltages, magnetic pole orientations, and the action states due to the resulting magnetic fields. Note that although the magnetic field strength is increased by the addition of the above-described ferromagnetic cores, the behavior of this embodiment, from the point of view of control, is the same as that of the implementation described in connection with FIG. 9F.

TABLE II

| V1 | V2 | V3 | V4 | P1 | P2 | P3 | P4 | Action State |
|---|---|---|---|---|---|---|---|---|
| + | − | − | + | S | N | N | S | push open |
| − | + | − | + | N | S | N | S | pull closed |
| = | = | X | X | n/a | n/a | X | X | no action |
| X | X | = | = | X | X | n/a | n/a | no action |
| + | − | + | − | S | N | S | N | pull closed |
| − | + | + | − | N | S | S | N | push open |

Figure 10:
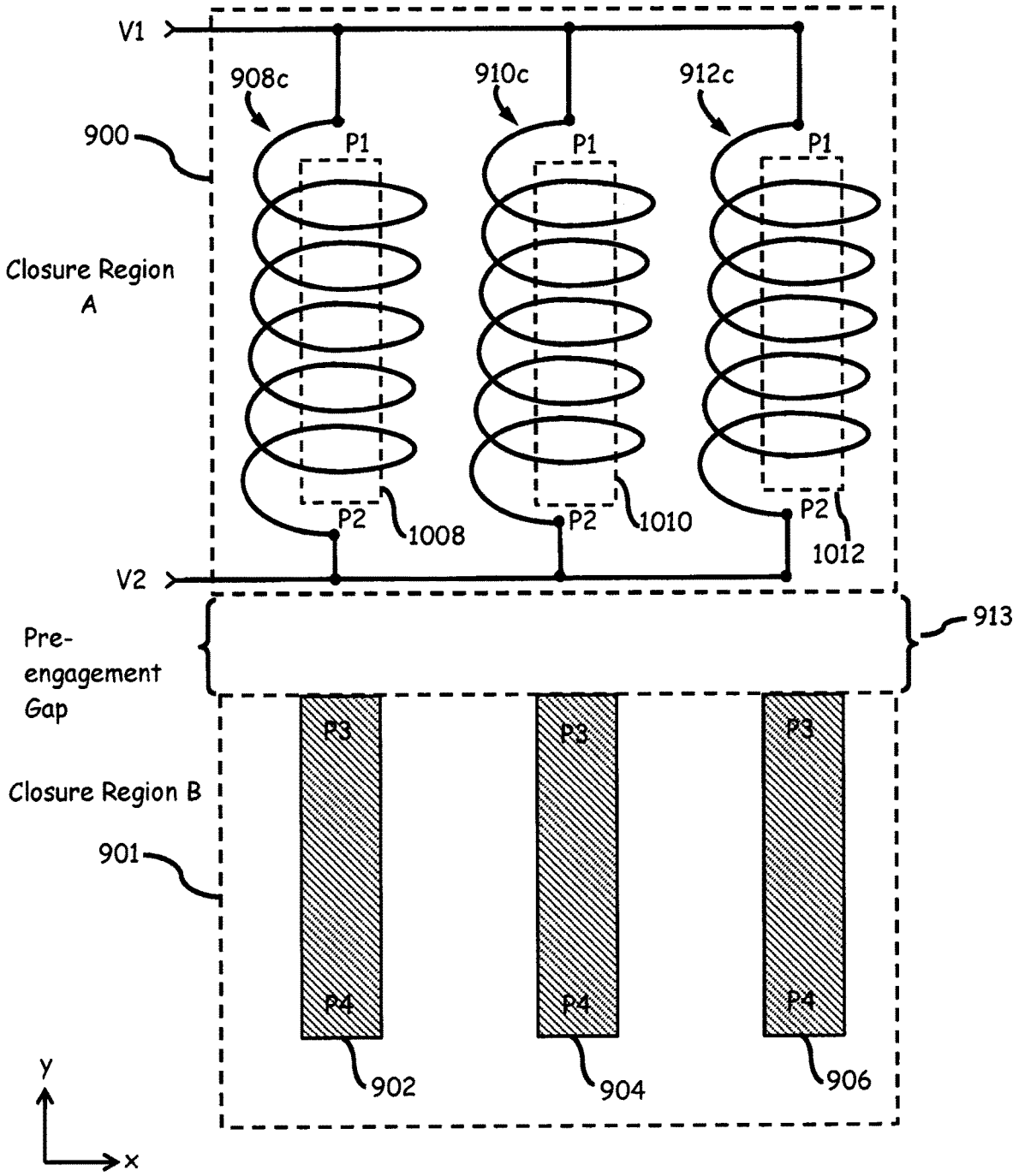
FIG. 10 is a cut-away top view, i.e., looking down in the z-direction, illustrating the eleventh embodiment implemented with a first one of the two closure regions having electromagnetic coils combined, respectively, with corresponding ferromagnetic cores, and a second one of the two closure regions having permanent magnets.

FIG. 10 illustrates the eleventh embodiment implemented with a first one of the two closure regions having electromagnetic coils combined, respectively, with corresponding ferromagnetic cores, and a second one of the two closure regions having permanent magnets. In other words, the implementation of FIG. 10 illustrates a hybrid approach wherein a first closure region, in this non-limiting example Closure Region A 900, is configured in the same way as Closure Region A 900 in FIG. 9G; and a second closure region, in this non-limiting example Closure Region B 901, is configured similarly to Closure Region B 901 in FIGS. 9D and 9E. The difference between Closure Region B 901 in FIG. 10, and closure regions B 901 in FIGS. 9D and 9E, is that rather than specifically identifying the magnetic pole orientation of permanent magnets 902, 904, 906, FIG. 10 illustrates the general case simply by labeling the magnetic poles as P3 and P4.

Still referring to the implementation of FIG. 10, Table III, below, lists the relationship between applied voltages, magnetic pole orientations, and the action states due to the resulting magnetic fields.

TABLE III

| V1 | V2 | P1 | P2 | P3 | P4 | Action State |
|---|---|---|---|---|---|---|
| + | − | S | N | N | S | push open |
| − | + | N | S | N | S | pull closed |
| = | = | n/a | n/a | N | S | no action |
| + | − | S | N | S | N | pull closed |
| − | + | N | S | S | N | push open |
| = | = | n/a | n/a | S | N | no action |

The first three entries in TABLE III relate to a configuration in which permanent magnets 902, 904, and 906 are oriented such that their north magnetic poles are facing pre-engagement gap 913. The second three entries in TABLE III relate to a configuration in which permanent magnets 902, 904, and 906 are oriented such that their south magnetic poles are facing pre-engagement gap 913.

Figure 11A:
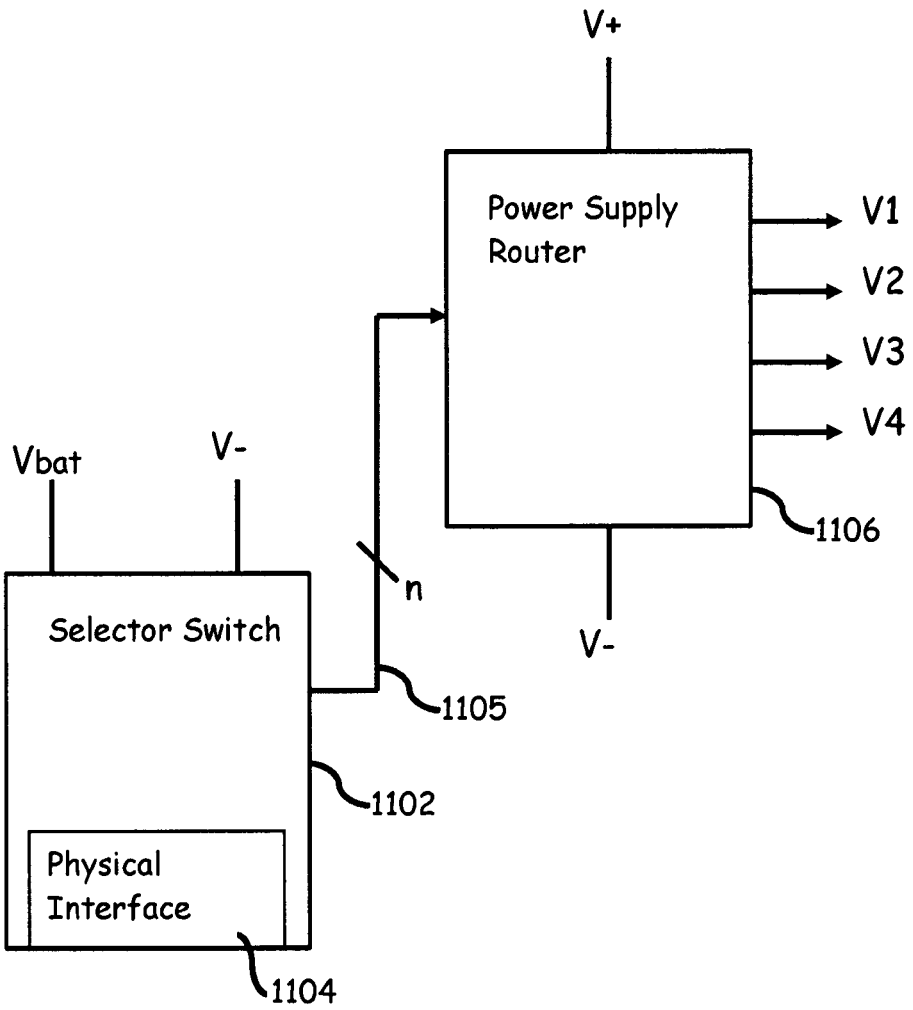
FIG. 11A is a high-level block diagram of a selector switch and a power supply router for controlling the direction of current flow in one or more electromagnets.

FIG. 11A is a high-level block diagram of a selector switch and a power supply router for controlling the direction of current flow in one or more electromagnets. In this illustrative embodiment, a selector switch 1102, which includes a physical interface 1104, is coupled to a power supply node "Vbat," and a power supply node "V−." Selector switch 1102 is configured to drive a signal 1105 that is based on the state of physical interface 1104. In some embodiments, signal 1105 is a digital signal of n bits where n≥1. In other embodiments, signal 1105 is an analog signal. The function of signal 1105 is to communicate to a power supply router 1106, the polarity of power supply connections made to one or more electromagnet coils. Since the polarity of the power supply connections determines the direction of current flow through the electromagnet coils, it correspondingly determines the orientation of the North/South magnetic poles of the electromagnets so formed. Various physical configurations of such electromagnets are described above in connection with FIGS. 9F and 9G. The magnitude, or range of magnitudes, of the voltage at power supply node Vbat is a design choice made by those of ordinary skill in the art and does not require undue experimentation. Some factors affecting this design choice include the strength of the magnetic force that is desired to achieve and maintain closure of the foam belt; the number of turns in the electromagnet coils; the cross-sectional area of the wire used to form the electromagnet coils; whether the electromagnet coils are disposed around a ferromagnetic core; whether a battery or supercapacitor is selected to provide the voltage and current to the electromagnet coils; the tradeoffs in the size and weight of the battery or supercapacitor, electromagnet coils, and ferromagnetic cores in view of the height and thickness of the foam belt; the costs of the foregoing components, and the manufacturing lead times for obtaining the foregoing components.

Figure 11B:
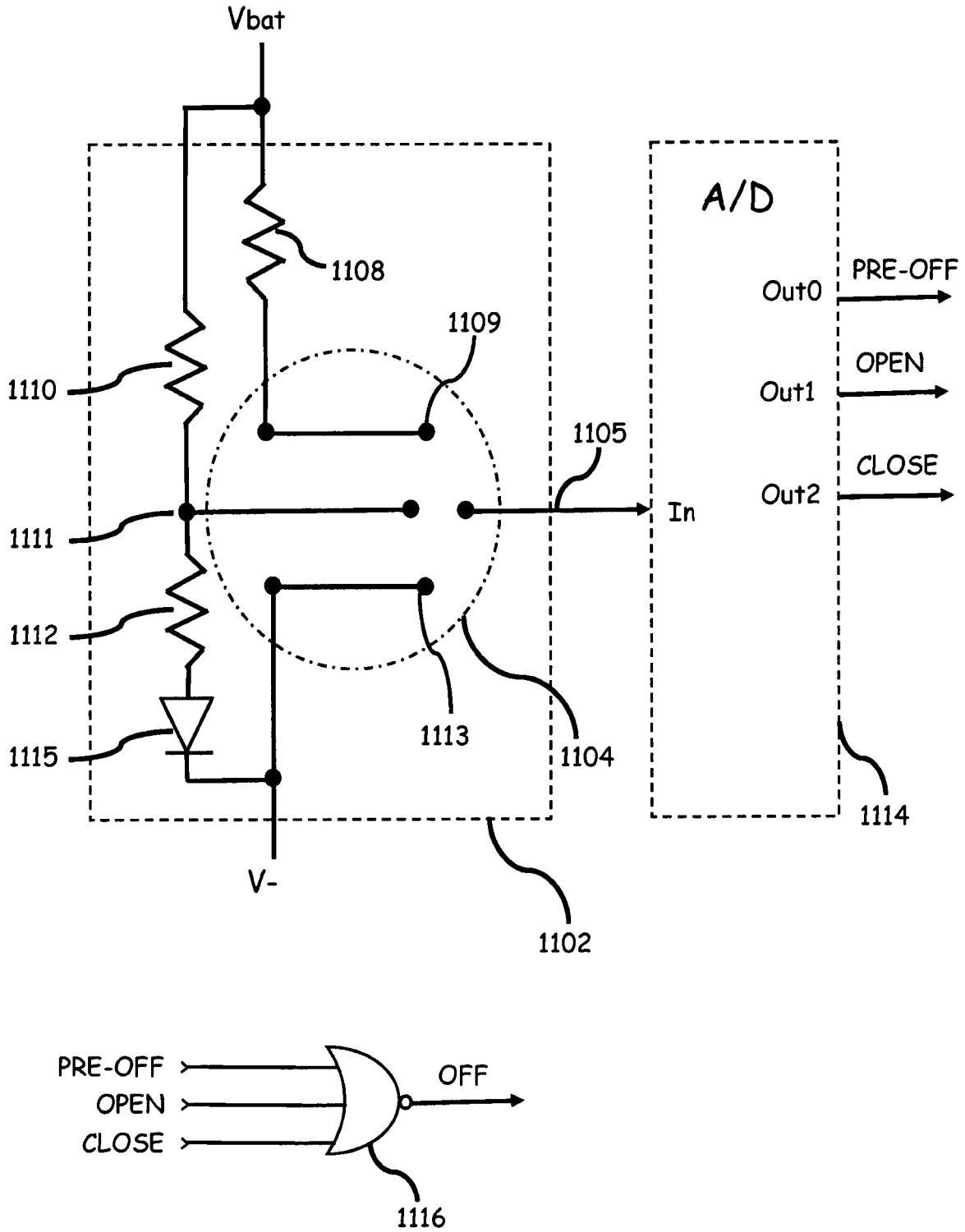
FIG. 11B is a schematic diagram of an illustrative selector switch in accordance with this disclosure, including a three-position switch as a physical interface, and a resistor network configured to provide a voltage divider and a current limiter.

FIG. 11B is a schematic diagram of an illustrative selector switch in accordance with this disclosure, including a three-position switch as a physical interface, and a resistor network configured to provide a voltage divider and a current limiter; an analog-to-digital converter, and control logic. In this illustrative embodiment, a selector switch 1102 includes a three-position switch 1104, a first resistor 1108, a second resistor 1110, a third resistor 1112, and a diode 1115. An output of three-position switch 1104 is coupled so as to provide an output of selector switch 1102 at output terminal 1105. In operation, a user physically interacts with three-position switch 1104, such as, by way of example and not limitation, turning a knob, flipping a switch lever, or pushing a button. As a result of the user's physical interaction with three-position switch 1104, output terminal 1105 is coupled to one of terminals 1109, 1111, or 1113. Output terminal 1105 is coupled to an analog-to-digital converter (A/D) 1114. A/D 1114, as shown in FIG. 11B, includes an input terminal "In," and three output terminals "Out0," "Out1," and "Out2." A/D conversion circuits are well known and their specific circuit designs are not discussed further herein. A/D converters are commercially available from a number of large manufacturers including, but not limited to, Analog Devices Incorporated, and Texas Instruments. In this illustrative embodiment, output terminals Out0, Out1, and Out2, are respectively coupled to nodes "PRE-OFF," "OPEN," and "CLOSE," as shown in FIG. 11B. Output terminals Out0, Out1, and Out2, and correspondingly nodes PRE-OFF, OPEN, and CLOSE, provide a 3-bit digital output that represents the voltage at the input terminal of A/D 1114, which is provided via output terminal 1105.

Still referring to FIG. 11B, terminal 1109 is coupled to node Vbat by resistor 1108, thus the voltage at terminal 1109, prior to connection to output terminal 1105 is also Vbat since there is no current flow through resistor 1108. When terminal 1109 is connected to output terminal 1105, there is negligible current flow through resistor 1108 to the input terminal of A/D 1114. Thus, any voltage drop (V=IR) across resistor 1108 is likewise negligible. Similarly, when terminal 1111 is connected to output terminal 1105, there is a negligible change in current flow through resistor 1110 to the input terminal of A/D 1114. Thus the voltage at terminal 1111 remains substantially unchanged, and that voltage is determined primarily be the potential difference between Vbat and V−, and the ratio of the resistances of, resistors 1110 and 1112. In this illustrative embodiment, terminal 1113 is tied directly to power supply node V−, thus the voltage at terminal 1113 does not change when terminal 1113 is coupled to the input terminal of A/D 1114 via out terminal 1105 of selector switch 1102. In this illustrative embodiment there is no current-limiting resistor disposed between terminal 1113 and power supply node V−. In various alternative embodiments a current-limiting resistor may be coupled between terminal 1113 and power supply node V− in order to limit current flow in the event of a short circuit condition.

Still referring to FIG. 11B, a 3-input NOR gate 1116 is shown. The three input terminals of NOR gate 1116 are respectively coupled to nodes PRE-OFF, OPEN, and CLOSE (which, in turn, correspond respectively to the three output terminals Out0, Out1, and Out2, of A/D 1114). The output terminal of NOR gate 1116 is coupled to a node "OFF." In operation, the output of NOR gate 1116 is asserted when each of PRE-OFF, OPEN, and CLOSE are in a logic low state. In some embodiments described below, OPEN, CLOSE, and OFF are used by power supply router circuits to activate one or more electromagnets, and to control the north/south polarity of those electromagnets.

In various alternative embodiments, diode 1115 may optionally be left out of selector switch 1102. By eliminating diode 1115 and connecting resistor 1112 directly to node V−, the total voltage across the voltage divider constituted by resistors 1110 and 1112 will be increased by the diode drop of diode 1115, i.e., by the forward voltage, $V_F$, of diode 1115. Consequently, the current through the voltage divider will increase in accordance with the formula $I=V/R_{total}$, where I=current through the voltage divider, V equals the voltage across the voltage divider, and $R_{total}$=the sum of the resistances of resistors 1110 and 1112. This alternative embodiment may reduce the bill of materials, but may result in a shorter battery life due to increased current flow through the voltage divider.

Figure 11C:
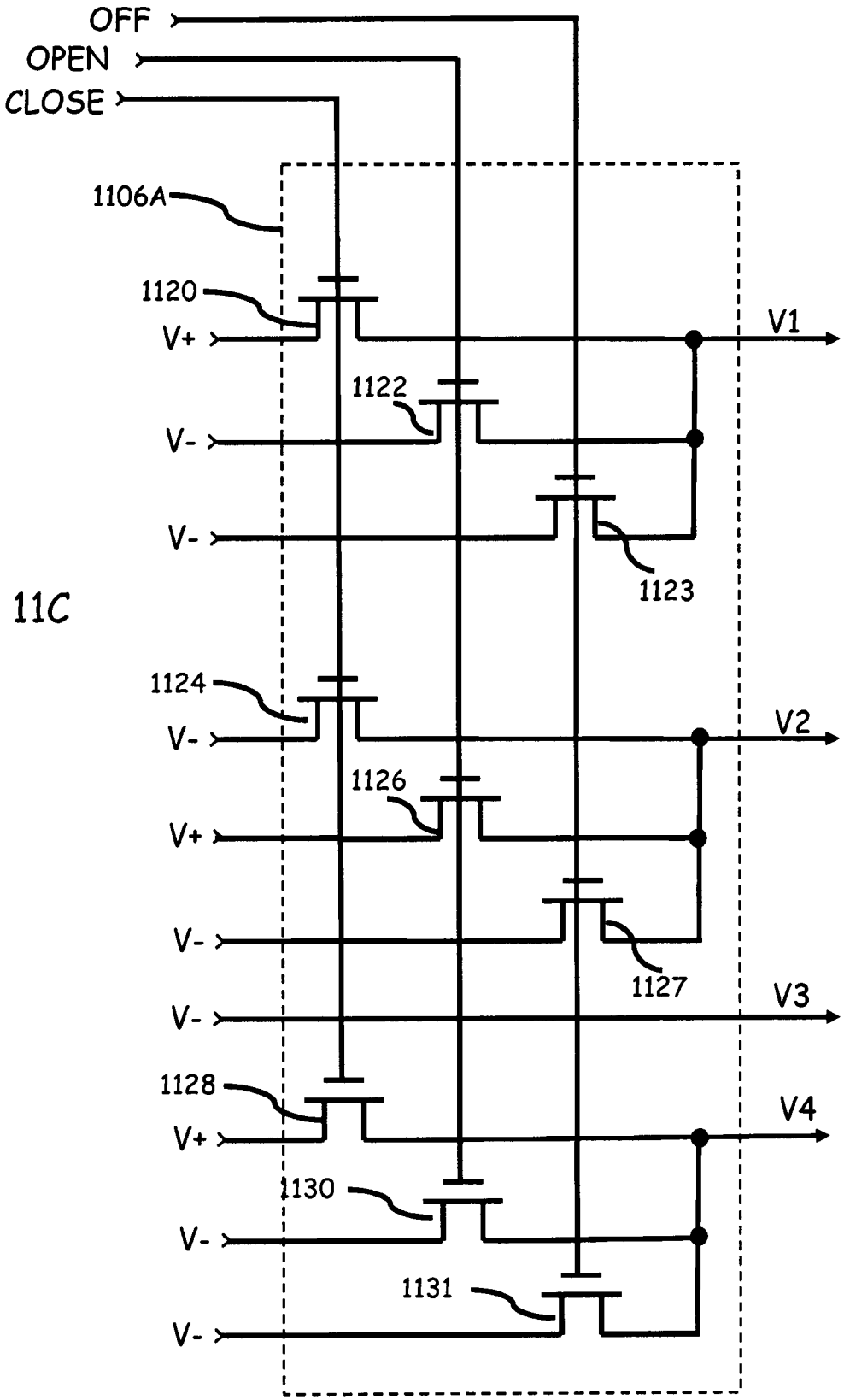
FIG. 11C is a schematic diagram of an illustrative power supply router configured to couple at least one electromagnet coil to a power supply.

FIG. 11C is a schematic diagram of an illustrative power supply router configured to couple at least one electromagnet coil to a power supply. More particularly, an illustrative power supply router 1106A, is coupled to nodes CLOSE, OPEN, and OFF, and configured to perform in accordance with the control signals provided on nodes CLOSE, OPEN, and OFF; and is further configured to provide outputs for nodes V1, V2, V3, and V4. For the sake of convenience, the control signals provided on nodes CLOSE, OPEN, and OFF will be referred to hereinafter as CLOSE, OPEN, and OFF respectively. Power supply router 1106A includes a first NFET 1120 coupled between a first power supply node V+ and a node V1; a second NFET 1122 coupled between a second power supply node V− and node V1; and a third NFET 1123 coupled between second power supply node V− and node V1. A gate terminal of NFET 1120 is coupled to receive control signal CLOSE; a gate terminal of NFET 1122 is coupled to receive control signal OPEN; and a gate terminal of NFET 1123 is coupled to receive control signal OFF. Together, NFETs 1120, 1122, and 1123 are configured to operate effectively as a 3-to-1 multiplexer with each of its first, second, and third data inputs tied, respectively, to a corresponding one of a first power supply node and a second power supply node. That is, when the signal CLOSE is asserted and the signals OPEN and OFF are deasserted, node V1 is coupled, via NFET 1120, to first power supply node V+. When the control signal OPEN is asserted and the control signals CLOSE and OFF are deasserted, node V1 is coupled, via NFET 1122, to second power supply node V−. When control signal OFF is asserted and control signals CLOSE and OPEN are deasserted, node V1 is coupled, via NFET 1123 to second power supply node V−.

Still referring to FIG. 11C, a fourth NFET 1124, a fifth NFET 1126, and a sixth NFET 1127 are configured to operate in the same manner as NFETs 1120, 1122, 1123, and drive node V2 with either V+ or V−, as shown in FIG. 11C and in TABLE IV below. Likewise, a seventh NFET 1128, an eighth NFET 1130, and a ninth NFET 1131 are configured to operate in the same manner as NFETs 1120, 1122, and drive node V4 with either V+ or V−, as shown in FIG. 11C and in TABLE IV below.

TABLE IV

| OPEN | CLOSE | OFF | V1 | V2 | V3 | V4 |
|---|---|---|---|---|---|---|
| 0 | 0 | 0 | undefined | undefined | V− | undefined |
| 0 | 0 | 1 | V− | V− | V− | V− |
| 0 | 1 | 0 | V− | V+ | V− | V+ |
| 0 | 1 | 1 | undefined | undefined | V− | undefined |
| 1 | 0 | 0 | V+ | V− | V− | V− |
| 1 | 0 | 1 | undefined | undefined | V− | undefined |
| 1 | 1 | 0 | undefined | undefined | V− | undefined |
| 1 | 1 | 1 | undefined | undefined | V− | undefined |

The condition of two or more of control signals CLOSE, OPEN, and OFF being asserted concurrently is a forbidden state, and is prohibited by the physical implementation of the system as described above in connection with FIG. 11B. Thus, in TABLE X above, those entries which show (for the sake of completeness) two or more of control signals CLOSE, OPEN, and OFF being asserted concurrently, the resulting condition of nodes V1, V2, and V4 are undefined.

Figure 11D:
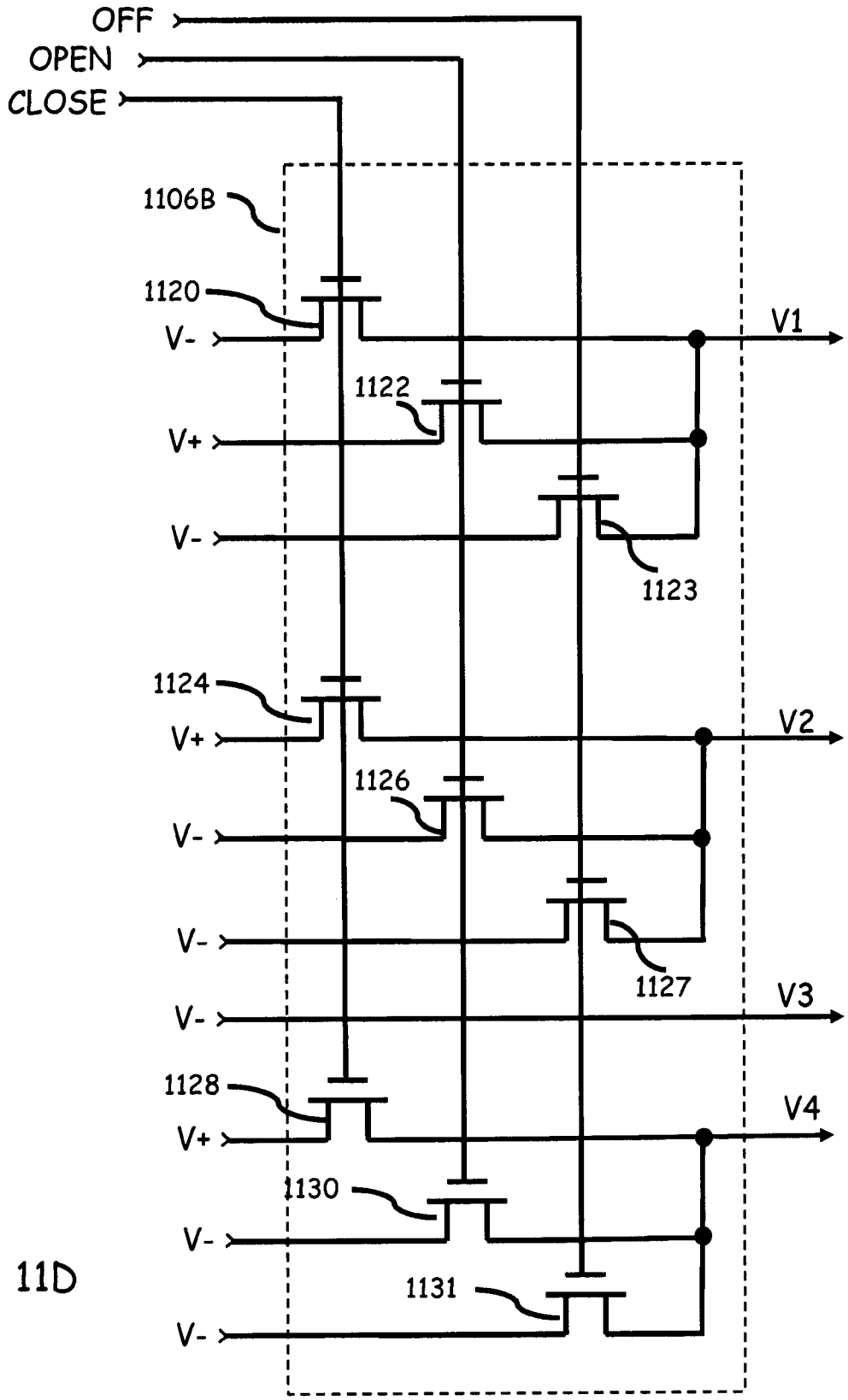
FIG. 11D is a schematic diagram of another illustrative power supply router configured to couple at least one electromagnet coil to a power supply.

FIG. 11D is a schematic diagram of an alternative illustrative power supply router configured to couple at least one electromagnet coil to a power supply. An illustrative power supply router 1106B, is coupled to nodes CLOSE, OPEN, and OFF, and configured to perform in accordance with the control signals provided on nodes CLOSE, OPEN, and OFF; and is further configured to provide outputs for nodes V1, V2, V3, and V4. As noted above, the control signals provided on nodes CLOSE, OPEN, and OFF are referred to here as CLOSE, OPEN, and OFF respectively. Power supply router 1106B includes first NFET 1120 coupled between second power supply node V− and node V1; second NFET 1122 coupled between first power supply node V+ and node V1; and third NFET 1123 coupled between second power supply node V− and node V1. A gate terminal of NFET 1120 is coupled to receive control signal CLOSE; a gate terminal of NFET 1122 is coupled to receive control signal OPEN; and a gate terminal of NFET 1123 is coupled to receive control signal OFF. Together, NFETs 1120, 1122, and 1123 are configured to operate effectively as a 3-to-1 multiplexer with each of its first, second, and third data inputs tied, respectively, to a corresponding one of the first power supply node and the second power supply node. That is, when control signal CLOSE is asserted and the control signals OPEN and OFF are deasserted, node V1 is coupled, via NFET 1120, to second power supply node V−. When control signal OPEN is asserted and control signals CLOSE and OFF are deasserted, node V1 is coupled, via NFET 1122, to first power supply node V+. When control signal OFF is asserted and control signals CLOSE and OPEN are deasserted, node V1 is coupled, via NFET 1123 to second power supply node V−.

Still referring to FIG. 11D, fourth NFET 1124, fifth NFET 1126, and sixth NFET 1127 are configured to operate in the same manner as NFETs 1120, 1122, 1123, and drive node V2 with either V+ or V−, as shown in FIG. 11D and in TABLE V below. Likewise, seventh NFET 1128, eighth NFET 1130, and ninth NFET 1131 are configured to operate in the same manner as NFETs 1120, 1122, 1123 and drive node V4 with either V+ or V−, as shown in FIG. 11D and in TABLE V below.

In this illustrative embodiment, as shown in FIG. 11D, node V3 is tied, i.e., directly connected, to second power supply node V−, thus node V3 is unaffected by the state of control signals CLOSE, OPEN or OFF, either singularly or in any logical combination.

TABLE V

| OPEN | CLOSE | OFF | V1 | V2 | V3 | V4 |
|---|---|---|---|---|---|---|
| 0 | 0 | 0 | undefined | undefined | V− | undefined |
| 0 | 0 | 1 | V− | V− | V− | V− |
| 0 | 1 | 0 | V+ | V− | V− | V− |
| 0 | 1 | 1 | undefined | undefined | V− | undefined |
| 1 | 0 | 0 | V− | V+ | V− | V− |
| 1 | 0 | 1 | undefined | undefined | V− | undefined |
| 1 | 1 | 0 | undefined | undefined | V− | undefined |
| 1 | 1 | 1 | undefined | undefined | V− | undefined |

As with the illustrative embodiment discussed in connection with FIG. 11C, the state of two or more of control signals CLOSE, OPEN, and OFF being asserted concurrently is a forbidden state, and is prohibited by the physical implementation of the system as described above in connection with FIG. 11B. Thus, in TABLE V above, those entries which show (for the sake of completeness) two or more of control signals CLOSE, OPEN, and OFF being asserted concurrently, the resulting condition of nodes V1, V2, and V4 are undefined. Similarly, the state of control signals CLOSE, OPEN, and OFF being concurrently deasserted is a forbidden state, and is prohibited by the physical implementation of the system as described above in connection with FIG. 11B.

Figure 11E:
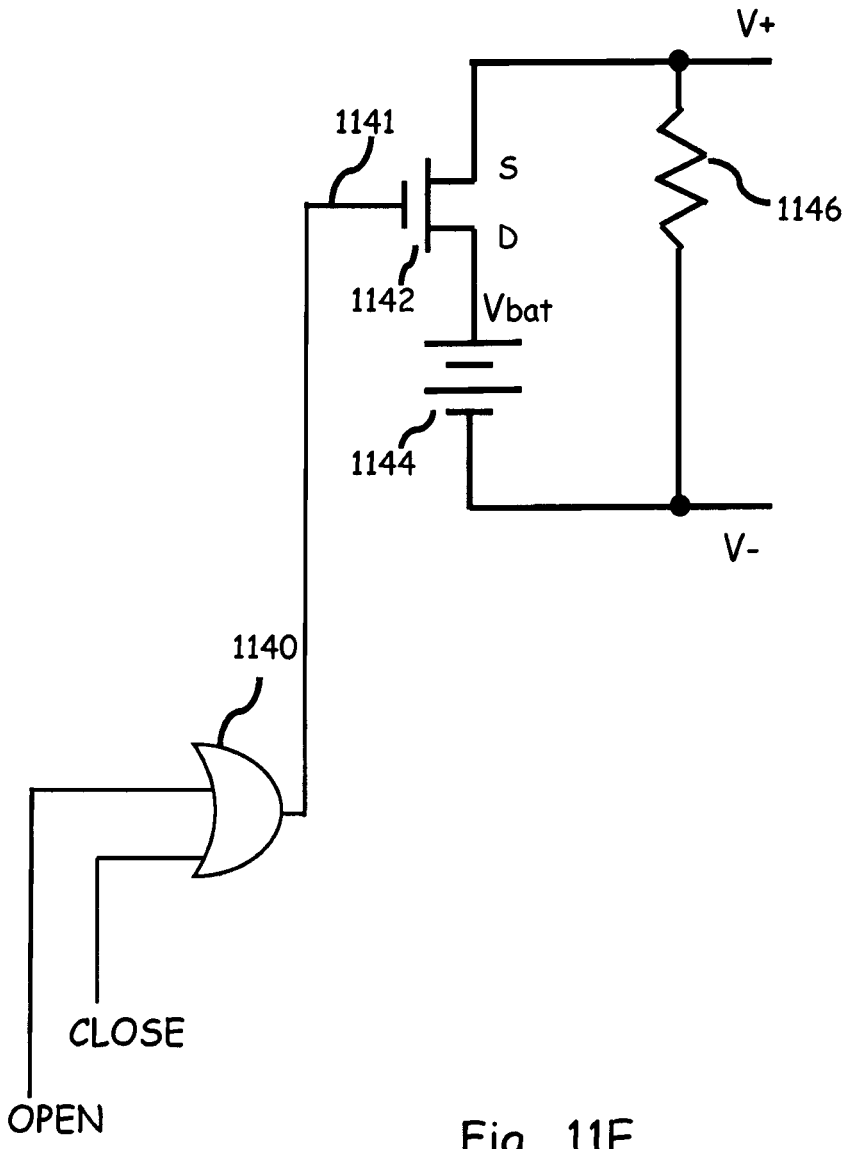
FIG. 11E is a schematic diagram of a battery in series with a transistor-based power supply switch, and control logic configured to control the on/off state of the transistor-based power supply switch.

FIG. 11E is a schematic diagram of a battery in series with a transistor-based power supply switch, and control logic configured to control the on/off state of the transistor-based power supply switch. In this illustrative embodiment, a 2-input logical OR gate 1140 is coupled to receive, as inputs, a signal "CLOSE," and a signal "OPEN." Logical OR gate 1140 has an output terminal coupled to a node 1141. An n-channel field effect transistor (NFET) 1142 is coupled drain-to-source between the positive terminal "Vbat" of a battery 1144, and a node "V+." Battery 1144 may be a rechargeable battery or a non-rechargeable battery. A gate terminal of NFET 1142 is coupled to node 1141 such that an output signal generated in operation by logical OR gate 1140 is communicated to the gate terminal of NFET 1142. A resistor 1146 is coupled between node V+ and a node V−.

Still referring to FIG. 11E, in this illustrative embodiment, resistor 1146 has a relatively high value so that the amount of current flowing therethrough is correspondingly relatively small. As will be discussed in greater detail below, the purpose of including resistor 1146 is to provide a discharge path for charge stored in the coils and interconnect wiring of the electromagnets after the connection between the battery and the electromagnets is terminated by NFET 1144 transitioning from an ON state to an OFF state. Choosing a specific value of resistance for resistor 1146 is a matter of design choice and does not require undue experimentation by those having ordinary skill in the art. As is well known in this field, factors to consider in selecting a resistance value for resistor 1146 include, but are not limited to, the voltage and storage capacity of battery 1144, the desired battery life (i.e., the amount of operating time available given the load on the battery), the cost of the components such as resistor 1146, and the lead times for obtaining such components. In some alternative embodiments a supercapacitor may be substituted for battery 1144.

The drawings shown in FIGS. 12A-12H, and FIGS. 13A-13C are for illustrative purposes and are not necessarily drawn to scale. These drawings are intended to illustrate and explain various features disclosed herein.

FIGS. 12A-12D show a beginning form, intermediate forms, and an ending form of a foam rubber workpiece in accordance with various steps in an illustrative manufacturing process. In general, a piece of foam rubber having the shape of a rectangular bar, is further shaped by removing several portions of an initial piece of foam rubber to provide a beveled (i.e., sloped) top surface, a first closure region having a cutout (Closure Region A cutout) from a front portion of the foam rubber workpiece, and a second closure region having a cutout (Closure Region B cutout) from a back portion of the foam rubber workpiece. In some illustrative embodiments the Closure Region A cutout is formed before the Closure Region B cutout. In other illustrative embodiments the Closure Region B cutout is formed before the Closure Region A cutout. In still other illustrative embodiments Closure Region A and Closure Region B may be formed concurrently. Methods for shaping foam rubber include, but are not limited to, cutting, sawing, and hot wire shaping. Such methods for shaping foam rubber are well known and are not described further herein. Other aspects of the illustrative manufacturing process are described elsewhere in this disclosure.

Figure 12A:
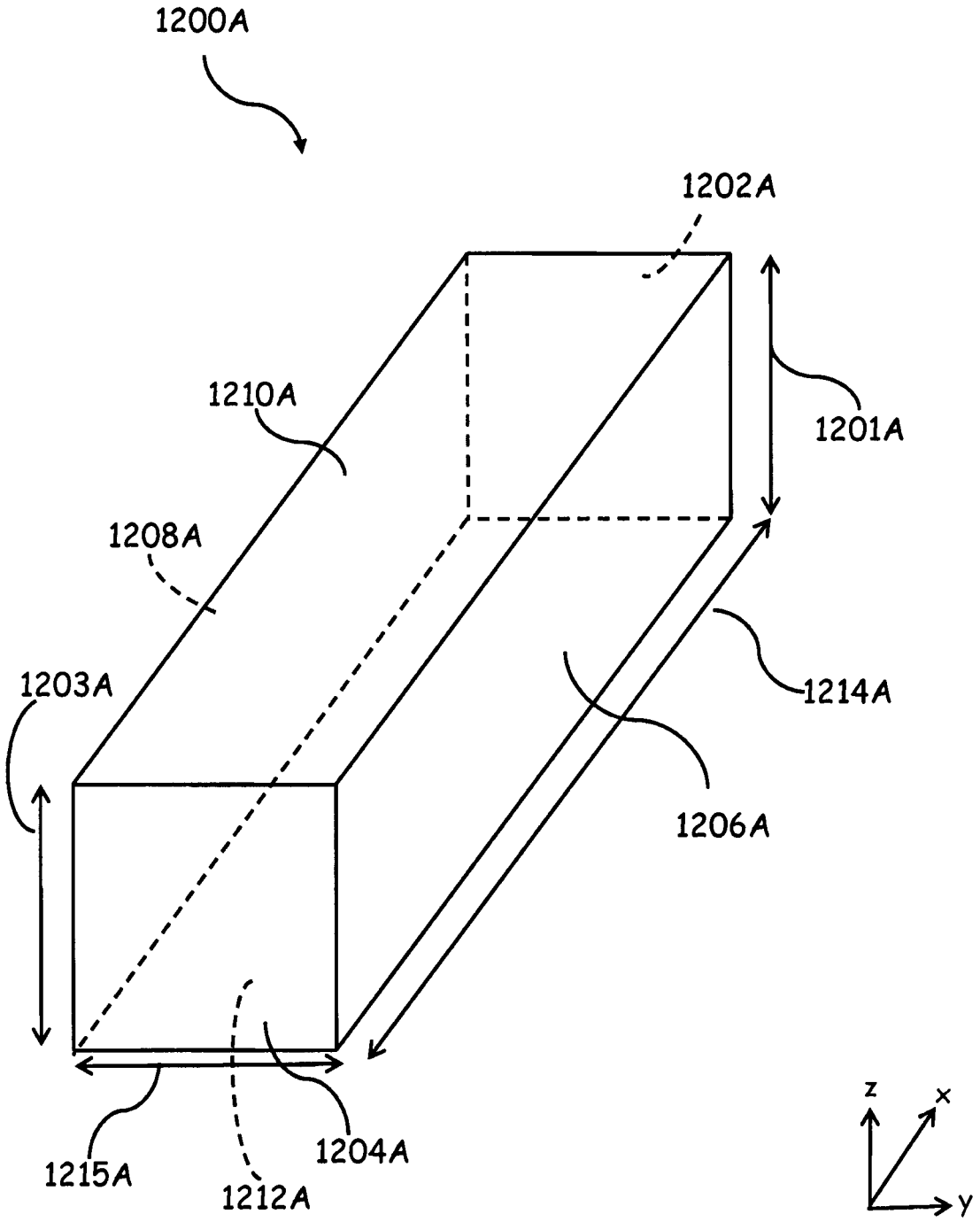
FIG. 12A is a wireframe perspective view of a piece of foam rubber shaped as a rectangular prism (also referred to as a rectangular bar).

FIG. 12A illustrates a foam rubber workpiece 1200A in the shape of a rectangular bar. As seen in FIG. 12A, workpiece 1200A has six sides, each side being referred to herein as a surface. Workpiece 1200A includes a first end surface 1202A, a second end surface 1204A, a first front surface 1206A, a first back surface 1208A, a first top surface 1210A, and a first bottom surface 1212A. First front surface 1206A has a height 1201A in the z-direction, and a length 1214A in the x-direction. First back surface 1208A has a height 1203A in the z-direction. In this illustrative embodiment height 1201A and height 1203A are nominally equal. First top surface 1210A and first bottom surface 1212A are parallel to each other, and each are perpendicular to first front surface 1206A and first back surface 1208A respectively. First front surface 1206A and first back surface 1208A are parallel to each other. First end surface 1202A is perpendicular to first front surface 1206A, first back surface 1208A, first top surface 1210A, and first bottom surface 1212A. Second end surface 1204A is perpendicular to first front surface 1206A, first back surface 1208A, first top surface 1210A, and first bottom surface 1212A. First end surface 1202A is parallel to second end surface 1204A.

Figure 12B:
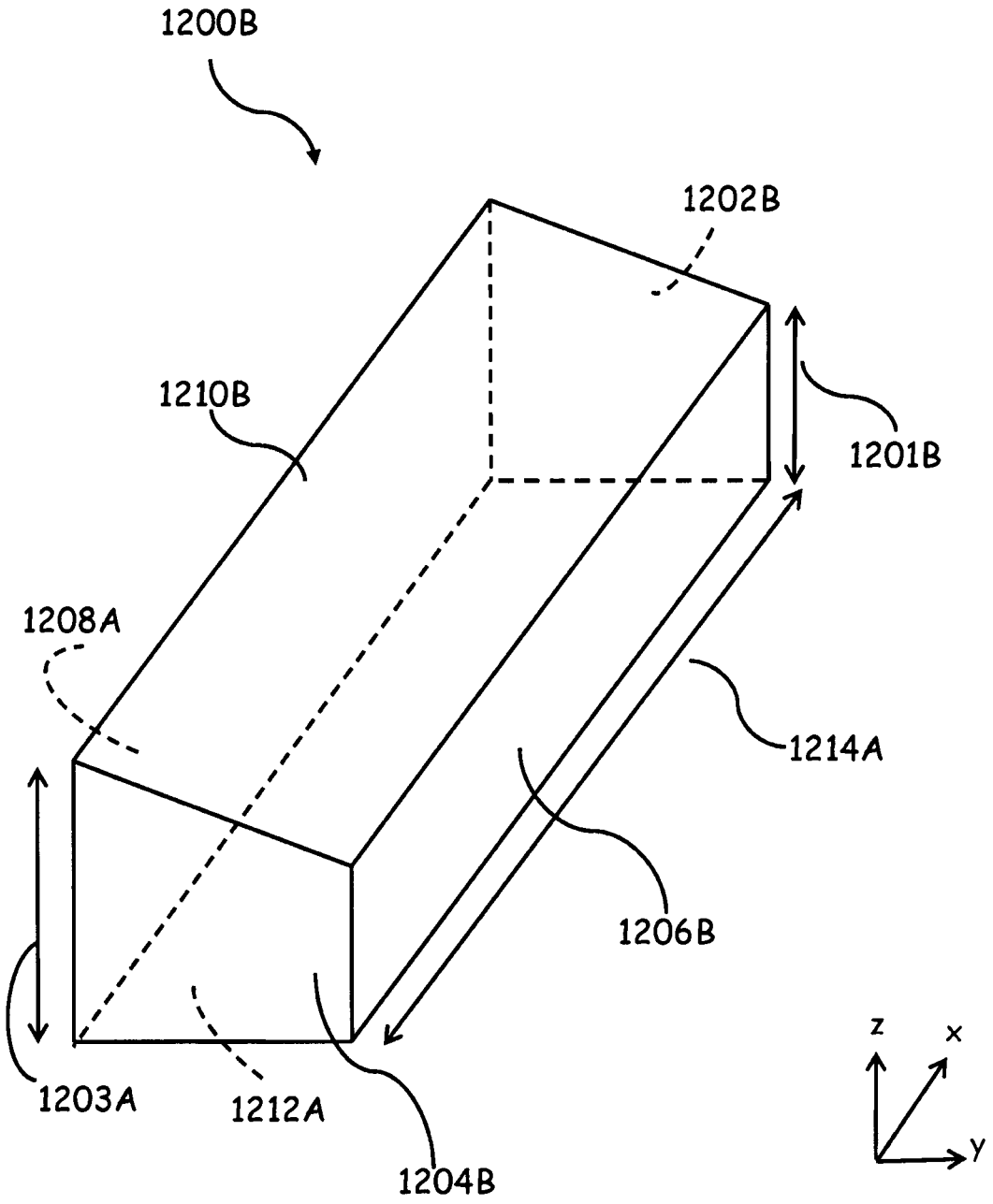
FIG. 12B is a wireframe perspective view of the piece of foam rubber of FIG. 12A after a portion of the foam rubber has been removed to form a beveled (i.e., sloped surface).

FIG. 12B illustrates a foam rubber workpiece 1200B. As seen in FIG. 12B, 1200B has six sides, each side being referred to herein as a surface. Workpiece 1200B is workpiece 1200A after a portion of first top surface 1210A (see FIG. 12F) has been removed so as to produce second top surface 1210B. The removal of the portion of first top surface 1210A may be achieved with any of the well-known methods for shaping foam rubber including, but not limited to, cutting or sawing. Unlike first top surface 1210A, second top surface 1210B is not parallel to first bottom surface 1212A. A consequence of removing the portion of first top surface 1210A, is that height 1201A is reduced to height 1201B, thus resulting in a second front surface 1206B, which has a height 1201B that is less than height 1201A. In other words, second top surface 1210B is downwardly sloped from first backside surface 1208A to second frontside surface 1206B. The difference in height between 1201A and 1201B is nominally equivalent to a height 1252F of the removed portion of first top surface 1210A (shown in FIG. 12F as 1200F).

Figure 12C:
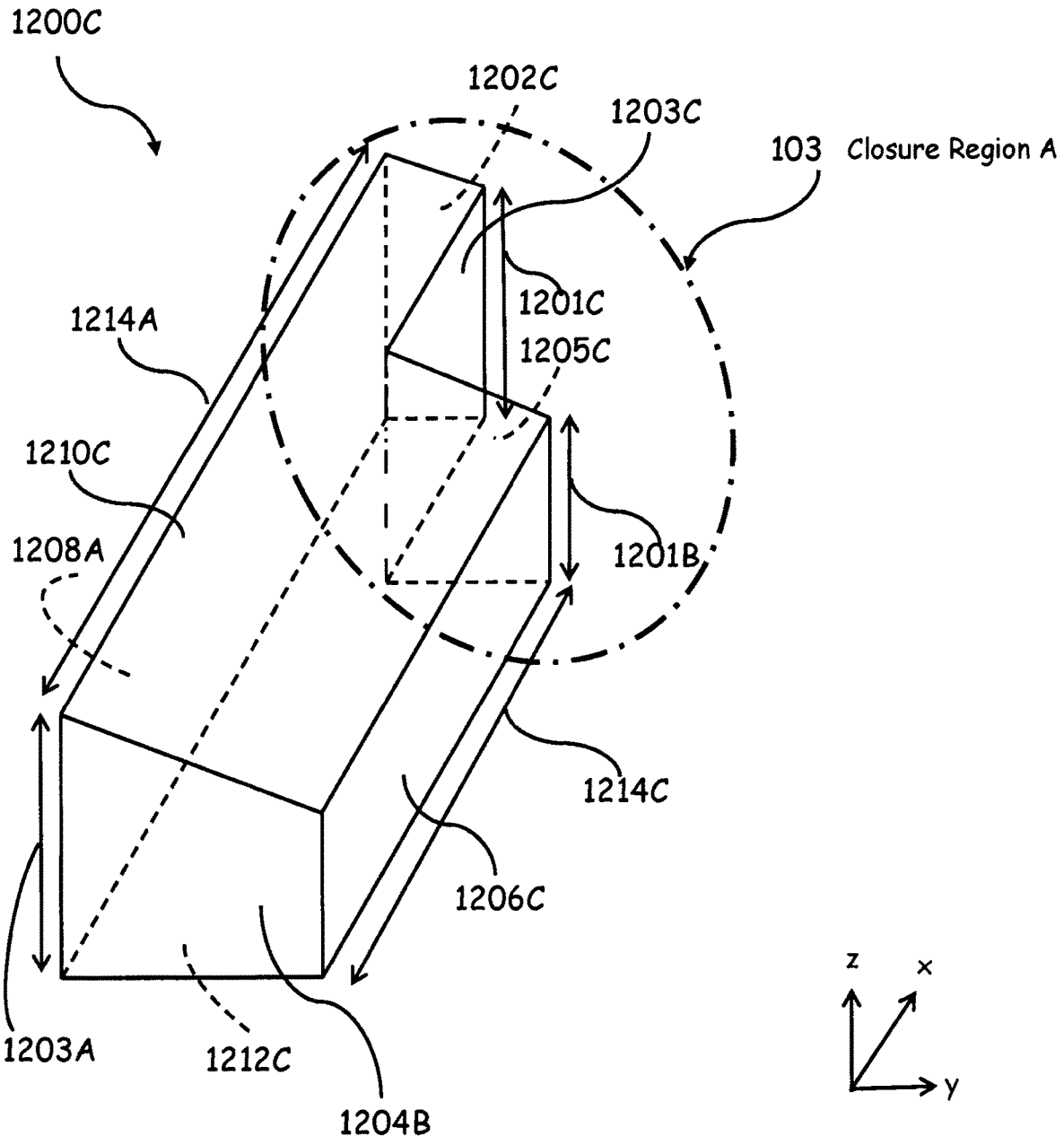
FIG. 12C is a wireframe perspective view of the piece of foam rubber of FIG. 12B after another portion of the foam rubber has been removed to form a Closure Region A cutout.

FIG. 12C illustrates a foam rubber workpiece 1200C. Workpiece 1200C is workpiece 1200B after a cutout is formed so as to produce Closure Region A 103. Workpiece 1200C is an intermediate structure produced in the course of various illustrative method embodiments in accordance with this disclosure. As seen in FIG. 12C, 1200C has eight sides, each side being referred to herein as a surface. More specifically, workpiece 1200C includes a first end surface 1202C, a second end surface 1212C, a third end surface 1205C, a fourth end surface 1203C, a top surface 1210C, a bottom surface 1212C, a front side 1206C, and a back side 1208A. Fourth end surface 1203C has a height 1201C in the z-direction. Height 1201C is less than height 1203A, and greater than height 1201B. In this illustrative embodiment, third end surface 1205C, and fourth end surface 1203C, meet at a right angle and are thus perpendicular to each other. However alternative embodiments may have third end surface 1205C, and fourth end surface 1203C, meet at correspondingly different angles.

Figure 12D:
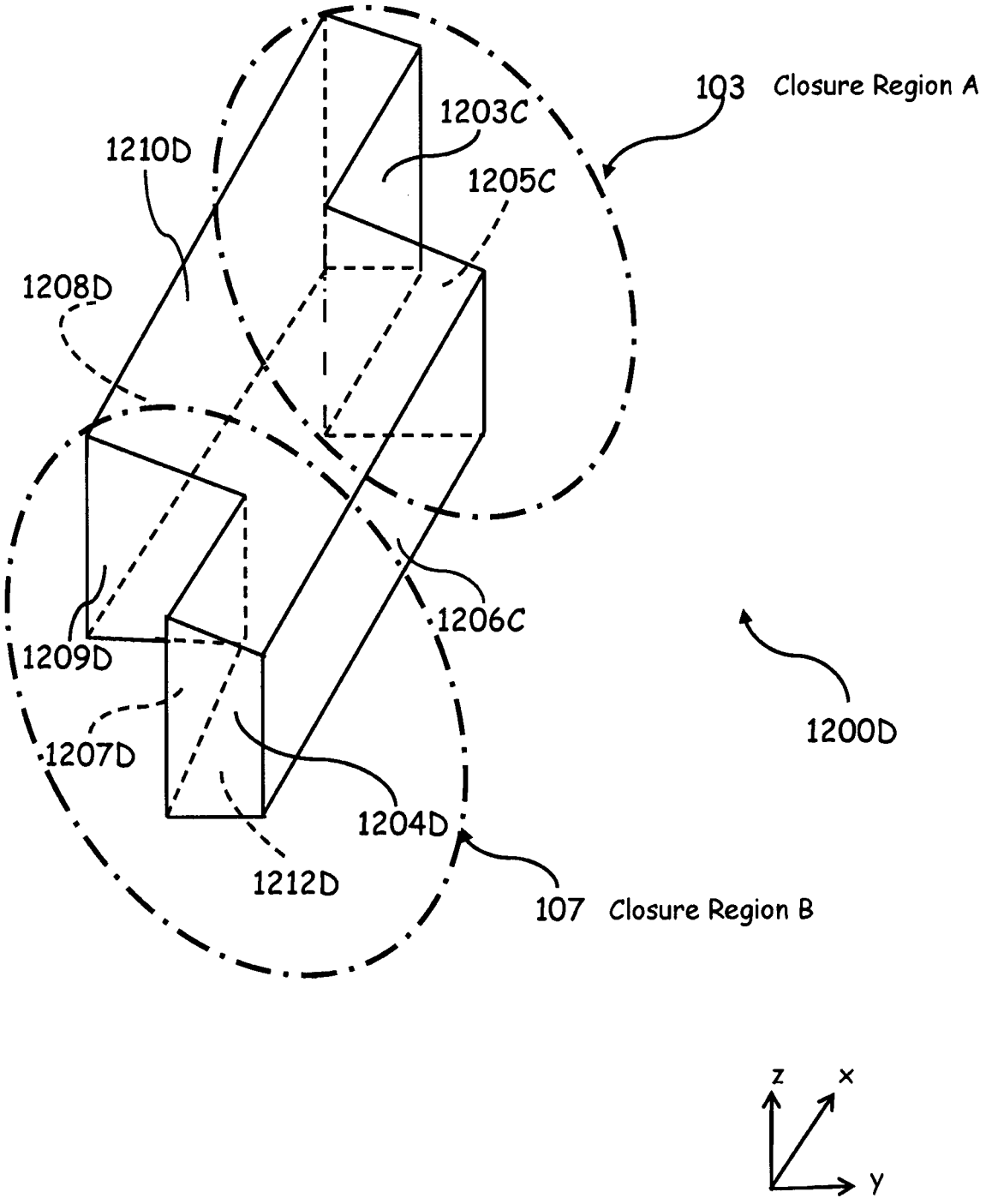
FIG. 12D is a wireframe perspective view of the piece of foam rubber of FIG. 12B after another foam rubber has been removed to form both a Closure Region A cutout, and a Closure Region B cutout.

FIG. 12D illustrates a foam rubber workpiece 1200D. In some illustrative embodiments, foam rubber workpiece 1200D is workpiece 1200C after a cutout is formed so as to produce Closure Region B 107. In some alternative illustrative embodiments, workpiece 1200D is workpiece 1200E after a cutout is formed so as to produce Closure Region A 103. Workpiece 1200D is an intermediate structure produced in the course of various illustrative method embodiments in accordance with this disclosure. As seen in FIG. 12D, workpiece 1200D has ten sides, each side being referred to herein as a surface. More specifically, workpiece 1200D includes Closure Region A 103 (as described above and shown in FIG. 12C) and Closure Region B 107 (as described below and shown in FIG. 12E).

Still referring to FIG. 12D, it is noted that Closure Region A 103 and Closure Region B 107 are disposed at opposite ends of workpiece 1200D. The illustrative drawing of workpiece 1200D is not necessarily to scale. In some embodiments, the distance between Closure Region A 103 and Closure Region B 107 may be greater than, or less than, the distance shown in FIG. 12D.

Figure 12E:
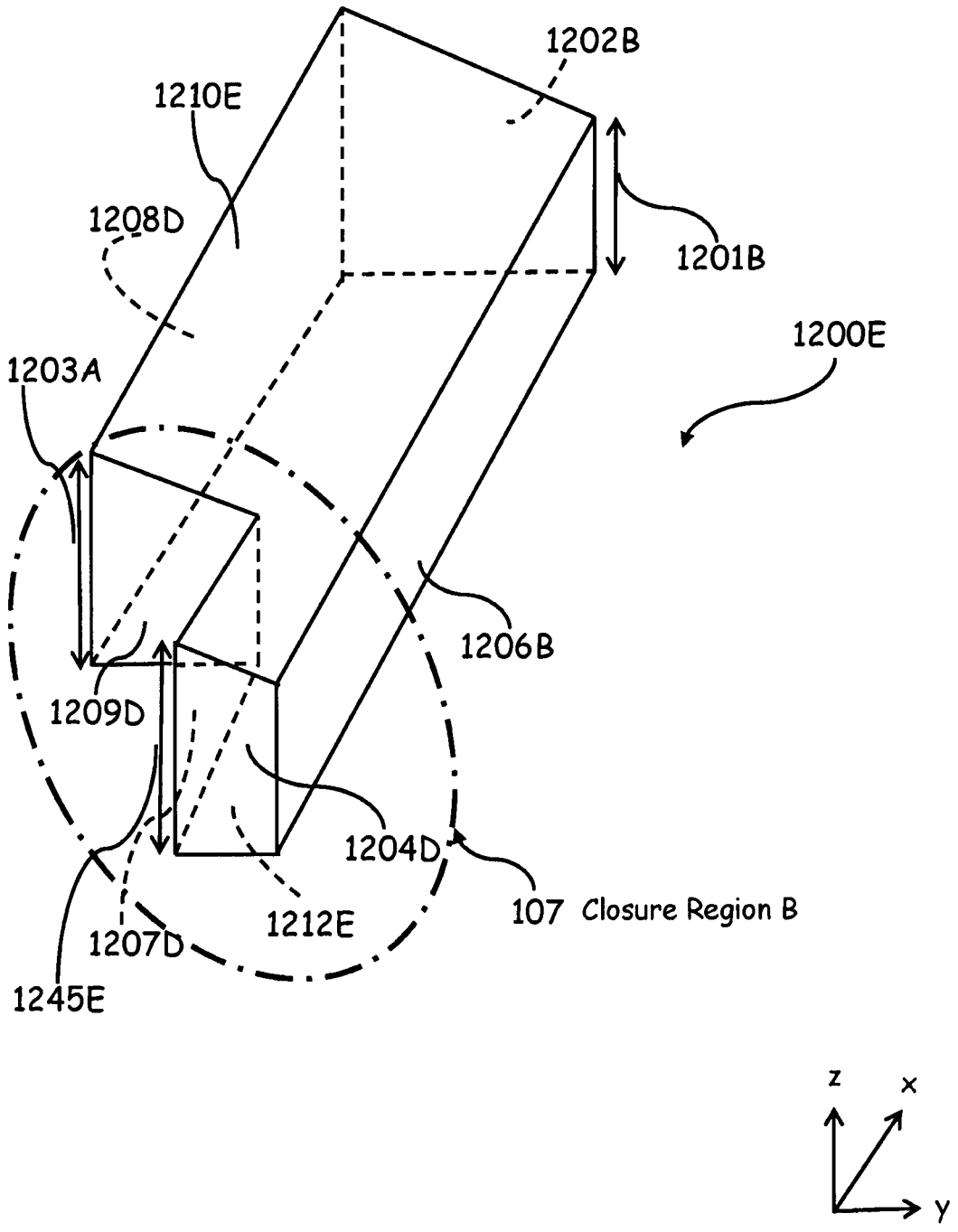
FIG. 12E is a wireframe perspective view of the piece of foam rubber of FIG. 12B after another portion of the foam rubber has been removed to form a Closure Region B cutout.

FIG. 12E illustrates an intermediate stage of an alternative manufacturing process in accordance with disclosure. As seen in FIG. 12E, workpiece 1200E has eight sides, each side being referred to herein as a surface. In this alternative manufacturing process, Closure Region B 107 is formed prior to Closure Region A 103. Specifically, workpiece 1200E is workpiece 1200B after a cutout is formed so as to produce Closure Region B 107. Workpiece 1200E includes a first end surface 1202B, a second end surface 1204D, a third end surface 1207D, a fourth end surface 1209D, a top surface 1210E, a bottom surface 1212E, a front side 1206B, and a back side 1208D. Third end surface 1207D has a height 1245E in the z-direction. Fourth end surface 1209D has a height 1203A in the z-direction. Height 1245E is less than height 1203A, and greater than height 1201B.

Figure 12F:
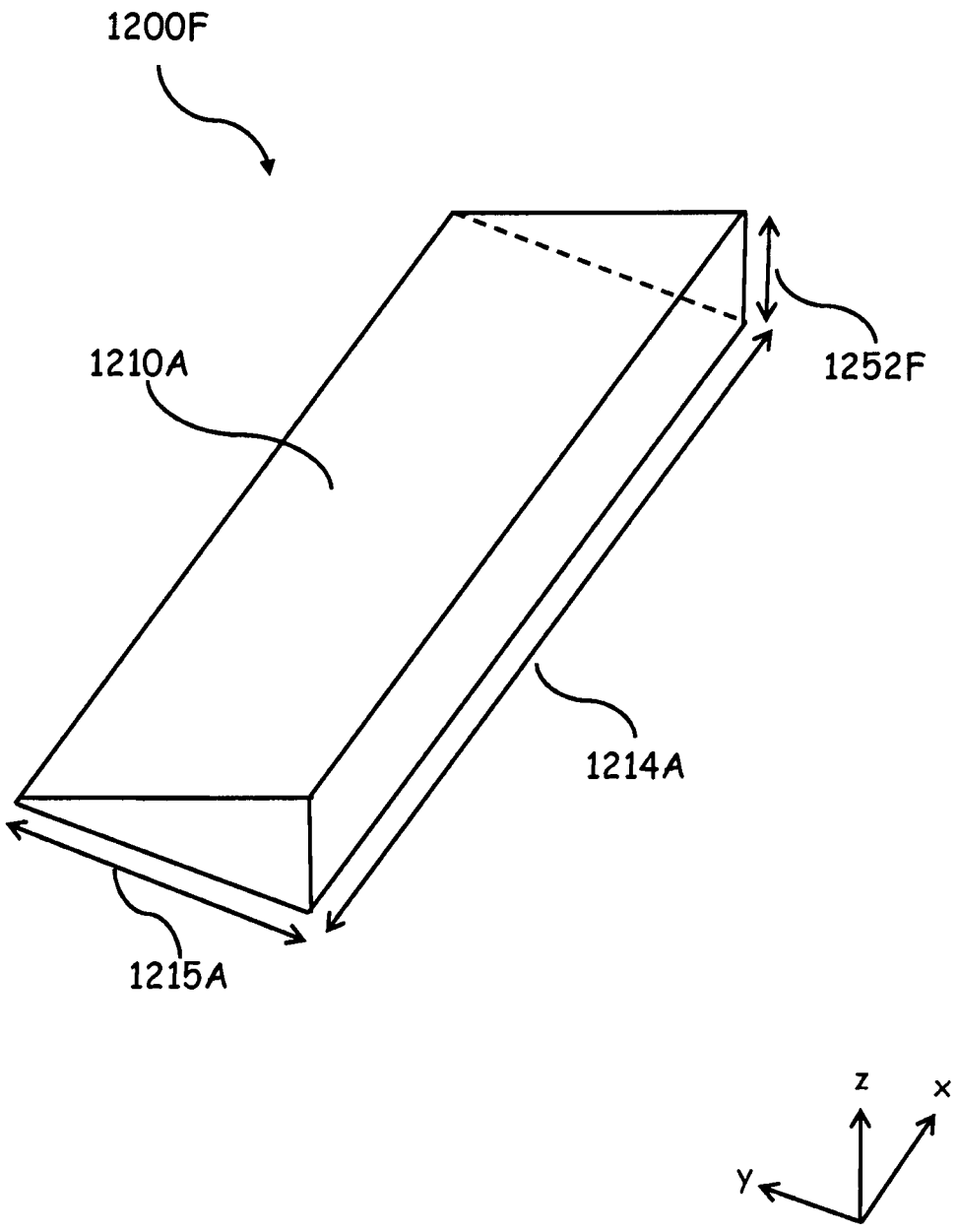
FIG. 12F illustrates a portion of foam rubber removed from the structure of FIG. 12A to form a beveled top surface.
Figure 12G:
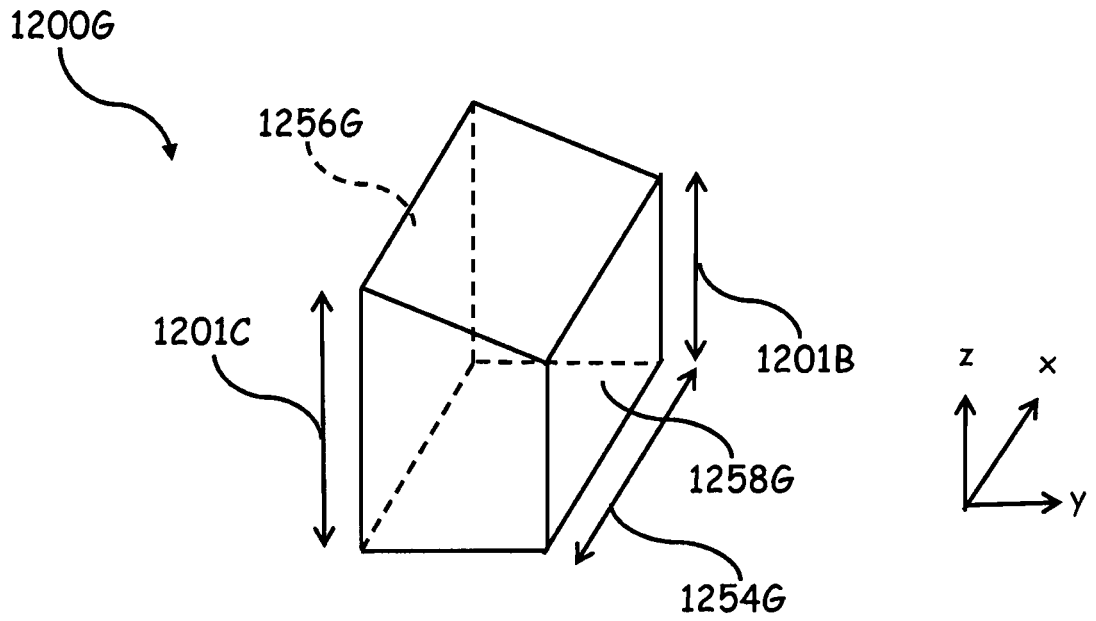
FIG. 12G illustrates a portion of foam rubber removed from the structure FIG. 12B to form a Closure Region A cutout.
Figure 12H:
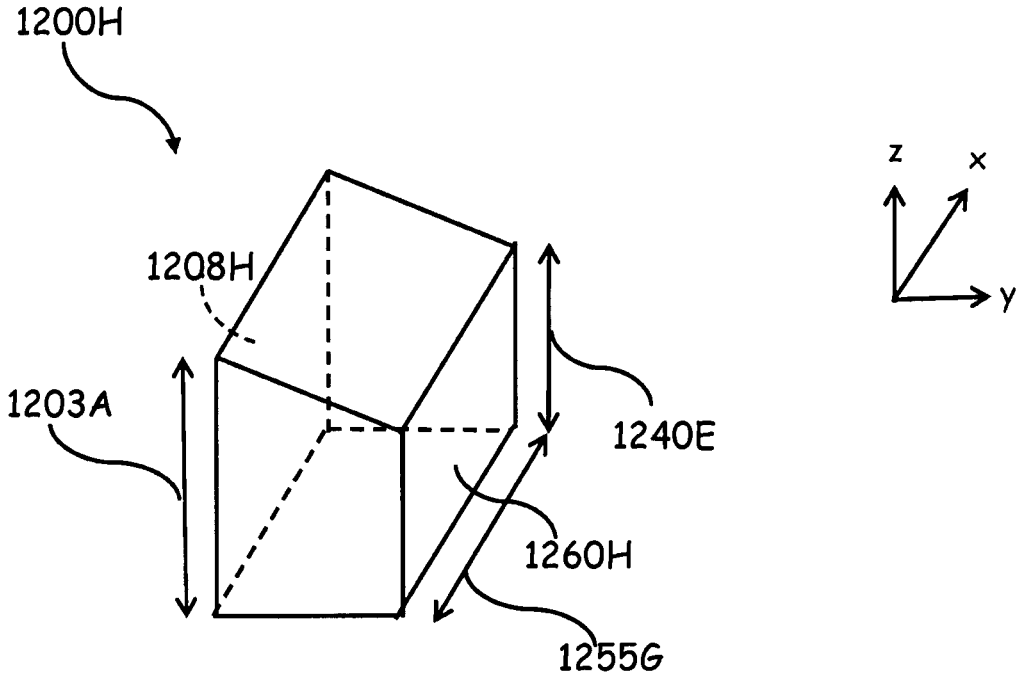
FIG. 12H illustrates a portion of foam rubber removed from the structure FIG. 12B to form a Closure Region B cutout.

The foam rubber pieces shown in FIGS. 12F, 12G, and 12H do not form any part of the completed foam rubber belt described in this disclosure. Rather, these foam rubber pieces are shown and described in order to facilitate the reader's understanding of the illustrative shape and dimensions of the Closure Region A cutout and the Closure Region B cutout.

FIG. 12F illustrates a foam rubber piece 1200F removed from workpiece 1200A to produce workpiece 1200B. Viewing FIGS. 12A and 12B, together with FIG. 12F, it can be seen that foam rubber piece 1200F is that portion of workpiece 1200A that is removed to produce workpiece 1200B. Foam rubber piece 1200F may be removed by any suitable method including, but not limited to, cutting or sawing. The removal of foam rubber piece 1200F results in foam rubber workpiece 1200B having a top surface 1210B that slopes downwardly from back surface 1208A to front surface 1206B. Although foam rubber piece 1200F is shown as a single unitary piece, alternative embodiments may be implemented by removing two or more pieces of foam rubber from workpiece 1200B to achieve the same sloped top surface 1210B (shown in FIG. 12B). Foam rubber piece 1200F (which is shown here after its removal from foam rubber workpiece 1200A) has a length 1214A in the x-direction, a width 1215A in the y-direction, and a height 1252F in the z-direction.

FIG. 12G illustrates a piece of foam rubber 1200G removed from workpiece 1200B to produce workpiece 1200C. Foam rubber piece 1200G does not form part of the structure of the foam belt described in this disclosure. Rather, this description of foam rubber piece 1200G is intended to assist the reader in understanding the shape of the Closure Region A cutout. Viewing FIGS. 12B and 12C, together with FIG. 12G, it can be seen that foam rubber piece 1200G is that portion of workpiece 1200B that has been removed to produce workpiece 1200C having a cutout in Closure Region A 103 (for convenience this cutout is referred to herein as the Closure Region A cutout). For the sake of clarity, it is noted that the "cutout" is that region from which foam rubber has been removed to produce Closure Region A. Foam rubber piece 1200G may be removed by any suitable method including, but not limited to, cutting or sawing. Foam rubber piece 1200G is shown as a unitary piece of foam rubber, which indicates that the Closure Region A cutout is formed by the removal of a single, unitary piece of foam rubber. However, it is noted that alternative embodiments may produce the Closure Region A cutout by removing two or more pieces of foam rubber, which in sum result in the Closure Region A cutout. That is, the Closure Region A cutout may be implemented via the removal of one or more pieces of foam rubber. Foam rubber piece 1200G has a back side 1256G that has a height 1201C in the z-direction, and a length 1254G in the x-direction. Further foam rubber piece 1200G has a front side 1258G that has a height 1201B in the z-direction, and a length 1254G in the x-direction. Height 1201C of backside 1256G is greater than height 1201B of frontside 1258G. Alternative embodiments may be produced from materials other than foam rubber.

FIG. 12H illustrates foam rubber piece 1200H removed from workpiece 1200C to produce workpiece 1200D. Viewing FIGS. 12C and 12D, together with FIG. 12H, it can be seen that foam rubber piece 1200H is that portion of workpiece 1200C that has been removed to produce workpiece 1200D, which has a cutout in Closure Region B 107. Foam rubber piece 1200H, like foam rubber piece 1200G, may be removed by any suitable method including, but not limited to, cutting or sawing. Foam rubber piece 1200H is shown as a unitary piece of foam rubber, which indicates that the Closure Region B cutout is formed by the removal of a single, unitary piece of foam rubber. However, it is noted that alternative embodiments may produce the Closure Region B cutout by removing two or more pieces of foam rubber, which in sum result in the Closure Region B cutout. That is, the Closure Region B cutout may be implemented via the removal of one or more pieces of foam rubber. Foam rubber 1200H has a back side 1208H that has a height 1203A in the z-direction, and a length 1255G in the x-direction. Further rubber 1200H has a front side 1260H that has a height 1201B in the z-direction, and a length 1255H in the x-direction. Height 1203A of backside 1208H is greater than height 1240E of frontside 1260H. It will be appreciated that alternative embodiments may be produced from materials other than foam rubber.

Referring to FIGS. 12D, 12G, and 12H, it is noted that in various embodiments, the size of the cutout in Closure Region A 103 corresponds to the size of foam rubber 1200G. Likewise, the size of the cutout in Closure Region B 107 corresponds to the size of foam rubber 1200H. This is so because in this illustrative embodiment foam rubber pieces 1200G and 1200H are respectively removed as singular pieces in the formation of the cutouts. In some alternative embodiments, the cutouts of Closure Region A 103 and Closure Region B 107, may be produced by removing two or more pieces of foam rubber respectively, rather than as the singular foam rubber pieces 1200G and 1200H.

Figure 13A:
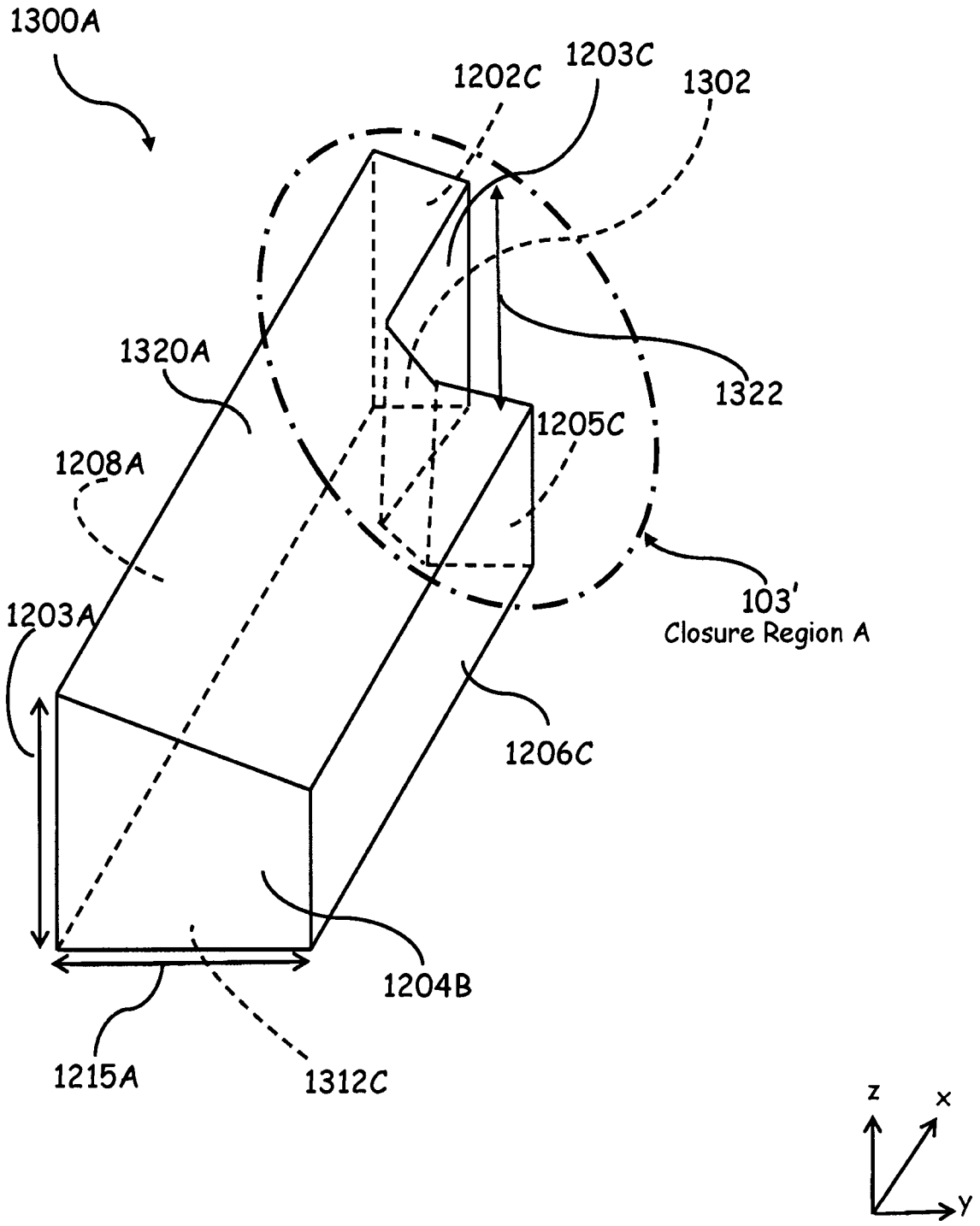
FIG. 13A is similar to FIG. 12C, but illustrates an embodiment that includes an alternatively-shaped Closure Region A.

An alternative to Closure Region A 103 (see FIG. 12C) is Closure Region A 103' shown in FIG. 13A. Workpieces 1200C and 1300A are similar to each other but have a difference within their respective Closure Region A cutouts. In Closure Region A 103 of FIG. 12C, surface 1203C and surface 1205C meet at a right angle. (Although, it is noted above in the description of FIG. 12C, that surfaces 1203C and 1205C may alternatively meet at other angles.) However, in Closure Region A 103', surfaces 1203C and 1205C do not meet. Rather, an additional surface (1302) is disposed between surfaces 1203C and 1205C as shown in FIG. 13A. This results in the alternative illustrative shape of the Closure Region A 103' cutout. Although surface 1302 is shown in FIG. 13A as being planar, some alternative embodiments may use a curved surface rather than a planar surface between surfaces 1203C and 1205C.

Still referring to illustrative FIG. 13A, a foam rubber workpiece 1300A having Closure Region A 103' is shown. Workpiece 1300A is workpiece 1200B after a cutout is formed so as to produce Closure Region A 103'. Workpiece 1300A is an intermediate structure produced in the course of various illustrative method embodiments in accordance with this disclosure. As seen in FIG. 13A, workpiece 1300A has nine sides, each side being referred to herein as a surface. More specifically, workpiece 1300A includes a first end surface 1202C, a second end surface 1204B opposing first end surface 1202C, a third end surface 1203C, a fourth end surface 1205C, and a fifth end surface 1302. Further, workpiece 1300A includes a top surface 1320A, a front surface 1206C, a back surface 1208A, and a bottom surface 1312C. Backside 1208A has a height 1203A in the z-direction. Third end surface 1203C has a height 1322 in the z-direction. Height 1322 is less than height 1203A.

Figure 13B:
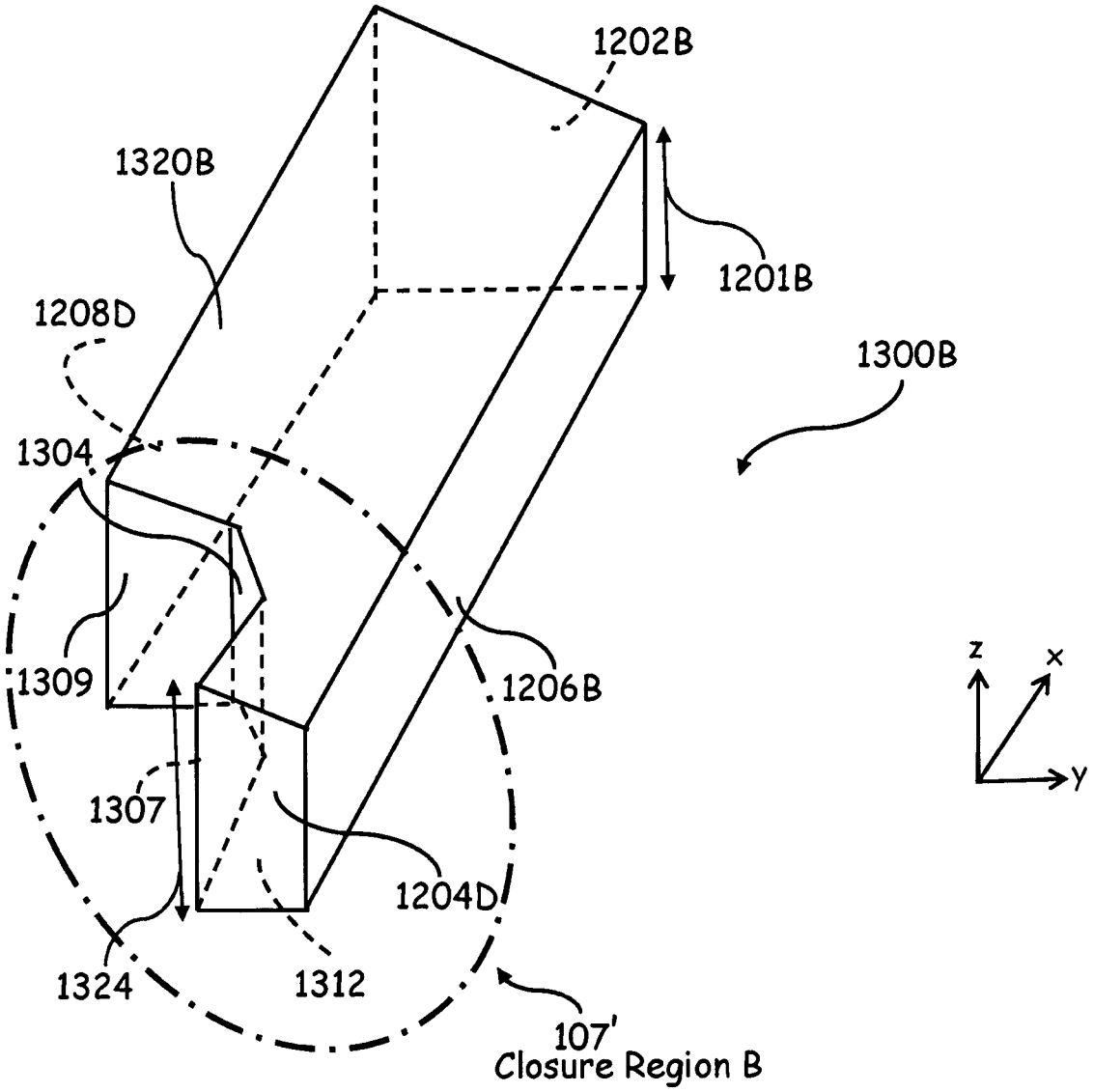
FIG. 13B is similar to FIG. 12E, but illustrates an embodiment that includes an alternatively-shaped Closure Region B.

An alternative to Closure Region B 107 (see FIG. 12E) is Closure Region B 107' shown in FIG. 13B. Workpieces 1200E and 1300B are similar to each other but have a difference within their respective Closure Region B cutouts. In Closure Region B 107 of FIG. 12E, surface 1207D and surface 1209D meet at a right angle. However, in Closure Region B 107', surfaces 1307 and 1309 do not meet. Rather, an additional surface 1304 is disposed between surfaces 1307 and 1309 as shown in FIG. 13B. This results in the alternative illustrative shape of the Closure Region B 107' cutout. Surface 1307 has a height 1324 in the z-direction. Surface 1206B has a height 1201B in the z-direction. Height 1201B is less than Closure Region A cutout and Closure Region B cutout of workpiece height 1324.

Still referring to FIG. 13B, workpiece 1300B a top surface 1320B and a bottom surface 1312.

Figure 13C:
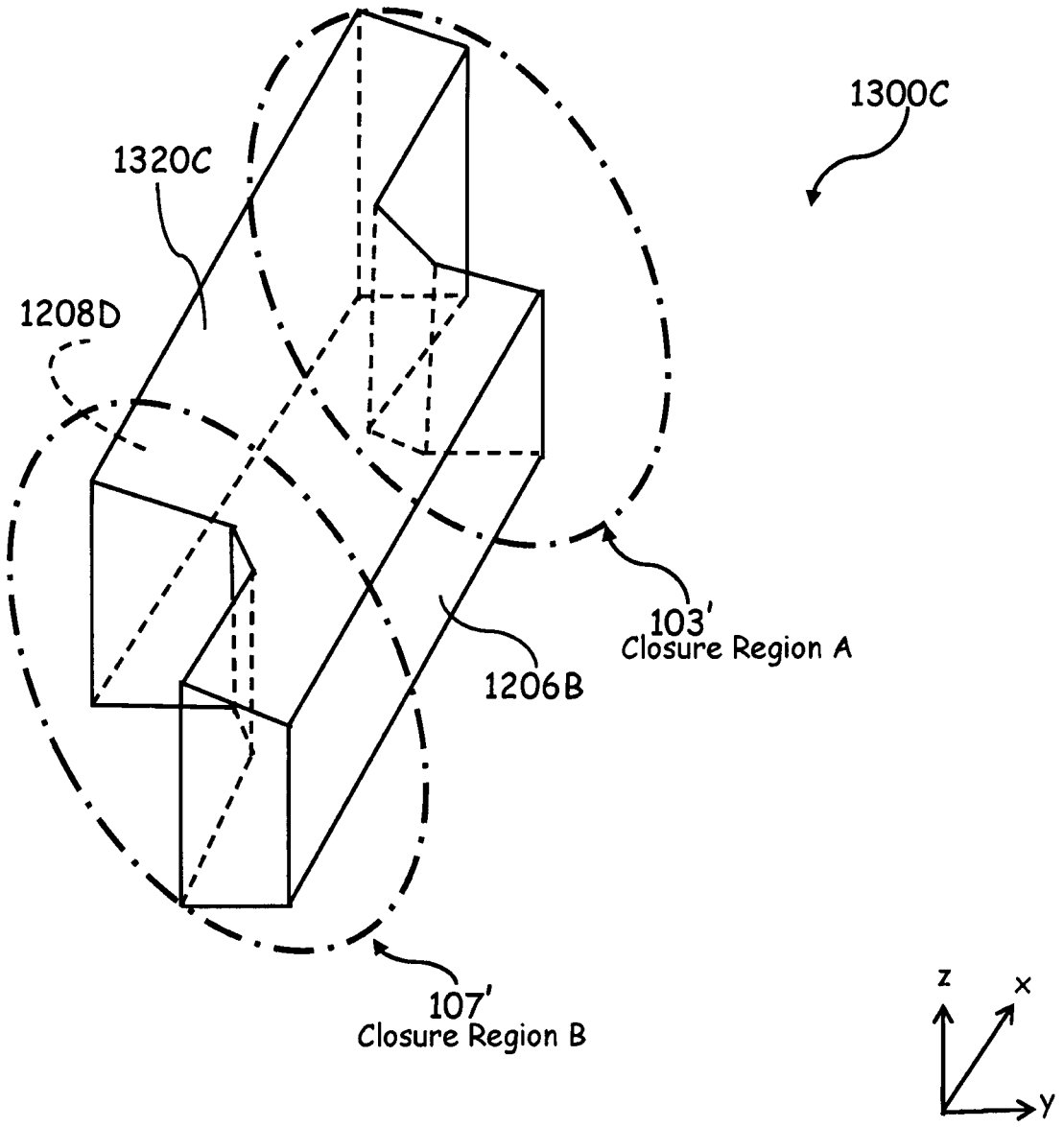
FIG. 13C is similar to FIG. 12D, but illustrates an embodiment that includes both an alternatively-shaped Closure Region A and an alternatively-shaped Closure Region B.

Referring to FIG. 13C, workpiece 1300C is similar to workpiece 1200D (see FIG. 12D), however the Closure Region A cutout and Closure Region B cutout of workpiece 1300C are different from the Closure Region A cutout and Closure Region B cutout of workpiece 1200D as explained above. This results in workpiece 1300C having twelve surfaces as opposed to the ten surfaces of workpiece 1200D.

FIG. 14 is a flow diagram of an illustrative method embodiment 1400 in accordance with this disclosure for manufacturing a foam belt. Method 1400 includes providing 1402 a rectangular-bar-shaped foam rubber workpiece (see 1200A of FIG. 12A). The shape of workpiece 1200A is then modified through a series of operations to become a foam belt such as those foam belts described above in this disclosure. Illustrative method embodiment 1400 continues by removing 1404 a portion of the rectangular-bar-shaped foam rubber workpiece (see 1200F of FIG. 12F) to form a first intermediate workpiece (see 1200B of FIG. 12B) having a sloped top surface (see 1210B of FIG. 12B). Illustrative method embodiment 1400 continues by removing 1406 a first piece of the first intermediate workpiece (see 1200B, and 1200G of FIG. 12G) to form a second intermediate workpiece (see 1200C of FIG. 12C) having a sloped top surface, and a Closure Region A cutout. The expression "Closure Region A cutout" refers to a cutout formed by the removal of 1200G. Illustrative method embodiment 1400 continues by removing 1408 a first piece of the second intermediate workpiece (see 1200H of FIG. 12H) to form a third intermediate workpiece (see 1200D of FIG. 12D) having a sloped top surface 1210D, a Closure Region A cutout, and a Closure Region B cutout. The expression "Closure Region B cutout" refers to a cutout formed by the removal of 1200H. Illustrative method embodiment 1400 continues by attaching 1410 a first portion of an attachment mechanism in Closure Region A; and attaching 1412 a second portion of the attachment mechanism in Closure Region B. Attachment of the first portion of the attachment mechanism and the second portion of the attachment mechanism may be performed in any order. Any suitable attachment mechanism may be used; and some example attachment mechanisms are shown in, but not limited to, FIGS. 3A-6C, and 8A-8J.

Figure 15:
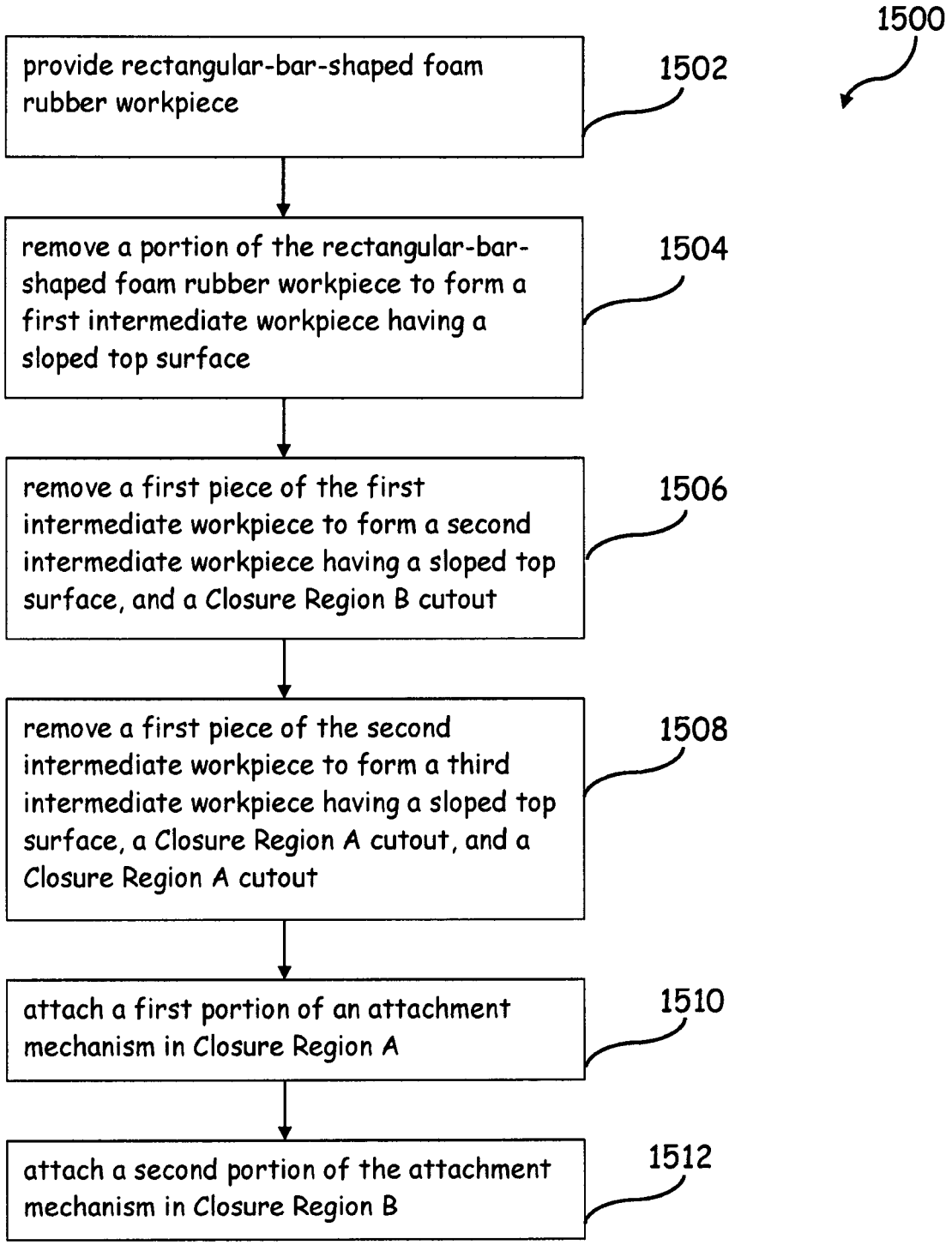
FIG. 15 is a flow diagram of another illustrative method in accordance with this disclosure.

FIG. 15 is a flow diagram of an alternative illustrative method embodiment 1500 in accordance with this disclosure for manufacturing a foam belt. Method 1500 includes providing 1502 a rectangular-bar-shaped foam rubber workpiece. The shape of workpiece 1200A is then modified through a series of operations to become a foam belt such as those described above in this disclosure. Alternative illustrative method embodiment 1500 continues by removing 1504 a portion of the rectangular-bar-shaped foam rubber workpiece (see 1200F of FIG. 12F) to form a first intermediate workpiece (see 1200B of FIG. 12B) having a sloped top surface (see 1210B of FIG. 12B). Alternative illustrative method embodiment 1500 continues by removing 1506 a first piece of the first intermediate workpiece (see 1200B, and 1200G of FIG. 12G) to form a second intermediate workpiece (see 1200E of FIG. 12E) having a sloped top surface, and a Closure Region B cutout. The expression "Closure Region B cutout" refers to a cutout formed by the removal of 1200H. Alternative illustrative method embodiment 1500 continues by removing 1508 a first piece of the second intermediate workpiece (see 1200G of FIG. 12G) to form a third intermediate workpiece (see 1200D of FIG. 12D) having a sloped top surface 1210D, a Closure Region B cutout, and a Closure Region A cutout. The expression "Closure Region A cutout" refers to a cutout formed by the removal of 1200G. Alternative illustrative method embodiment 1500 continues by attaching 1510 a first portion of an attachment mechanism in Closure Region A; and attaching 1512 a second portion of the attachment mechanism in Closure Region B. Attachment of the first portion of the attachment mechanism and the second portion of the attachment mechanism may be performed in any order. As with the description of the FIG. 14 embodiment, any suitable attachment mechanism may be used with the FIG. 15 embodiment; and some of such example attachment mechanisms are shown in, but not limited to, FIGS. 3A-6C, and 8A-8J.

Materials

Foam rubber, in general, refers to a rubber material that has an air-filled matrix structure. Various embodiments may be formed from polyurethane foam rubber. Other illustrative embodiments may be formed from latex rubber.

Hook and loop fasteners are very well known and this technology is not described further herein other than that such fasteners are often referred to by the trademark of a supplier of hook and loop fasteners, namely: Velcro®.

Adhesive may be used to attach the first attachment means and the second attachment means respectively to the first and second closure regions. In some embodiments, the first attachment means is one of the loop portion or the hook portion of a hook and loop fastener, and the second attachment means is the other of the loop portion or the hook portion of a hook and loop fastener. In these illustrative arrangements, both the loop portion and the hook portion are attached to a polyurethane foam rubber by an adhesive.

Terminology

The term "nominal," as used herein, refers to a desired, or target, value of a characteristic or parameter for a material, component, or part, set during the design phase of a product, together with a range of values above and/or below the desired, or target, value. The range of values is typically due to slight variations in manufacturing processes or tolerances.

The expression "fit profile," as used herein, refers to the extent to which an item of clothing, for example but not limited to a pair of pants, conforms to a wearer. By way of example but not limitation, a pair of pants may conform to a person wearing a foam belt in accordance with this disclosure differently than to the same person not wearing the foam belt.

The term "density," as used herein, refers to weight per unit volume. The density of a foam belt may affect its durability, odor potential, and cost. Density is a factor that may be used in characterizing or specifying a foam, such as a polyurethane foam or a latex foam.

The term "firmness," as used herein, refers to a factor that may be used in characterizing or specifying a foam, such as a polyurethane foam or a latex foam. Because such foams have been commonly used in the construction of mattresses, a measurement of firmness referred to as indentation load deflection ("ILD") has been developed. ILD may be determined by placing a circular disk measuring one foot in diameter on a section of foam that measures about four inches thick. The ILD is the amount of weight needed to compress that section of foam by 25%. ILD is expressed in numerals corresponding to the weight. The foams used in mattress comfort layers usually fall between 10 and 20, while transitional layer and support core foams usually have much higher ILD measurements.

In various embodiments using polyurethane foam, the foam is white. Polyurethane foam may also be made or purchased in a wide variety of colors. By way of example and not limitation, polyurethane foam may be made or purchased in colors including blues, reds, greens, gray, and black. In some embodiments, the polyurethane foam may be a color other than white.

The term "FET," as used herein, refers to metal-oxide-semiconductor field effect transistors (MOSFETs). These transistors are also known as insulated gate field effect transistors (IGFETs). An n-channel FET is referred to as an NFET. A p-channel FET is referred to as a PFET. A FET has a first source/drain terminal, a second source/drain terminal, and a gate terminal. A voltage applied to the gate terminal controls whether the FET is "on" or "off." When the voltage applied to the gate terminal puts the FET into the "on" state, conduction between the first source/drain terminal and the second source/drain terminal may take place.

Source/drain (S/D) terminals refer to the terminals of a FET, between which conduction occurs under the influence of an electric field resulting from a voltage applied to the gate terminal. Generally, the source and drain terminals of FETs used for logic applications are fabricated such that they are geometrically symmetrical. However, it is common that the source and drain terminals of power FETs are fabricated with asymmetrical geometries. With geometrically symmetrical source terminals and drain terminals, it is common to simply refer to these terminals as source/drain terminals, and this nomenclature is used herein. Designers often designate a particular source/drain terminal to be a "source" or a "drain" on the basis of the voltage to be applied to that terminal when the FET is operated in a circuit.

FETs such as those described above, are broadly considered herein to be switchable conductive pathways because a conductive pathway through the FET can be switched on and off by applying voltage to the gate terminal. In various alternative embodiments one or more bipolar junction transistors (BJTs), together with any appropriate biasing network, may be substituted for one or more FETs. It is well known in the art that FETs are voltage-controlled transistors, while BJTs are current-controlled transistors, nonetheless, those skilled in the art and having the benefit of this disclosure would be able to make such substitutions without undue experimentation.

It is expressly contemplated by the inventor that various combinations of the features disclosed in the illustrative embodiments discussed above may be combined in any suitable manner to form alternative embodiments.

Some Illustrative Embodiments

Various embodiments in accordance with this disclosure provide an apparatus, typically but not exclusively, in the form of a foam belt that can be worn around a user's waist such that pants do no slide down when the user stands, and further such that the tails of the user's tucked-in shirt do not ride up and over the waist portion of those pants so as to appear substantially untucked. In some alternative embodiments, at least portions of the foam belt are covered by fabric.

In some illustrative embodiments an apparatus includes a foam belt, the foam belt having a first base portion with a rectangular cross-section, a first bevel portion with a first triangular cross-section superjacent the first base portion, a first closure region at a first end portion of the foam belt, the first closure region having second bevel portion with a second triangular cross-section, a second closure region at a second end portion of the foam belt, the second end portion being at an opposite end of the foam belt relative to the first end portion of the foam belt, the second closure region having a third bevel portion with a third triangular cross-section; and an attachment mechanism having a first portion attached to the first closure region, and a second portion attached to the second closure region; wherein the first portion of the attachment mechanism and the second portion of the attachment mechanism are configured to detachably engage with each other; wherein a first force required to detach the first and second portions of the attachment mechanism from engagement with each other is less than a second force required to remove the first portion of the attachment mechanism from the first closure region, wherein the base portion of the foam belt has a thickness T_base, and a height H_base; wherein the bevel portion of the foam belt has a height H_bevel, and a bevel slope $\angle\alpha$; wherein the first closure region of the foam belt has a thickness T_base_D, a base height H_closure_RegionA_base, a bevel height H_closure_RegionA_bevel, and a bevel slope $\angle\alpha_D$; wherein the second closure region has a thickness T_base_E, a base height H_closure_RegionB_base, a bevel height H_closure_RegionB_bevel, and a bevel slope $\angle\alpha_E$; wherein:

$$T_base_D < T_base,$$

$$T_base_E < T_base,$$

$$H_base + H_bevel = H_total,$$

$$H_closure_Region_A_base + H_closure_Region_A_bevel = H_total;$$

$$H_closure_Region_B_base + H_closure_Region_B_bevel < H_total;$$

$$H_closure_Region_B_base < H_closure_Region_A_base;$$

$$H_closure_Region_A_base > H_base;$$

$$H_closure_Region_B_base = H_base; \text{ and}$$

$$\angle\alpha D = \angle\alpha E = \angle\alpha.$$

And, in some of these illustrative embodiments T_base_D+T_base_E≥T_base, or alternatively T_base_D+T_base_E<T_base.

The table below highlights support for the above-mentioned relationships.

| Relationships | Support/Explanation |
|---|---|
| T_base_D < T_base | Thickness, T_base_ D, of Closure Region A (FIG. 2D, element 102D) is less than thickness, T_base, of the foam belt (FIG. 2A, element 102). |
| T_base_D < T_base | Thickness, T_base_E, of Closure Region B is less than thickness of the foam belt (FIG. 2A, element 102). |
| H_base + H_bevel = H_total | As shown in FIG. 2C, the height, H_base, of the foam belt base section plus the height, H_bevel, of the foam belt's superjacent bevel section equals the total height, H_total, of the foam belt. |
| H_closure_RegionA_base + H_closure_RegionA_bevel = H_total | Referring to FIGS. 2A, 2D, and 7F, the height, H_closure_RegionA_base, of Closure Region A's base, plus the height, H_closure_RegionA_bevel, of Closure Region A's bevel, equals the total height of the foam belt because Closure Region A's cutout is from the low side of the foam belt's bevel, therefore only the high side of the foam belt with height H_total is left after the Closure Region A cutout is formed. |
| H_closure_RegionB_base + H_closure_RegionB_bevel < H_total | Referring to FIGS. 2A, 2E 7F, and 12E, the height, H_closure_RegionB_base, of Closure Region B's base, plus the height, H_closure_RegionB_bevel, of Closure Region B's bevel, is less than the total height, H_total, of the foam belt because Closure Region B's cutout is from the high side of the foam belt's bevel, therefore the part of Closure Region B that would have reached as high as H_total has been removed. |
| H_closure_RegionB_base < H_closure_RegionA_base | Referring to FIGS. 2D, 2E, 7F, and 12D, Closure Region B's base height is less than Closure Region A's base height because Closure Region B's base height is measured from the bottom of the foam rubber to the lowest point of the beveled top surface, which is unlike Closure Regions A's base height which is measured from the bottom of the foam rubber to the beginning of the Closure Region's beveled section which is further up the bevel's slope since the lower portion is removed to form the Closure Region A cutout. |
| H_closure_RegionA_base > H_base | FIGS. 2A, 2D, and 7F; the base height is the distance from the bottom of the foam belt to the lowest point of the bevel, thus closure region A's base height is greater than the foam belt's base height because |

-continued

| Relationships | Support/Explanation |
|---|---|
| | closure region A's cutout removes the lower portion of the foam belt's bevel |
| H_closure_RegionB_base = H_base | FIGS. 2A, 2E, and 7F; the base height is the distance from the bottom of the foam belt to the lowest point of the bevel, thus closure region B's base height is the same as the foam belt's base height because closure region B's cutout removes the upper portion of the foam belt's bevel |
| $\angle\alpha_D = \angle\alpha_E = \angle\alpha$ | Referring to FIGS. 2C, 2D, 2E, and 7F. the bevel slope angle is the same regardless of the thickness of the base section; (two parallel lines cut by a transversal -> alternate interior angles are equal) |

In some illustrative embodiments an apparatus includes a foam belt, the foam belt having a base portion with a rectangular cross-section, a bevel portion with a triangular cross-section disposed superjacent the base portion, a first closure region at a first end of the foam belt, and a second closure region at a second end of the foam belt; a first attachment means attached to the first closure region; and a second attachment means attached to the second closure region; wherein the foam belt has an outer surface having a first coefficient of friction, and an inner surface having a second coefficient of friction; wherein the first attachment means and the second attachment means are configured to attachably engage with each other. The foam belt may comprise polyurethane foam rubber or latex foam rubber. The first attachment means may be a loop portion of a hook and loop fastener; a backside of the loop portion adhered to a surface of the first closure region; the second attachment means may be a hook portion of the hook and loop fastener; and a backside of the hook portion adhered to a surface of the second closure region. The first coefficient of friction and the second coefficient of friction are nominally equal. at least one of the loop portion and hook portion comprises a plurality of separate strips, each strip attached to its respective closure region.

In some alternative embodiments, at least one of the loop portion and the hook portion are adhered within a corresponding recessed portion of its respective closure region. In still further alternative embodiments, the first coefficient of friction and the second coefficient of friction are different from each other by a predetermined amount.

In some illustrative embodiments, the base portion has a thickness and a height, and the bevel portion has a slope and a height; and the ratio of the height of the bevel portion to the height of the base portion is 0.4 when the slope is about 38.7°. In some embodiments, the ratio of the height of the bevel portion to the height of the base portion is in the range of 0.36 to 0.44 when the slope is in the range of 35.4° to 41.3°. Alternative embodiments may have other dimensions and ratios.

In some illustrative embodiments, the foam belt comprises an open-cell foam; and the base portion and the bevel portion are integral with each other.

In some illustrative embodiments, the first attachment means and the second attachment means are attached, respectively, to the first closure region and the second closure region by an adhesive.

In some illustrative embodiments, the adhesive may be a spray adhesive suitable for use with foam rubber and fabric. By way of example and not limitation, Dan Tack 2012 Professional Quality Foam & Fabric spray adhesive may be used.

In some illustrative embodiments, Closure Region A 103 and Closure Region B 107 are treated with a polyester resin in order to increase their respective strengths.

In some illustrative embodiments a foam belt comprises a shaped foam rubber structure, wherein the shaped foam rubber structure has a base portion with a rectangular cross-section, a bevel portion with a triangular cross-section disposed superjacent the base portion, a first closure region at a first end of the shaped foam rubber structure, and a second closure region at a second end of the shaped foam rubber structure; a first hook and loop fastener attached to the first closure region; and a second hook and loop fastener attached to the second closure region; wherein the shaped foam rubber structure has an outer surface having a first coefficient of friction, and an inner surface having a second coefficient of friction. The hook portions of the hook and loop fastener may have any suitable shape, including but not limited to, rectangles, trapezoids, circles, ovals, letters or numbers, or polygons. For embodiments having a plurality of hook portions, those hook portions may have the same or different shapes, and may have the same of different sizes.

In some illustrative embodiments, a foam belt includes a shaped polyurethane foam rubber structure, wherein the shaped polyurethane foam rubber structure has a first base portion with a first rectangular cross-section, a first bevel portion with a first triangular cross-section superjacent the first base portion, a first closure region at a first end of the shaped polyurethane foam rubber structure, and a second closure region at a second end of the shaped polyurethane foam rubber structure, wherein the first end and the second end are at opposite ends of the shaped polyurethane foam rubber structure; a first portion of a hook and loop fastener attached to the first closure region; and a second portion of the hook and loop fastener attached to the second closure region; wherein the first closure region has a second rectangular cross-section that is different than the first rectangular cross-section, a second bevel portion with a second triangular cross-section that is different from the first triangular cross-section, wherein the second closure region has a third rectangular cross-section that is different than the first rectangular cross-section, and a third bevel portion with a third triangular cross-section that is different from the first triangular cross-section and different from the second triangular cross-section.

In some embodiments the foam belt has a first color, the first portion of the hook and loop fastener has a second color, and the second portion of the hook and loop fastener has a third color. The first, second and third colors may be the same. In one illustrative alternative, the second and third colors may be the same as each other, while also both being different from the first color.

In some illustrative embodiments, an apparatus, includes a foam belt having a first length, a first base portion with a first rectangular cross-section having a first height, an integral bevel portion of a second length superjacent the first base portion and having a first triangular cross-section with a second height, a first closure region at a first end region of the foam belt, a second closure region at a second end region of the foam belt, opposite the first end region, wherein the first closure region has third length, and a second rectangular cross-section having a third height, and the second closure region has a fourth length, and a third rectangular cross-section having a fourth height; a loop portion of a hook and loop fastener attached to the first closure region; and a hook portion of the hook and loop fastener attached to the second closure region; wherein the third height equals the first height plus the second height, and the fourth height equals the third height, and wherein the second length equals the first length minus the third length and minus the fourth length.

It is to be appreciated that the Detailed Description section, and not the Abstract of the Disclosure, is intended to be used to interpret the claims. The Abstract of the Disclosure may set forth one or more but not all contemplated embodiments and thus, the Abstract of the Disclosure is not intended to limit the subjoined claims.

This disclosure outlines features of several embodiments so that those skilled in the art may better understand that which is disclosed herein. Those skilled in the art will appreciate that they may readily use this disclosure as a basis for designing or modifying other methods and apparatuses for carrying out the same purposes or achieving the same advantages of the embodiments introduced herein. Those skilled in the art will also realize that such equivalent constructions do not depart from the spirit and scope of this disclosure, and that various changes, substitutions, and alterations may be made without departing from the spirit and scope of the subjoined claims.

What is claimed is:

1. An apparatus, comprising:

a foam belt, the foam belt having a first base portion with a rectangular cross-section, a first bevel portion with a first triangular cross-section superjacent the first base portion;

a first closure region at a first end of the foam belt, the first closure region having second bevel portion with a second triangular cross-section, and the first closure region being integral with the foam belt;

a second closure region at a second end of the foam belt, the second end being at an opposite end of the foam belt relative to the first end of the foam belt, the second closure region having a third bevel portion with a third triangular cross-section, and the second closure region being integral with the foam belt; and an attachment mechanism having a first portion attached to the first closure region, and a second portion attached to the second closure region;

wherein the first portion of the attachment mechanism and the second portion of the attachment mechanism are configured to detachably engage with each other;

wherein a first force required to detach the first and second portions of the attachment mechanism from engagement with each other is less than a second force required to remove the first portion of the attachment mechanism from the first closure region, wherein the base portion of the foam belt has a thickness T_base, and a height H_base;

wherein the bevel portion of the foam belt has a height H_bevel, and a bevel slope $\angle\alpha$;

wherein the first closure region of the foam belt has a thickness T_base_D, a base height H_closure_RegionA_base, a bevel height H_closure_RegionA_bevel, and a bevel slope $\angle\alpha_D$;

wherein the second closure region has a thickness T_base_E, a base height H_closure_RegionB_base, a bevel height H_closure_RegionB_bevel, and a bevel slope $\angle\alpha_E$;

wherein:

$$T_base_D<T_base,$$

$$T_base_E<T_base,$$

$$H_base+H_bevel=H_total,$$

$$H_closure_RegionA_base+H_closure_RegionA_bevel=H_total;$$

$$H_closure_RegionB_base+H_closure_RegionB_bevel<H_total;$$

$$H_closure_RegionB_base<H_closure_RegionA_base;$$

$$H_closure_RegionA_base>H_base;$$

$$H_closure_RegionB_base=H_base;\text{ and}$$

$$\angle\alpha_D=\angle\alpha_E=\angle\alpha.$$

2. The apparatus of claim 1, wherein T_base_D+T_base_E≥T_base, wherein when the foam belt is in a closed configuration, a groove is formed between the second bevel portion of the first closure region and the third bevel portion of the second closure region, and wherein the groove is at least partially bounded by a sloped portion of the second bevel and a non-sloped portion of the third bevel portion.

3. The apparatus of claim 1, wherein when the foam belt is in a closed configuration, a groove is formed between the second bevel portion of the first closure region and the third bevel portion of the second closure region.

4. The apparatus of claim 1, wherein the foam belt comprises polyurethane foam rubber having an open cell structure.

5. The apparatus of claim 1, wherein the foam belt comprises latex foam rubber having an open cell structure.

6. The apparatus of claim 1, wherein the foam belt in an open configuration has a first surface having a first coefficient of friction, and a second surface having a second coefficient of friction, and wherein the foam belt in a closed configuration has a third coefficient of friction for the first surface, and a fourth coefficient of friction for the second surface.

7. The apparatus of claim 6, wherein the first coefficient of friction and the second coefficient of friction are the same.

8. The apparatus of claim 1, wherein the attachment mechanism is a hook and loop fastener, the first portion of the attachment mechanism is a loop portion of the hook and loop fastener, the second portion of the attachment mechanism is a hook portion of the hook and loop fastener, a backside of the loop portion is attached to a surface of the first closure region, and a backside of the hook portion is attached to a surface of the second closure region.

9. The apparatus of claim 8, wherein at least one of the loop portion and hook portion comprises a plurality of spaced apart strips, each strip attached to its respective closure region.

10. A foam belt, comprising:

a shaped polyurethane foam rubber structure, wherein the shaped polyurethane foam rubber structure has a first base portion with a first rectangular cross-section, a first bevel portion with a first triangular cross-section superjacent the first base portion, a first closure region at a first end of the shaped polyurethane foam rubber structure and integral therewith, and a second closure region at a second end of the shaped polyurethane foam rubber structure and integral therewith, wherein the first end and the second end are at opposite ends of the shaped polyurethane foam rubber structure;

a first portion of a hook and loop fastener attached to the first closure region; and a second portion of the hook and loop fastener attached to the second closure region;

wherein the first closure region has a second base portion with a second rectangular cross-section that is different than the first rectangular cross-section, a second bevel portion with a second triangular cross-section that is different from the first triangular cross-section, wherein the second closure region has a third base portion with a third rectangular cross-section that is different than the first rectangular cross-section, and a third bevel portion with a third triangular cross-section that is different from the first triangular cross-section and different from the second triangular cross-section, and wherein the first base portion is not within the first closure region and not within the second closure region;

wherein the first base portion has a height H_base, and the first bevel portion has a height H_bevel;

wherein the first closure region has a base height H_closure_RegionA_base, and a bevel height H_closure_RegionA_bevel;

wherein the second closure region has a base height H_closure_RegionB_base, and a bevel height H_closure_RegionB_bevel;

wherein:

H_base+H_bevel=H_total,

H_closure_RegionA_base+H_closure_RegionA_bevel=H_total,

H_closure_RegionB_base+H_closure_RegionB_bevel<H_total, and

H_closure_RegionB_base<H_closure_RegionA_base,

H_closure_RegionA_base>H_base, and

H_closure_RegionB_base=H_base.

11. The foam belt of claim 10, wherein the shaped polyurethane foam rubber structure has a first color, the first portion of the hook and loop fastener has a second color, and the second portion of the hook and loop fastener has a third color.

12. The foam belt of claim 11, wherein the shaped polyurethane foam rubber structure has an outer surface having a first coefficient of friction, and an inner surface having a second coefficient of friction, and wherein the first color and the second color are the same.

13. The foam belt of claim 10, wherein the first portion of the hook and loop fastener comprises a hook portion, and the second portion of the hook and loop fastener comprises a loop portion.

14. The foam belt of claim 10, wherein the first portion of the hook and loop fastener comprises a loop portion, and the second portion of the hook and loop fastener comprises a hook portion.

15. The foam belt of claim 10, wherein a first force required to detach the first and second portions of the hook and loop fastener from engagement with each other is less than a second force required to remove the first portion of the hook and loop fastener from the first closure region.

* * * * *